US007324123B2

(12) United States Patent
Yamazaki et al.

(10) Patent No.: US 7,324,123 B2
(45) Date of Patent: Jan. 29, 2008

(54) DISPLAY DEVICE AND ELECTRONIC APPARATUS

(75) Inventors: Shunpei Yamazaki, Tokyo (JP); Jun Koyama, Kanagawa (JP); Yoshifumi Tanada, Kanagawa (JP); Mitsuaki Osame, Kanagawa (JP); Hajime Kimura, Kanagawa (JP); Ryota Fukumoto, Kanagawa (JP); Hiromi Yanai, Kanagawa (JP); Hideaki Shishido, Kanagawa (JP)

(73) Assignee: Semiconductor Energy Laboratory Co., Ltd., Atsugi-shi (JP)

( * ) Notice: Subject to any disclaimer, the term of this patent is extended or adjusted under 35 U.S.C. 154(b) by 0 days.

(21) Appl. No.: 11/419,345

(22) Filed: May 19, 2006

(65) Prior Publication Data

US 2006/0262054 A1 Nov. 23, 2006

(30) Foreign Application Priority Data

May 20, 2005 (JP) ..... 2005-148838

(51) Int. Cl.
*G09G 5/10* (2006.01)
*G09G 3/32* (2006.01)

(52) U.S. Cl. ..... 345/690; 345/77; 345/82; 345/207; 315/169.3

(58) Field of Classification Search ..... 345/60–83, 345/204, 690, 207, 205; 315/169.3, 169.4; 713/300, 322
See application file for complete search history.

(56) References Cited

U.S. PATENT DOCUMENTS

| | | | | |
|---|---|---|---|---|
| 5,990,629 | A * | 11/1999 | Yamada et al. | 315/169.3 |
| 6,265,833 | B1 * | 7/2001 | Kim et al. | 315/169.3 |
| 6,339,422 | B1 | 1/2002 | Kuwajima et al. | |
| 6,380,689 | B1 * | 4/2002 | Okuda | 315/169.3 |
| 6,693,614 | B2 * | 2/2004 | Kamiya et al. | 345/89 |
| 6,879,110 | B2 | 4/2005 | Koyama | |
| 6,909,243 | B2 | 6/2005 | Inukai | |
| 6,995,753 | B2 * | 2/2006 | Yamazaki et al. | 345/204 |
| 2001/0022565 | A1 | 9/2001 | Kimura | |
| 2002/0047568 | A1 | 4/2002 | Koyama | |
| 2002/0047852 | A1 | 4/2002 | Inukai et al. | |
| 2003/0011626 | A1 * | 1/2003 | Tanabe et al. | 345/690 |

(Continued)

FOREIGN PATENT DOCUMENTS

EP 1 103 946 A2 5/2001

(Continued)

*Primary Examiner*—Lun-Yi Lao
(74) *Attorney, Agent, or Firm*—Fish & Richardson P.C.

(57) ABSTRACT

Outside light is received using a light sensor, and in accordance with the outside light intensity, each of a first display mode which expresses multiple gray scales and a second display-y mode which expresses a gray scale smaller in number than that in the first display mode is switched and used. The switching is controlled by a display controller based on data of the outside light intensity. Accordingly, the visibility can be ensured in a wide range of situations, from under a fluorescent lamp in a dark place or inside, to under sunlight outside. In the second display mode, frequencies of a start pulse and a clock pulse to be inputted to a source signal line driver circuit are reduced and a driving voltage is decreased by the display controller; accordingly, a frame period can be longer than that in the first display mode and power consumption can be reduced.

27 Claims, 48 Drawing Sheets

U.S. PATENT DOCUMENTS

| | | | | |
|---|---|---|---|---|
| 2003/0112257 | A1* | 6/2003 | Tamura | 345/690 |
| 2003/0197667 | A1 | 10/2003 | Numao | |
| 2004/0012550 | A1 | 1/2004 | Koyama | |
| 2004/0095364 | A1* | 5/2004 | Koyama et al. | 345/690 |
| 2005/0116914 | A1 | 6/2005 | Nagao et al. | |
| 2005/0253835 | A1* | 11/2005 | Kawase | 345/207 |

FOREIGN PATENT DOCUMENTS

| | | |
|---|---|---|
| EP | 1 184 833 A2 | 3/2002 |
| JP | 11-133921 | 5/1999 |
| JP | 3110257 | 11/2000 |
| JP | 2001-324958 | 11/2001 |
| JP | 2001-343933 | 12/2001 |
| JP | 2002-108264 | 4/2002 |
| JP | 2002-108285 | 4/2002 |
| JP | 2002-149113 | 5/2002 |
| JP | 2004-004501 | 1/2004 |

* cited by examiner

FIG. 5

| A \ B | SF1 | SF2 | SF3 | SF4 |
|---|---|---|---|---|
| | 1 | 2 | 4 | 8 |
| 0 | × | × | × | × |
| 1 | ○ | × | × | × |
| 2 | × | ○ | × | × |
| 3 | ○ | ○ | × | × |
| 4 | × | × | ○ | × |
| 5 | ○ | × | ○ | × |
| 6 | × | ○ | ○ | × |
| 7 | ○ | ○ | ○ | × |
| 8 | × | × | × | ○ |
| 9 | ○ | × | × | ○ |
| 10 | × | ○ | × | ○ |
| 11 | ○ | ○ | × | ○ |
| 12 | × | × | ○ | ○ |
| 13 | ○ | × | ○ | ○ |
| 14 | × | ○ | ○ | ○ |
| 15 | ○ | ○ | ○ | ○ |

A: number of gray scales

B: display period

○ : lightming

× : non-lightning

FIG. 6A

| A \ B | SF1 | SF2 | SF3 | SF4 | SF5 |
|---|---|---|---|---|---|
| | 1 | 2 | 4 | 4 | 4 |
| 0 | × | × | × | × | × |
| 1 | ○ | × | × | × | × |
| 2 | × | ○ | × | × | × |
| 3 | ○ | ○ | × | × | × |
| 4 | × | × | ○ | × | × |
| 5 | ○ | × | ○ | × | × |
| 6 | × | ○ | ○ | × | × |
| 7 | ○ | ○ | ○ | × | × |
| 8 | × | × | ○ | ○ | × |
| 9 | ○ | × | ○ | ○ | × |
| 10 | × | ○ | ○ | ○ | × |
| 11 | ○ | ○ | ○ | ○ | × |
| 12 | × | × | ○ | ○ | ○ |
| 13 | ○ | × | ○ | ○ | ○ |
| 14 | × | ○ | ○ | ○ | ○ |
| 15 | ○ | ○ | ○ | ○ | ○ |

FIG. 6B

| A \ B | SF1 | SF2 | SF3 | SF4 | SF5 |
|---|---|---|---|---|---|
| | 4 | 2 | 1 | 4 | 4 |
| 0 | × | × | × | × | × |
| 1 | × | × | ○ | × | × |
| 2 | × | ○ | × | × | × |
| 3 | × | ○ | ○ | × | × |
| 4 | × | × | × | ○ | × |
| 5 | × | × | ○ | ○ | × |
| 6 | × | ○ | × | ○ | × |
| 7 | × | ○ | ○ | ○ | × |
| 8 | ○ | × | × | ○ | × |
| 9 | ○ | × | ○ | ○ | × |
| 10 | ○ | ○ | × | ○ | × |
| 11 | ○ | ○ | ○ | ○ | × |
| 12 | ○ | × | × | ○ | ○ |
| 13 | ○ | × | ○ | ○ | ○ |
| 14 | ○ | ○ | × | ○ | ○ |
| 15 | ○ | ○ | ○ | ○ | ○ |

A: number of gray scales

B: display period

○ : lightming

× : non-lightning

FIG. 7

| A \ B | SF1 | SF2 | SF3 |
|---|---|---|---|
| | 1 | 2 | 4 |
| 0 | × | × | × |
| 1 | ○ | × | × |
| 2 | × | ○ | × |
| 3 | ○ | ○ | × |
| 4 | × | × | ○ |
| 5 | ○ | × | ○ |
| 6 | × | ○ | ○ |
| 7 | ○ | ○ | ○ |

A: number of gray scales

B: display period

○ : lightming

× : non-lightning

FIG. 8A

| A \ B | SF1 | SF2 | SF3 | SF4 |
|---|---|---|---|---|
| | 1 | 2 | 2 | 2 |
| 0 | × | × | × | × |
| 1 | ○ | × | × | × |
| 2 | × | ○ | × | × |
| 3 | ○ | ○ | × | × |
| 4 | × | ○ | ○ | × |
| 5 | ○ | ○ | ○ | × |
| 6 | × | ○ | ○ | ○ |
| 7 | ○ | ○ | ○ | ○ |

FIG. 8B

| A \ B | SF1 | SF2 | SF3 | SF4 |
|---|---|---|---|---|
| | 2 | 2 | 1 | 2 |
| 0 | × | × | × | × |
| 1 | × | × | ○ | × |
| 2 | × | ○ | × | × |
| 3 | × | ○ | ○ | × |
| 4 | × | ○ | × | ○ |
| 5 | × | ○ | ○ | ○ |
| 6 | ○ | ○ | × | ○ |
| 7 | ○ | ○ | ○ | ○ |

A: number of gray scales

B: display period

○ : lightming

× : non-lightning

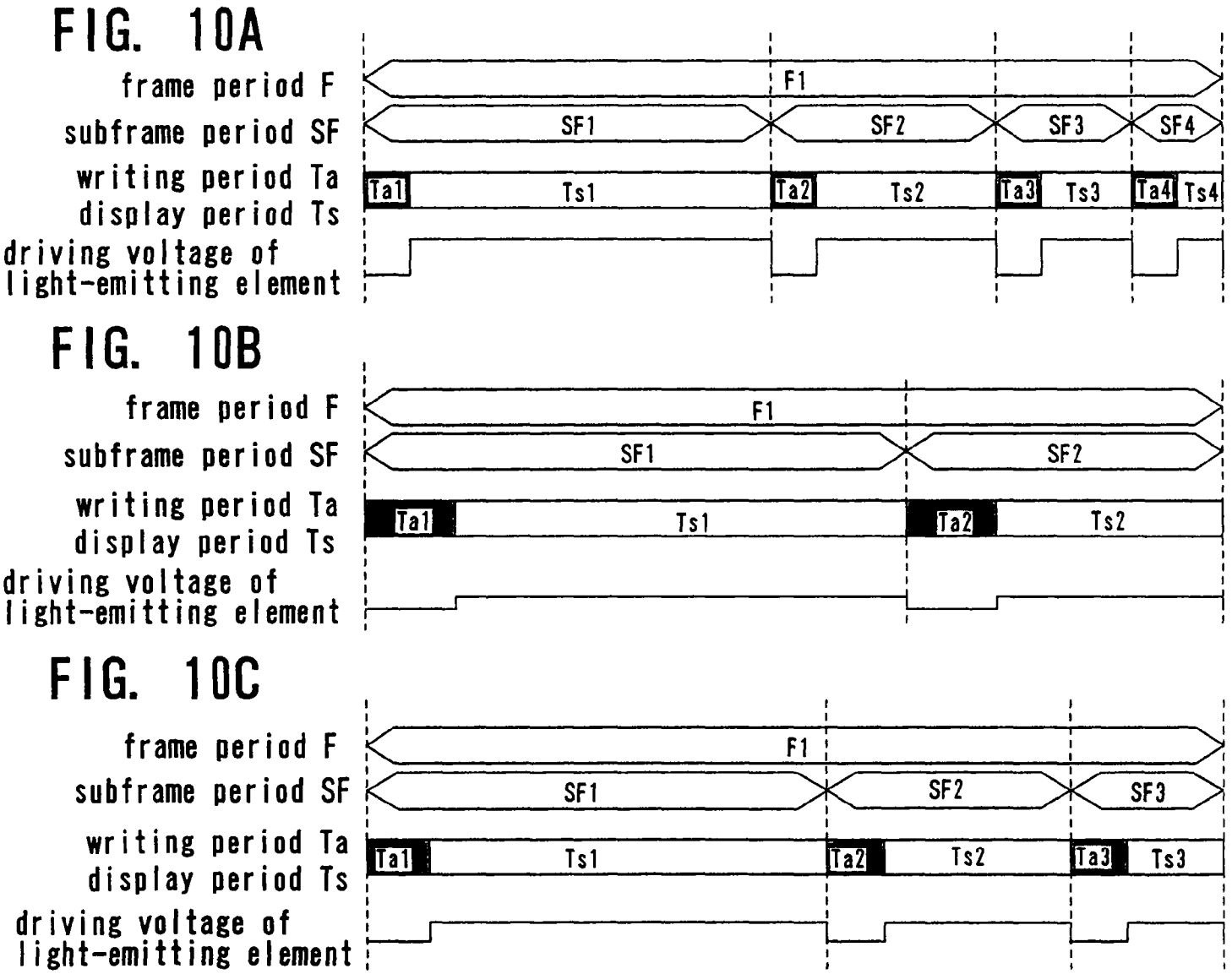
FIG. 10A
frame period F
subframe period SF
writing period Ta
display period Ts
driving voltage of light-emitting element
F1
SF1
SF2
SF3
SF4
Ta1
Ts1
Ta2
Ts2
Ta3
Ts3
Ta4
Ts4
FIG. 10B
frame period F
subframe period SF
writing period Ta
display period Ts
driving voltage of light-emitting element
F1
SF1
SF2
Ta1
Ts1
Ta2
Ts2
FIG. 10C
frame period F
subframe period SF
writing period Ta
display period Ts
driving voltage of light-emitting element
F1
SF1
SF2
SF3
Ta1
Ts1
Ta2
Ts2
Ta3
Ts3

DISPLAY DEVICE AND ELECTRONIC APPARATUS

BACKGROUND OF THE INVENTION

1. Field of the Invention

The present invention relates to a display device for performing display of an image by inputting a digital video signal. In particular, the present invention relates to a display device having light-emitting elements. Further, the present invention relates to an electronic apparatus using the display device.

2. Description of the Related Art

A display device having a light-emitting element in each pixel and which performs display of an image by controlling light emission of the light-emitting elements is described below.

The description in this specification is made using an element (OLED element) having a structure in which an organic compound layer which emits light when an electric field is generated is sandwiched between an anode and a cathode, as a light-emitting element; however, the invention is not limited to this. Any element which emits light by applying an electric field between the anode and the cathode can be freely used.

A display device is constituted by a display and a peripheral circuit for inputting a signal to the display.

As for constitution of the display, a block diagram is shown in FIG. 36. In FIG. 36, a display 3600 is constituted by a source signal line driver circuit 3601, a gate signal line driver circuit 3602, and a pixel portion 3603. The pixel portion includes pixels disposed in matrix.

In each pixel of the pixel portion, a thin film transistor (hereinafter referred to as a TFT) is disposed. Here, a method is described in which two TFTs are disposed in each pixel and light emission of a light-emitting element of each pixel is controlled.

A configuration of the pixel portion of the display is shown in FIG. 37. In a pixel portion 3700, source signal lines S1 to Sx, gate signal lines G1 to Gy, and power supply lines V1 to Vx are disposed, and pixels of x columns (where x is a natural number) and y rows (where y is a natural number) are disposed. Each pixel 3800 has a selecting TFT 3801, a driving TFT 3802, a storage capacitor 3803, and a light-emitting element 3804.

An enlarged diagram of one pixel of the pixel portion of FIG. 37 is shown in FIG. 38. The pixel is constituted by one source signal line S of the source signal lines S1 to Sx, one gate signal line G of the gate signal lines G1 to Gy, one power supply line V of the power supply lines V1 to Vx, the selecting TFT 3801, the driving TFT 3802, the storage capacitor 3803, and the light-emitting element 3804.

A gate electrode of the selecting TFT 3801 is connected to the gate signal line G, and one of either a source region or a drain region of the selecting TFT 3801 is connected to the source signal line S, while the other one is connected to a gate electrode of the driving TFT 3802 and to one electrode of the storage capacitor 3803. One of either a source region or a drain region of the driving TFT 3802 is connected to the power supply line V, while the other one is connected to an anode or a cathode of the light-emitting element 3804. The other electrode of the two electrodes of the storage capacitor 3803, which is not connected to the driving TFT 3802 and the selecting TFT 3801, is connected to the power supply line V.

In this specification, the anode of the light-emitting element 3804 is referred to as a pixel electrode whereas the cathode thereof is referred to as an opposing electrode in the case where the source region or the drain region of the driving TFT 3802 is connected to the anode of the light-emitting element 3804. On the other hand, in the case where the source region or the drain region of the driving TFT 3802 is connected to the cathode of the light-emitting element 3804, the cathode of the light-emitting element 3804 is referred to as a pixel electrode whereas the anode of the light-emitting element 3804 is referred to as an opposing electrode.

Further, a potential supplied to the power supply line V is referred to as a power supply potential, and a potential supplied to the opposing electrode is referred to as an opposing potential.

The selecting TFT 3801 and the driving TFT 3802 may both be either a p-channel TFT or an n-channel TFT.

Note that the storage capacitor 3803 need not always be provided.

For example, when an n-channel TFT used as the driving TFT 3802 has an LDD region formed so as to overlap with a gate electrode through a gate insulating film, parasitic capacitance generally called as gate capacitance is formed in this overlapping region. It is also possible to actively use this parasitic capacitance as a storage capacitor for storing a voltage applied to the gate electrode of the driving TFT 3802.

Operation in displaying an image with the pixel having the above-described configuration is described below.

A signal is inputted to the gate signal line G, and the potential of the gate electrode of the selecting TFT 3801 is changed. Through the source and the drain of the selecting TFT 3801 which are thus electrically connected, a signal is inputted to the gate electrode of the driving TFT 3802 from the source signal line S. Further, the signal is stored in the storage capacitor 3803. The gate voltage of the driving TFT 3802 is changed by the signal inputted to the gate electrode of the driving TFT 3802, thereby the source and the drain thereof are electrically connected. A potential of the power supply line V is supplied to the pixel electrode of the light-emitting element 3804 through the driving TFT 3802. In this manner, the light-emitting element 3804 emits light.

A method of expressing a gray scale with pixels having such a configuration is described.

Gray scale expression methods can be roughly classified into an analog method and a digital method. Compared to the analog method, the digital method has the advantages of not being affected by variations of a TFT as much, and being suitable for multiple gray scales.

As one example of a digital gray scale expression method, a time gray scale method is known. A time gray scale driving method is a method of expressing a gray scale by controlling a period during which each pixel of a display device emits light (see Patent Document 1).

Providing that a period for displaying one image is one frame period, one frame period is divided into a plurality of subframe periods.

Lighting or non-lighting, that is, whether the light-emitting element of each pixel is made to emit light or not is performed for each subframe period. The period during which the light-emitting element emits light in one frame period is controlled, thereby a gray scale for each pixel is expressed.

This time gray scale driving method is described in detail using timing charts in FIGS. 39A and 39B. Note that an example of expressing a gray scale by using a 4-bit digital video signal is shown in FIGS. 39A and 39B. Note also that FIG. 37 and FIG. 38 are referred to as the configurations of a pixel and a pixel portion thereof. Here, by an external power source (not shown), an opposing potential can be switched over between the same level of potential as a potential (power supply potential) of each of the power supply lines V1 to Vx, and a potential such that there is a potential difference from the potential of each of the power supply lines V1 to Vx to an extent that the light-emitting element 3804 emits light.

One frame period F1 is divided into a plurality of subframe periods SF1 to SF4 in FIG. 39A.

The gate signal line G1 is selected first in the first subframe period SF1, and a digital video signal is inputted from the source signal lines S1 to Sx to the respective pixels having the selecting TFTs 3801 with gate electrodes connected to the gate signal line G1. The driving TFT 3802 of each pixel is turned on or off by the inputted digital video signal.

Here in this specification, the term "a TFT being turned on" means that the source and the drain are electrically connected to each other by a gate voltage thereof. Further, the term "a TFT being turned off" means that the source and the drain are not electrically connected to each other by the gate voltage.

At this time, the opposing potential of the light-emitting element 3804 is set to be nearly equal to the potential (power supply potential) of each of the power supply lines V1 to Vx, therefore, the light-emitting element 3804 does not emit light even in a pixel in which the driving TFT 3802 is turned on.

Here, FIG. 39B is a timing chart showing operation of inputting a digital video signal to the driving TFT 3802 of each pixel.

In FIG. 39B, periods during which a source signal line driver circuit (not shown) samples signals corresponding to the respective source signal lines are denoted by reference symbols S1 to Sx. The sampled signals are outputted at the same time to all of the source signal lines in a blanking period in the figure. The signals thus outputted are inputted to the gate electrodes of the driving TFTs 3802 in the pixels which are selected by a gate signal line.

The aforementioned operation is repeated for all of the gate signal lines G1 to Gy, and a writing period Ta1 is completed. Note that a writing period of the first subframe period SF1 is referred to as Ta1. In general, a writing period of the j-th subframe period (where j is a natural number) is referred to as Taj.

When the writing period Ta1 is complete, the opposing potential changes so as to have a potential difference from the power supply potential to an extent that the light-emitting element 3804 emits light. A display period Ts1 thus starts. Note that a display period of the first subframe period SF1 is referred to as Ts1. In general, a display period of the j-th subframe period (where j is a natural number) is referred to as Tsj. In the writing period Ts1, the light-emitting element 3804 of each pixel emits light or does not emit light in accordance with the inputted signal.

The above operation is repeated for all of the subframe periods SF1 to SF4, thereby completing one frame period F1. Here, the length of the display periods Ts1 to Ts4 of the subframe periods SF1 to SF4 are set appropriately, and per frame period F1, a gray scale is expressed by the sum total of the display period during which the light-emitting element 3804 emits light, of the subframe period. That is, a gray scale is expressed by the sum total of the lighting time within one frame period.

A method of expressing $2^n$ gray scales by inputting an n-bit digital video signal is described in general. At this case, for example, one frame period is divided into n subframe periods SF1 to SFn, and the ratio of the length of the display periods Ts1 to Tsn of the subframe periods SF1 to SFn is set so as to be Ts1:Ts2: . . . :Tsn−1:Tsn=$2^0$:$2^{-1}$: . . . :$2^{-(n-2)}$:$2^{-(n-1)}$. Note that the lengths of the writing periods Ta1 to Tan are equal.

By calculating the sum total of a display period Ts during which light emission state is selected in the light-emitting element 3804 within one frame period, the gray scale level of the pixel in the frame period is determined. For example, providing that n is 8 and the luminance when the pixel emits light in all the display periods is 100%, a luminance of 1% can be expressed in the case where the pixel emits light in Ts8 and Ts7, and a luminance of 60% can be expressed in the case where Ts6, Ts4 and Ts1 are selected.

Note that one subframe period may be further divided into a plurality of subframe periods.

Here, it has been required that a display device consumes as little power as possible. Low power consumption has especially been required in the case where a display device is incorporated into portable information equipment or the like and used.

In that case, in the above-described display device for expressing $2^4$ gray scales by inputting a 4-bit digital video signal, a method for reducing power consumption of the display device has been used in which only an upper one-bit signal is used to express a gray scale. (see Patent Document 2)

[Patent Document 1]
Japanese Patent Laid-Open No. 2001-343933

[Patent Document 2]
Japanese Patent Laid-Open No.Hei11-133921

A timing chart showing a driving method of a display device in a first display mode which expresses $2^4$ gray scales is shown in FIG. 40A and a timing chart showing a driving method of a display device in a second display mode which expresses a gray scale by using only an upper one-bit signal is shown in FIG. 40B.

Since one subframe period may be provided in the second display mode, the respective frequencies of a start pulse and a clock pulse inputted to each driver circuit (a source signal line driver circuit and a gate signal line driver circuit) can be reduced, and power consumption can be reduced more than in the case where the upper one-bit gray scale is expressed in the first display mode.

In addition, in the case where the total length of time of a writing period in the first display mode is longer than the total length of time of a writing period in the second display mode, by changing a voltage between the cathode and the anode of the light-emitting element in accordance with a period of performing display, the rate of effective lighting period per frame period is increased.

However, in such a display device, an input voltage of each driver circuit is equal in the first display mode and the second display mode, therefore, further low power consumption cannot be achieved.

In addition, a conventional display device has had a problem in that when it is exposed to strong outside light, the outside light exceeds light emission of a light-emitting element and the display becomes blurred. For example, the case of a mobile phone using a conventional display device is shown in FIGS. 42A and 42B. With respect to screen display shown in FIG. 42A, the screen display is perceived as almost black when it is exposed to strong outside light as shown in FIG. 42B. A display device using liquid crystal solves this problem by using a reflective liquid crystal display device. However, in the display device using a light-emitting element, in principle, the same way of solving the problem cannot be applied. Therefore, there is a problem.

SUMMARY OF THE INVENTION

An object of the invention is to provide a display device in which, by changing the number of gray scales of an image in accordance with the intensity of outside light, namely, the brightness of the surroundings, visibility can be ensured in a wide range of situations, from under a fluorescent lamp in a dark place or inside, to under sunlight outside, and moreover in which power consumption is reduced further when performing a drive in which the number of gray scales to be expressed is reduced.

The display device of the invention has a first display mode capable of displaying a high gray scale level and a second display mode which expresses two gray scales and of which power consumption is low, and each display mode can be switched and used. Note that the display device of the invention is provided with a light sensor for detecting the intensity of outside light, and when outside light with an intensity higher than a certain intensity is detected, the display mode is switched to the second display mode in which the number of gray scales is small, thereby allowing an image to be perceived clearly. In addition, in the second display mode, unlike in the first display mode, a lower-bit signal of a digital video signal is prevented from being written into a memory by a memory controller of a signal controlling circuit included in the display device. In addition, reading of a lower-bit digital video signal from the memory is prevented. In this way, as compared to a digital video signal (a first digital video signal) in the first display mode, each driver circuit inputs a digital video signal (a second digital video signal) with a reduced amount of information, to the source signal line driver circuit. Corresponding to this operation, the display controller changes the frequencies of a start pulse and a clock pulse which are inputted to each driver circuit (the source signal line driver circuit and the gate signal line driver circuit) so that they are small and changes the driving voltage so that it is low. According to the above, it is also possible to set a writing period and a display period relating to display to be long, is and reduce power consumption.

Note that two-gray scales display means display of two colors, white and black, in the case where the display device is a monochrome display device, and means display of eight colors in the case where the display device is a color display device.

In addition, as compared to the first display mode, one frame period itself can also be set to be long in the second display mode. Further, needless to say, a start pulse and a clock pulse can be stopped in a period when the display content is determined and writing is not required.

In addition, when driving the display device in the second display mode, the voltage for operating the display controller may be set to be low so that the power consumption of the display controller can be reduced.

According to the structure described above, a display device in which power consumption is low and the percentage of effective lighting period is high in the second display mode can be provided.

One feature of a display device of the invention includes a display, a display controller, and a light sensor, and the display device has at least a first display mode or a second display mode. In the first display mode, one frame period is divided into a plurality of subframe periods, each of the subframe periods is either a lighting period or a non-lighting period, and an n-bit (n is a natural number equal to or more than 2) gray scale is expressed by the sum total of the lighting period within one frame period, and in the second display mode, the display is operated by a lower clock frequency and a lower driving voltage than in the first display mode, one frame period is either a lighting period or a non-lighting period, and a one-bit gray scale is expressed by the lighting period within one frame period are included. Outside light is received using the light sensor, and the first display mode and the second display mode are controlled by the display controller in accordance with the intensity of the outside light. A plurality of gate signal lines are selected within one gate selection period by dividing one gate selection period into a plurality of sub-gate selection periods and selecting a gate signal line of one row within one sub-gate selection period.

Another feature of the display device of the invention includes a display, a display controller, and a light sensor, and the display device has at least a first display mode or a second display mode. In the first display mode, one frame period is divided into a plurality of subframe periods, each of the subframe periods is either a lighting period or a non-lighting period, and an n-bit (n is a natural number equal to or more than 2) gray scale is expressed by the sum total of the lighting period within one frame period, and in the second display mode, the display is operated by a lower clock frequency and a lower driving voltage than in the first display mode, one frame period which is longer than one frame period in the first display mode is either a lighting period or a non-lighting period, and a one-bit gray scale is expressed by the lighting period within one frame period are included. Outside light is received using the light sensor, and the first display mode and the second display mode are controlled by the display controller in accordance with the intensity of the outside light. A plurality of gate signal lines are selected within one gate selection period by dividing one gate selection period into a plurality of sub-gate selection periods and selecting a gate signal line of one row within one sub-gate selection period, so that.

Another feature of the display device of the invention includes a display, a display controller, and a light sensor, and the display device has at least a first display mode or a second display mode. In the first display mode, one frame period is divided into a plurality of subframe periods, each of the subframe periods is either a lighting period or a non-lighting period, and an n-bit (n is a natural number equal to or more than 2) gray scale is expressed by the sum total of the lighting period within one frame period, and in the second display mode, the display is operated by a lower clock frequency and a lower driving voltage than in the first display mode, one frame period is divided into a plurality of subframe periods, each of the subframe periods is either a lighting period or a non-lighting period, and an m-bit (n is a natural number less than n) gray scale is expressed by the sum total of the lighting period within one frame period are included. Outside light is received using the light sensor, and the first display mode and the second display mode are controlled by the display controller in accordance with the intensity of the outside light. A plurality of gate signal lines are selected within one gate selection period by dividing one gate selection period into a plurality of sub-gate selection periods and selecting a gate signal line of one row within one sub-gate selection period.

Note that there may be a structure in which the intensity of outside light when the first display mode is selected is higher than the intensity of outside light when the second display mode is selected in the invention.

Note that there may be a structure in which the display device of the invention includes a frame memory, and n-bit data (where n is a natural number equal to or more than 2) is written into the frame memory and the n-bit data is read from the frame memory to perform display in the first display mode, and m-bit data (where m is a natural number less than n) is written into the frame memory and the m-bit data is read from the frame memory to perform display in the second display mode.

Note that there may be a structure in which the display device of the invention includes a light-emitting element in each pixel, and a voltage applied to the light-emitting element in the first display mode is higher than a voltage applied to the light-emitting element in the second display mode.

Note that there may be a structure in which the display device of the invention includes a light-emitting element in each pixel, and a current applied to the light-emitting element in the first display mode is larger than a current applied to the light-emitting element in the second display mode.

Note that there may be a structure in which one frame period is constituted by three periods, respectively, a period for writing to a pixel, a display period, and an erasing period in the first display mode of the invention.

Note that there may be a structure in which one frame period is constituted by three periods, respectively, a period for writing to a pixel, a display period, and an erasing period, in the second display mode of the invention.

Note that there may be a structure in which when using the second display mode, a power supply controlling circuit for a driver circuit in the display controller of the invention outputs a voltage which is lower than that in the first display mode.

Note that there may be a structure in which a gray scale is expressed by the sum total of a lighting period in the subframe period in the first display mode and a gray scale is expressed by the sum total of a lighting period in the subframe period in the second display mode.

Note that various forms of switch can be used as a switch in the invention, for example, an electrical switch, a mechanical switch, and the like. That is, it is not limited to a specific form of switch and anything can be used as long as it can control a flow of current. For example, it may be a transistor, a diode (a PN diode, a PIN diode, a Schottky diode, a diode-connected transistor or the like), or a logic circuit configured by them. Therefore, in the case where a transistor is used as a switch, a polarity (conductivity type) thereof is not particularly limited because it operates just as a switch. However, when it is preferable that OFF current is small, preferably a transistor with a polarity with small OFF current is used. As a transistor with small OFF current, there is a transistor provided with an LDD region or a transistor with a multi-gate structure, or the like. Further, it is desirable that an n-channel transistor is employed when operating in a state where a potential of a source terminal of the transistor as a switch is close to the low potential side power source (Vss, GND, 0V or the like), whereas it is desirable that a p-channel transistor is employed when operating in a state where the potential of the source terminal is close to the high potential side power source (Vdd or the like). This is because the transistor can be easily operated as a switch since the absolute value of a gate-source voltage thereof can be increased. Note that a CMOS switch can also be applied by using both n-channel and p-channel transistors. In the case where a CMOS switch is applied, the switch can be operated property even when the condition changes, such as when a voltage outputted through the switch (namely, an input voltage to the switch) is higher or lower than an output voltage.

Note that in the invention, "being connected" includes the case of being electrically connected and the case of being directly connected. Therefore, in the structure disclosed in the invention, in addition to the predetermined connection between elements, another element capable of electrical connection (for example, a switch, a transistor, a capacitor, an inductor, a resistor, or a diode) may be disposed therebetween. Alternatively, another element is not interposed therebetween. Note that only the case where connection is directly performed without interposing another element capable of electrical connection therebetween, and which does not include the case of being electrically connected, is referred to as "being directly connected". Note also that when "being electrically connected" is mentioned, it includes the case of being electrically connected and the case of being directly connected.

Note that in the invention, a semiconductor device means a device having a circuit including a semiconductor element (a transistor, a diode, or the like). Further, it may include any kind of device capable of functioning by utilizing a semiconductor property. A display device means a device having a display element (a liquid crystal element, a light-emitting element, or the like). Note also that a display device may be a display panel in which a plurality of pixels each including a display element such as a liquid crystal element or an EL element or a peripheral driver circuit for driving the pixels are formed over a substrate. Further, the display device may also be the display panel to which a flexible printed circuit (FPC) or a printed wiring board (PWB) is attached.

Note that in this specification, a gate means a whole including a gate electrode and a gate wiring (also called a gate line or a gate signal line) or a part thereof. The gate electrode means a conductive film in a portion which is overlapped with a semiconductor forming a channel region, an LDD (Lightly Doped Drain) region, or the like through a gate insulating film. The gate wiring means a wire for connecting respective gate electrodes of the pixels or for connecting the gate electrode to another wire.

However, there also exists a region which functions both as a gate electrode and as a gate wiring. Such a region may be called either a gate electrode or a gate wiring. That is, there also exists a region which cannot be clearly distinguished as either a gate electrode or a gate wiring. For example, in the case where a channel region is provided so as to overlap with a gate wiring provided while extending, the region functions as a gate wiring, and at the same time, it also functions as a gate electrode. Therefore, such a region may be called either a gate electrode or a gate wiring.

Furthermore, a region which is formed of the same material as a gate electrode and is connected to the gate electrode may also be called a gate electrode. Similarly, a region which is formed of the same material as a gate wiring and is connected to the gate wiring may also be called a gate wiring. In the strict sense, such a region is not necessarily overlapped with the channel region or does not necessarily have a function of connecting to another gate electrode. However, in terms of the manufacturing margin or the like, there exists a region which is formed of the same material as the gate electrode or the gate wiring and is connected to the gate electrode or the gate wiring. Therefore, such a region can also be called a gate electrode or a gate wiring.

Further, in a case of a multi-gate transistor, for example, a gate electrode of one transistor and a gate electrode of another transistor may be connected to each other through a conductive film formed of the same material as the gate electrodes in many cases. Such a conductive film which is used for connecting the gate electrodes to each other can be called a gate wiring. On the other hand, since the multi-gate transistor can be considered as one transistor, such a conductive film can also be called a gate electrode. That is, what is formed of the same material as the gate electrode and the gate wiring and is disposed so as to be connected to them may be called either a gate electrode or a gate wiring. In addition, a conductive film in a portion which connects the gate electrode and the gate wiring to each other may also be called either a gate electrode or a gate wiring.

Note that a gate terminal means a part of a region of a gate electrode or a part of a region which is electrically connected to a gate electrode.

Note that a source means a whole including a source region, a source electrode and a source wiring (also called a source line or a source signal line) or a part thereof. The source region means a semiconductor region in which a large amount of p-type impurities (boron, gallium, or the like) or n-type impurities (phosphorus, arsenic, or the like) is contained. Therefore, it does not include a region in which a small amount of p-type impurities or n-type impurities, namely an LDD (Lightly Doped Drain) region. The source electrode means a conductive layer in a region which is formed of a different material from the source region and is disposed so as to be electrically connected to the source region. However, the source electrode which includes the source region may be called the source electrode. The source wiring means a wire for connecting respective source electrode of pixels to each other, for connecting the source electrode to another wire, or the like.

However, there also exists a region which functions both as a source electrode and as a source wiring. Such a region may be called either a source electrode or a source wiring. That is, there also exists a region which cannot be clearly distinguished as either a source electrode or a source wiring. For example, in the case where a source region is provided so as to overlap with a source wiring provided while extending, the region functions as a source wiring, and at the same time, it also functions as a source electrode. Therefore, such a region may be called either a source electrode or a source wiring.

Further, a region which is formed of the same material as a source electrode and is connected to the source electrode or a portion for connecting a source electrode to another source electrode may also be called a source electrode. Further, a portion which is overlapped with a source region may also be called a source electrode. Similarly, a region which is formed of the same material as a source wiring and is connected to a source wiring may be called a source wiring. In the strict sense, such a region does not necessarily have a function such as a function of connecting to another source electrode. However, in terms of the manufacturing margin or the like, there exists a region which is formed of the same material as a source electrode or a source wiring and is connected to a source electrode or a source wiring. Therefore, such a region can also be called a source electrode or a source wiring.

In addition, for example, a conductive film at a portion which connects a source electrode and a source wiring to each other may also be called either a source electrode or a source wiring.

Note that a source terminal means a part of a region of a source region, a part of a source electrode, or a part of a region which is electrically connected to the source electrode.

Note that as for a drain, the description of a source can be referred to.

Note that it is difficult to distinguish between a source and a drain of a transistor structurally. Further, High and Low of a potential may be switched depending on the operation of the circuit. Therefore, in this specification, a source and a drain are not particularly specified and are referred to as a first electrode and a second electrode. For example, in the case where the first electrode is a source, the second electrode is a drain, whereas in the case where the first electrode is a drain, the second electrode is a source.

Note that in this invention, the word "on" or "over", such as in the phrase "formed on something" or in the phrase "formed over something" is not limited to the case of being directly in contact with something, and includes the case of not being in direct contact with something but having another thing interposed therebetween. Accordingly, for example, the phrase "a layer B is formed on a layer A (or over a layer A)" includes the case where the layer B is formed directly on the layer A and the case where another layer (such as a layer C or a layer D) is formed directly on the layer A and the layer B is formed directly on the another layer. The same can be applied to the word "above", and the word is not limited to the case of being directly in contact with something, and includes the case where another thing is interposed therebetween. Accordingly, for example, the phrase "a layer B is formed above a layer A" includes the case where the layer B is formed directly on the layer A and the case where another layer (such as a layer C or a layer D) is formed directly on the layer A and the layer B is formed directly on the another layer. Note that the same can be applied to the word "under" or the word "below", and these words include the case of being directly in contact with something, and the case of being not in contact with something.

Note that in the invention, one pixel means one element for controlling brightness. As an example, therefore, one pixel means one color element, and that one color element expresses brightness. Accordingly, in the case of a color display device including R (red), G (green), and B (blue) color elements, the smallest unit of an image is constituted by three pixels: R pixel, G pixel, and B pixel. Note that the number of color elements is not limited to three, and more color elements may be used, for example, RGBW (W: white), RGB with yellow, cyan, or magenta added, and the like may be used. As another example, in the case where the brightness of one color element is controlled using a plurality of regions, one of those regions is referred to as one pixel. Consequently, as an example, in the case of an area gray scale method where there are a plurality of regions for controlling brightness in each color element and a gray scale is expressed by all the regions, one pixel means one of the regions for controlling brightness. Therefore, in that case, one color element is constituted by a plurality of pixels. Further, in that case, the size of the area that contributes to display may vary from pixel to pixel. In addition, slightly-different signals may be supplied to a plurality of regions for controlling the brightness of one color element, namely, to a plurality of pixels constituting one color element, thereby increasing the viewing angle.

Note that in the invention, pixels may be arranged (arrayed) in matrix. Here, pixels arranged (arrayed) in matrix include pixels arranged in a striped grid pattern. In addition, the case where dots of three color elements (e.g., RGB) are arranged in a delta pattern when the three color elements are used for full color display is included. Further included is the case of a Bayer arrangement.

Note that in this specification, a light-emitting element is described using an organic EL element as an example; however, the content of the invention can also be applied to a display device other than a display device using an organic EL element. For example, it is possible to apply it to a display device using a display medium of which the contrast is changed by an electrical or magnetic effect, such as an EL element (an organic EL element, an inorganic EL element, or an EL element containing an organic compound and an inorganic compound), an electron emitting element, a liquid crystal element, electronic ink, a grating light valve (GLV), a plasma display (PDP), a Digital Micromirror Device (DMD), a piezoelectric ceramic display, or a carbon nanotube. Note that as a display device using an EL element, there is an EL display. As a display device using an electron emitting element, there is a field emission display (FED), a Surface-conduction Electron-emitter Display (SED), or the like. As a display device using a liquid crystal element, there are a liquid crystal display, a transmissive liquid crystal display, a semi-transmissive liquid crystal display, and a reflective liquid crystal display. As a display device using electronic ink, there is an electronic paper.

The invention can suppress power consumption of a display device according to the above-described structure. In addition, in the second display mode, even in the case where the number of subframes used for expressing a gray scale is reduced, a display period per frame period can be lengthened; thus, a display device capable of displaying a clear image and a driving method thereof can be provided.

Further, since a display period of a light-emitting element per frame period can be increased, a voltage applied between an anode and a cathode of a light-emitting element can be set to be lower when expressing the same brightness per frame. Thus, a display device with high reliability can be provided.

The invention can be applied not only to a display device using an OLED element, but also to another self-light emitting type display device such as an FED or a PDP.

BRIEF DESCRIPTION OF THE DRAWINGS

FIG. 5 is a table showing a driving method of a display device of the invention.

FIGS. 6A and 6B are diagrams each showing a driving method of a display device of the invention.

FIG. 7 is a diagram showing a driving method of a display device of the invention.

FIGS. 8A and 8B are diagrams each showing a driving method of a display device of the invention.

FIGS. 10A, 10B, and 10C are diagrams of timing charts showing a driving method of a display device of the invention.

DETAILED DESCRIPTION OF THE INVENTION

Although the invention will be fully described by way of embodiment modes and embodiments with reference to the accompanying drawings, it is to be understood that various changes and modifications will be apparent to those skilled in the art. Therefore, unless such changes and modifications depart from the scope of the invention, they should be construed as being included therein.

Embodiment Mode 1

Embodiment Mode 1 of the invention is described. Here, similar to the conventional example, an example in which 4 bits are used in the first display mode is described.

Figure 1A:
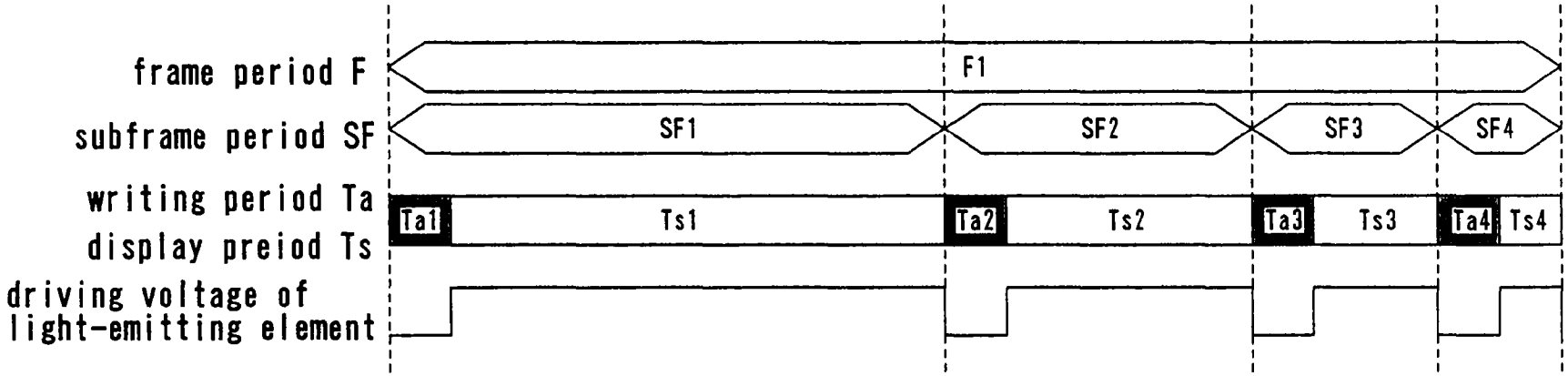
FIGS. 1A and 1B are diagrams of timing charts showing a driving method of a display device of the invention.
Figure 1B:
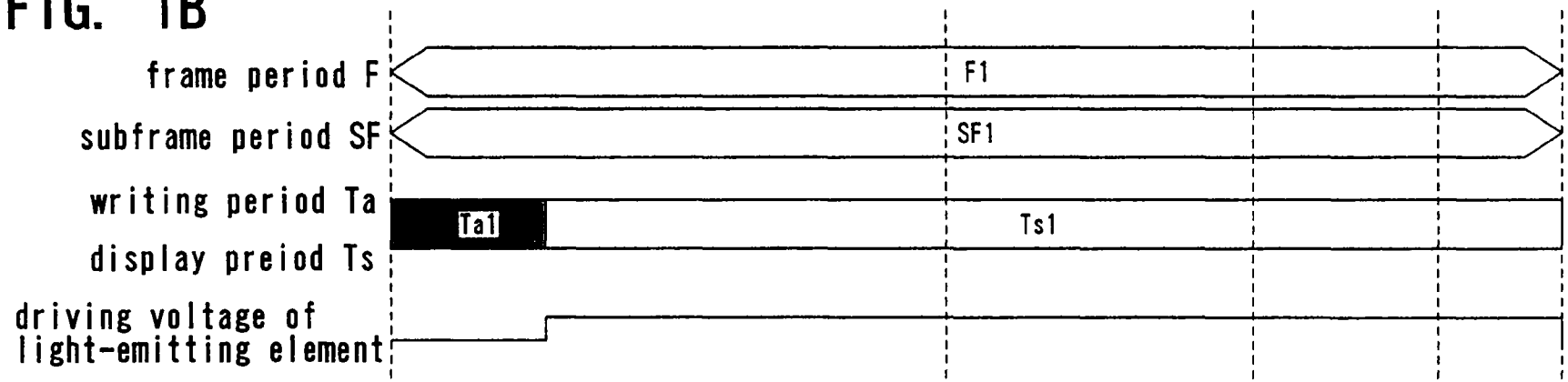

Timing charts for a driving method of a display device of the invention are shown in FIGS. 1A and 1B. In general, in a display device into which an n-bit digital video signal (where n is a natural number) is inputted, it is possible to express $2^n$ gray scales by using n subframe periods SF1 to SFn and an n-bit digital image signal in the first display mode, and it is possible to express 2 gray scales by using a 1-bit digital image signal in the second display mode by a switching operation. The display device of the invention can be applied to such a case.

Further in general, in a display device into which an n-bit digital video signal is inputted (where n is a natural number), it is possible to express n gray scales by inputting an n-bit digital image signal and using at least n subframe periods in the first display mode, and it is possible to express 2 gray scales by using a 1-bit digital image signal in the second display mode by a switching operation. The display device of the invention can be applied to such a case. Here, the reason why the number of gray scales is not set to be a power of 2 of the number of subframes is to take a measure for a pseudo contour on display. Details thereof have been described in Japanese Patent Laid-Open No. 2002-149113.

FIG. 1A shows a timing chart in a case of the first display mode in which a 4-bit signal is inputted and $2^4$ gray scales are expressed.

A light emitting state or a non-light emitting state of each pixel is selected in respective display periods of subframe periods SF1 to SF4 structuring one frame period. An opposing potential is set to be nearly the same as a power supply potential during writing periods, and is changed in the display periods so as to have a potential difference from the power supply potential to an extent that a light-emitting element emits light. This operation is similar to the conventional example, thus a detailed description is omitted.

In FIG 1B, shown is a timing chart in a case of the second display mode which expresses a gray scale using only the upper one-bit signal. Compared to the subframe period corresponding to the first bit in the first display mode shown in FIG. 1A, a writing period and a display period are set to be longer.

Therefore, in the second display mode, the luminance of the light-emitting element of which a light emitting state is selected can be made lower compared to the luminance of the light-emitting element of which a light emitting state is selected in the display period of the subframe period corresponding to the first bit in the first display mode. Consequently, the voltage applied between the anode and the cathode of the light-emitting element can be set lower in the display period in the second display mode.

Figure 2A:
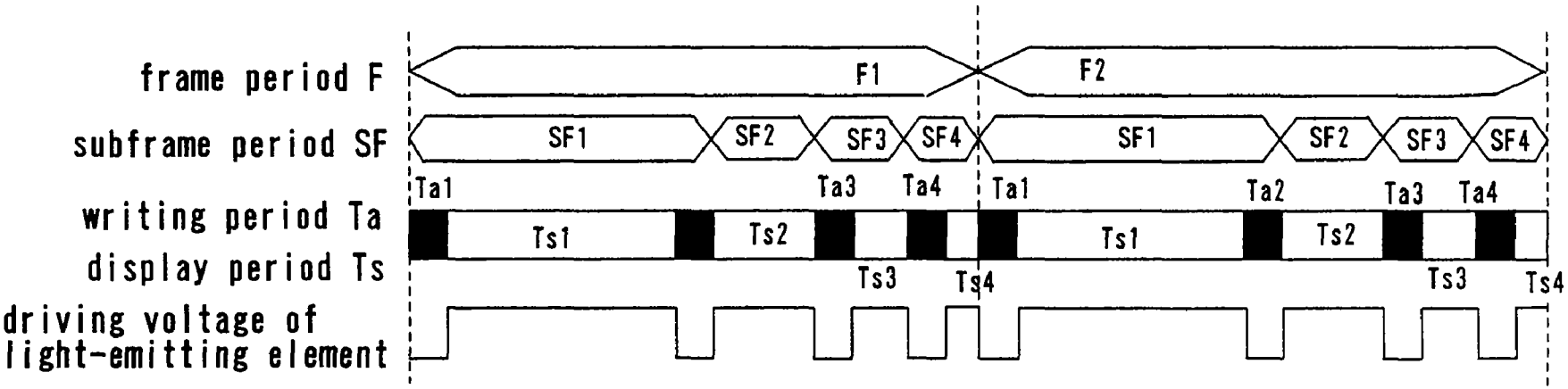
FIGS. 2A and 2B are diagrams of timing charts showing a driving method of a display device of the invention.
Figure 2B:
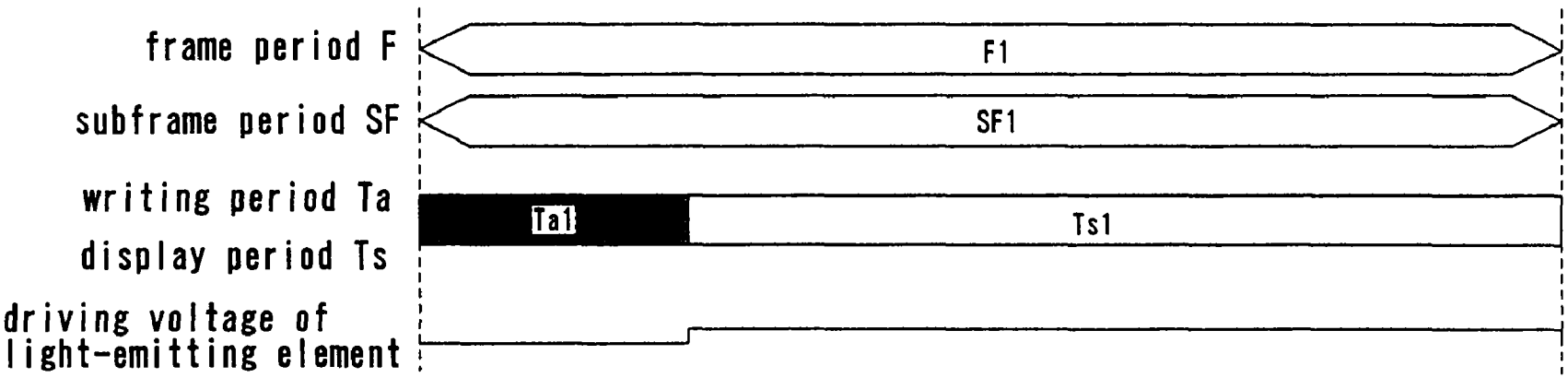

Further, an example in which the frame period in the second display mode is set to be longer than that in the first display mode is shown in FIGS. 2A and 2B. When a time gray scale method is used, a frame period cannot be set so long. This is because as the frame period is lengthened, the subframe period is also lengthened in proportion thereto, so that flickers will be perceived. Accordingly, the frame period cannot be set longer in the first display mode. However, since the second display mode is of expressing 2 gray scales, the problem of flickers caused by the gray scale does not occur. Accordingly, the length of the frame period is determined depending on a lighting period. Therefore, the frame period can be lengthened by increasing capacitance of a pixel, reducing leaks, or the like. When the frame period becomes longer, since the number of writings of the screen can be reduced in the case of a still image or the like, thus low power consumption can be achieved.

Figure 3:
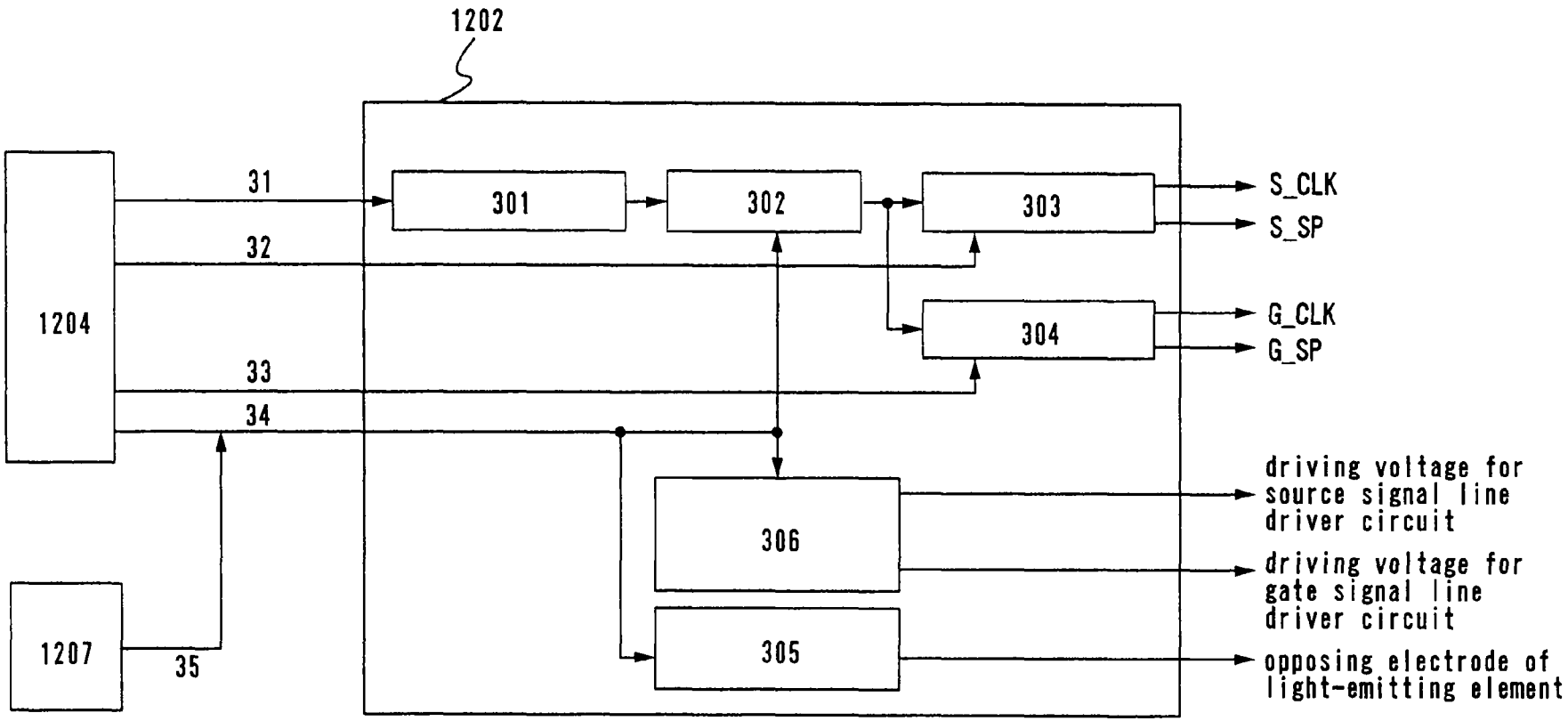
FIG. 3 is a diagram showing constitution of a display controller of a display device of the invention.

Constitution of a display controller is shown in FIG. 3. In FIG. 3, a power source controlling circuit for a light-emitting element 305 controls the potential of the opposing electrode (opposing potential) of the light-emitting element such that it is maintained at a potential which is nearly the same as the power source potential during the writing period whereas it has a potential difference from the power source potential to an extent that the light-emitting element emits light in the display period. Here, when the second display mode is selected, a gray scale controlling signal 34 is inputted to the power source controlling circuit for a light-emitting element 305 from a CPU 1204. By this, in a pixel of which a light emitting state is selected, the potential of the opposing electrode of the light-emitting element is changed so as to reduce the voltage applied between both the electrodes of the light-emitting element, by an amount of the increase in the light emitting period of the light-emitting element.

Consequently, the voltage applied between both the electrodes of the light-emitting element can be lower in the second display mode, therefore, stress on the light-emitting element due to the applied voltage can be reduced.

A power source controlling circuit for a driver circuit 306 controls a power source voltage to be applied to each driver circuit. Here, when the second display mode is selected, the gray scale controlling signal 34 is inputted to the power source controlling circuit for a driver circuit 306, thereby changing a power source voltage for a source signal line driver circuit and a driving voltage for a gate signal line driver circuit to be outputted. In the second display mode, since the frequency of a clock pulse of each driver circuit is smaller as compared to the first display mode, each driver circuit can be operated by a lower driving voltage.

Here, switching between the first and the second display modes is described. A display device of the invention is provided with a light sensor 1207 for detecting the intensity of outside light. The light sensor 1207 detects outside light, and outputs an electrical signal in accordance with the intensity (an output signal 35). In the display device of the invention, switching between the first and the second display modes is performed using the output signal 35 of the light sensor 1207.

The output signal 35 of the light sensor 1207 is amplified through an amplifier (not shown) and inputted to the display controller. The display controller operates such that the number of gray scales of an image to be displayed is changed depending on the size of the output signal 35 of the light sensor. In the case where the output signal 35 of the light sensor is equal to or larger than a certain value, that is, when the intensity of outside light is high, it operates such that the number of gray scales of an image to be displayed is small. That is, it operates to switch to the second display mode in which the number of gray scales is small. On the other hand, in the case where the output signal 35 of the light sensor is smaller than the certain value, that is, when the intensity of outside light is low, it operates such that the number of gray scales of an image to be displayed is large. That is, it operates to switch to the first display mode in which the number of gray scales is large.

In specific, the output signal 35 of the light sensor is inputted to the CPU 1204 and controls the gray scale controlling signal 34 produced in the CPU 1204. If the output signal 35 of the light sensor is equal to or larger than the certain value, a gray scale control signal corresponding to the second display mode is outputted to reduce the number of gray scales. On the other hand, if the output signal 35 of the light sensor is smaller than the certain value, a gray scale control signal corresponding to the first display mode is outputted to increase the number of gray scales.

By decreasing the number of gray scales of an image under strong outside light such as sunlight in this manner, an image can be perceived clearly and the visibility can be ensured in a wide range of situations, from under a fluorescent lamp in a dark place or inside, to under sunlight outside.

Note that when the second display mode is selected by the output of the light sensor 1207, a black display image is displayed on a white background image normally, however, by inverting them, a white display image may be displayed on a black background image. As a result of this, the visibility of a display screen can be further improved and since the background image is black, an area of a light emitting portion can be reduced and the power consumption can be reduced. In addition, by increasing the luminance of the white display image, the visibility of the display screen can be further improved.

Note that although the description is made on the display device in which two display modes of the first display mode and the second display mode are switched, the invention can also be applied to a case where, in addition to the first display mode and the second display mode, a mode in which the number of gray scales to be expressed is more minutely changed is set, and display is performed by switching among the plurality of modes.

For example, a third display mode in which the number of gray scales to be expressed is smaller than that of the first display mode and larger than that of the second display mode, may be provided. Note that in general, in a display device into which an n-bit digital video signal (where n is a natural number) is inputted, it is possible to express $2^q$ gray scales (where q is a natural number satisfying $1<q<n$) by using q subframe periods SF1 to SFq and a q-bit digital image signal in the third display mode. Further, it is also possible to express q gray scales by inputting a q-bit digital image signal and using at least q subframe periods. Note that a display mode to be additionally provided is not limited only to the third display mode. A display mode in which the number of gray scales to be expressed is further more minutely changed may be set as well.

Figure 4A:
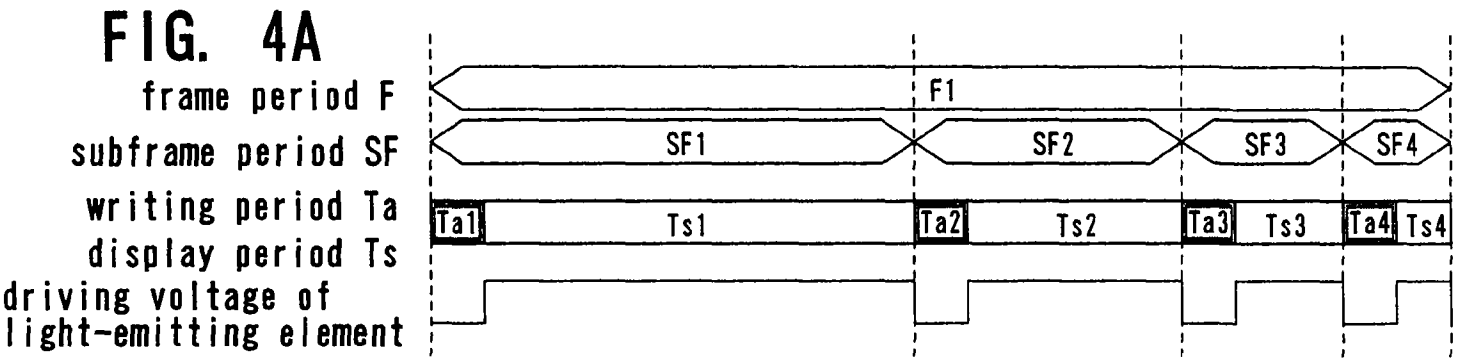
FIGS. 4A, 4B, and 4C are diagrams of timing charts showing a driving method of a display device of the invention.
Figure 4B:
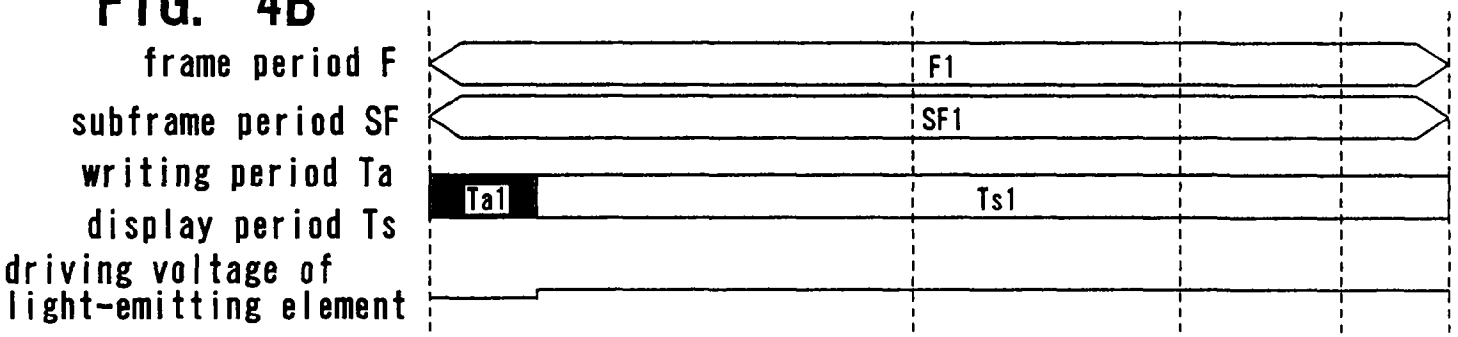
Figure 4C:
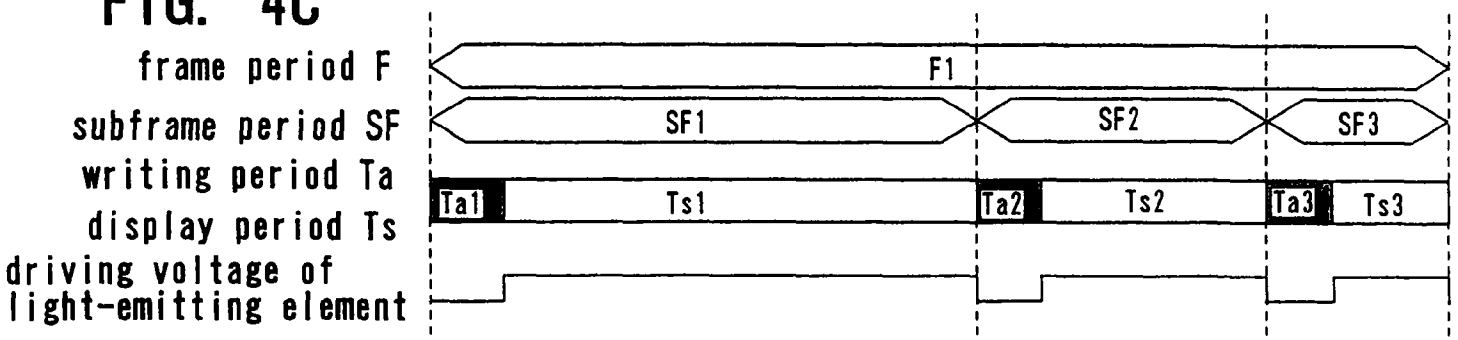

For example, in addition to the first display mode which expresses $2^4$ gray scales and the second display mode which expresses 2 gray scales, a third display mode which expresses $2^3$ gray scales may be provided. Timing charts in this case are shown in FIGS. 4A to 4C. FIG. 4A shows a timing chart in the case of the first display mode which expresses $2^4$ gray scales, FIG. 4B shows a timing chart in the case of the second display mode which expresses 2 gray scales, and FIG. 4C shows a timing chart in the case of the third display mode which expresses $2^3$ gray scales by inputting a 3-bit signal.

In the third display mode, a light emitting state or a non-light emitting state of each pixel is selected in respective display periods of subframe periods SF1 to SF3 structuring one frame period. Here, an opposing potential is set to be nearly the same as a power supply potential during writing periods, and is changed in the display periods so as to have a potential difference from the power supply potential to an extent that a light-emitting element emits light. This operation is similar to the conventional example, thus a detailed description is omitted.

Here, switching among the first, the second, and the third display modes is, similar to the conventional one, performed based on the intensity of outside light detected by the light sensor which is provided for the display device of the invention. If the output signal of the light sensor is large, that is, if the intensity of outside light is high, the display mode is switched to the second display mode in which the number of gray scales is small. On the other hand, if the output signal of the light sensor is small, that is, if the intensity of outside light is low, the display mode is switched to the first display mode in which the number of gray scales is large. In addition, if the output signal of the light sensor is medium, that is, if the intensity of outside light is medium, the display mode is switched to the third display mode in which the number of gray scales is medium.

Brightness of inside and outside is variously changed depending on the lighting, weather condition such as weather, time, or the like. For example, the illuminance in a room where there is a lighting at approximately 800 to 1,000 lux, the illuminance in cloudy weather during the day is approximately 32,000 lux, and the illuminance in clear weather during the day reaches 100,000 lux. Therefore, for example, for recognizing a display image clearly, display is performed in a room by switching to the first display mode in which the number of gray scales is large, the display is performed in clear weather during the day by switching to the second display mode in which the number of gray scales is small, and the display is performed in cloudy weather during the day by switching to the third display mode in which the number of gray scales is medium.

By changing the number of gray scales of an image in accordance with the intensity of outside light as above, an image can be perceived clearly and the visibility can be ensured in a wide range of situations, from under a fluorescent lamp in a dark place or inside, to under sunlight outside.

As described above, by setting a display mode in which the number of gray scales to be expressed is changed more minutely in addition to the first display mode and the second display mode, the display modes can be used optimally as the situation demands. For example, in the case of displaying a moving image or the like, the first display mode in which the number of gray scales to be expressed is large is suitable. In the case of displaying an image including many characters such as e-mail, the second display mode in which the number of gray scales to be expressed is small is suitable. Further, in the case of displaying a still image or the like such as a cartoon, the third display mode in which the number of gray scales to be expressed is medium is suitable. Note that the number of gray scales to be expressed in the first display mode is desirably $2^4$ gray scales or more. The number of gray scales to be expressed in the third display mode is desirably about $2^3$ gray scales.

Note that although the description is made on an example in which the display mode is switched based on the intensity of outside light in this embodiment mode, a selection switch by which a user selects a display mode in accordance with the application may be provided for the display device as well. In addition, even when a display mode is selected by the selection switch, the number of gray scales of the selected display mode can be automatically increased or decreased in accordance with the intensity of outside light.

Note that when a gray scale is expressed in the first or the third display mode, the number of subframes is not particularly limited. Further, the length of a display period of each subframe period, or the subframe for lighting, that is, a selecting method of subframes are not also be particularly limited.

For example, in the case where $2^4$ gray scales are expressed in the first display mode, it may be possible that one frame period is divided into four subframes (SF1 to SF4), the ratio of display periods of the subframes SF1 to SF4, Ts1:Ts2:Ts3:Ts4 is $2^0:2^1:2^2:2^3$, and the subframes are used for lighting based on a conventional time gray scale method. An example thereof is shown in FIG. 5.

In addition, as an expressing method of a gray scale, the gray scale may be expressed by sequentially adding a display period included in each of a part or all of subframes formed by dividing one frame. That is, the number of subframes for lighting may be increased as the gray scale level is increased. In this case, a subframe for lighting at a small gray scale level is also used for lighting at a large gray scale level. Such a gray scale method is called an "overlapped time gray scale method" in this specification. For example, examples in which an overlapped time gray scale method is applied to the case where $2^4$ gray scales are expressed in the first display mode, are shown in FIGS. 6A and 6B. In FIG. 6A, one frame period is divided into five subframes (SF1 to SF5), the ratio of display periods of the subframes SF1 to SF5, Ts1:Ts2:Ts3:Ts4:Ts5 is $2^0:2^1:2^2:2^2:2^2$, and an overlapped time gray scale method is applied to the subframes SF3 to SF5 of which the length of the display periods are equal. In FIG. 6B, one frame period is divided into five subframes (SF1 to SF5), the ratio of display periods of the subframes SF1 to SF5, Ts1:Ts2:Ts3:Ts4:Ts5 is $2^2:2^1:2^0:2^2:2^2$, and an overlapped time gray scale method is applied to the subframes SF1, SF4, and SF5 of which the length of the display periods are equal. Note that by applying an overlapped time gray scale method, a pseudo contour can be reduced.

Note that subframes to which an overlapped time gray scale method is applied are not limited to subframes of which the lengths of the display periods are equal. Further, an appearance order of subframes is not limited to the above.

Similar to the first display mode, in the case where a gray scale is expressed in the third display mode also, a conventional time gray scale method or an overlapped time gray scale method may be employed. For example, examples in which a conventional time gray scale method are an overlapped time gray scale method are respectively applied in the case where $2^3$ gray scales are expressed in the third display mode, are shown in FIGS. 7 to 8B. FIG. 7 shows an example in which one frame period is divided into three subframes (SF1 to SF3), the ratio of display periods of the subframes SF1 to SF3, Ts1:Ts2:Ts3 is $2^0:2^1:2^2$, and a conventional time gray scale method is applied thereto. FIG. 8A shows an example in which one frame period is divided into four subframes (SF1 to SF4), the ratio of display periods of the subframes SF1 to SF4, Ts1:Ts2:Ts3:Ts4 is $2^0:2^1:2^1:2^1$, and an overlapped time gray scale method is applied to the subframes SF2 to SF4 of which the length of the display periods are equal. Further, FIG. 8B shows an example in which one frame period is divided into four subframes (SF1 to SF4), the ratio of display periods of the subframes SF1 to SF4, Ts1:Ts2:Ts3:Ts4:Ts5 is $2^1:2^1:2^0:2^1$, and an overlapped time gray scale method is applied to the subframes SF1, SF2, and SF4 of which the length of the display periods are equal. Note that by applying an overlapped time gray scale method, a pseudo contour can be reduced.

Note that in the case of applying an overlapped time gray scale method, subframes to which the overlapped time gray scale method is applied are not limited to subframes of which the length of the display periods are equal. Further, an appearance order of subframes is not limited to the above.

Figure 37:
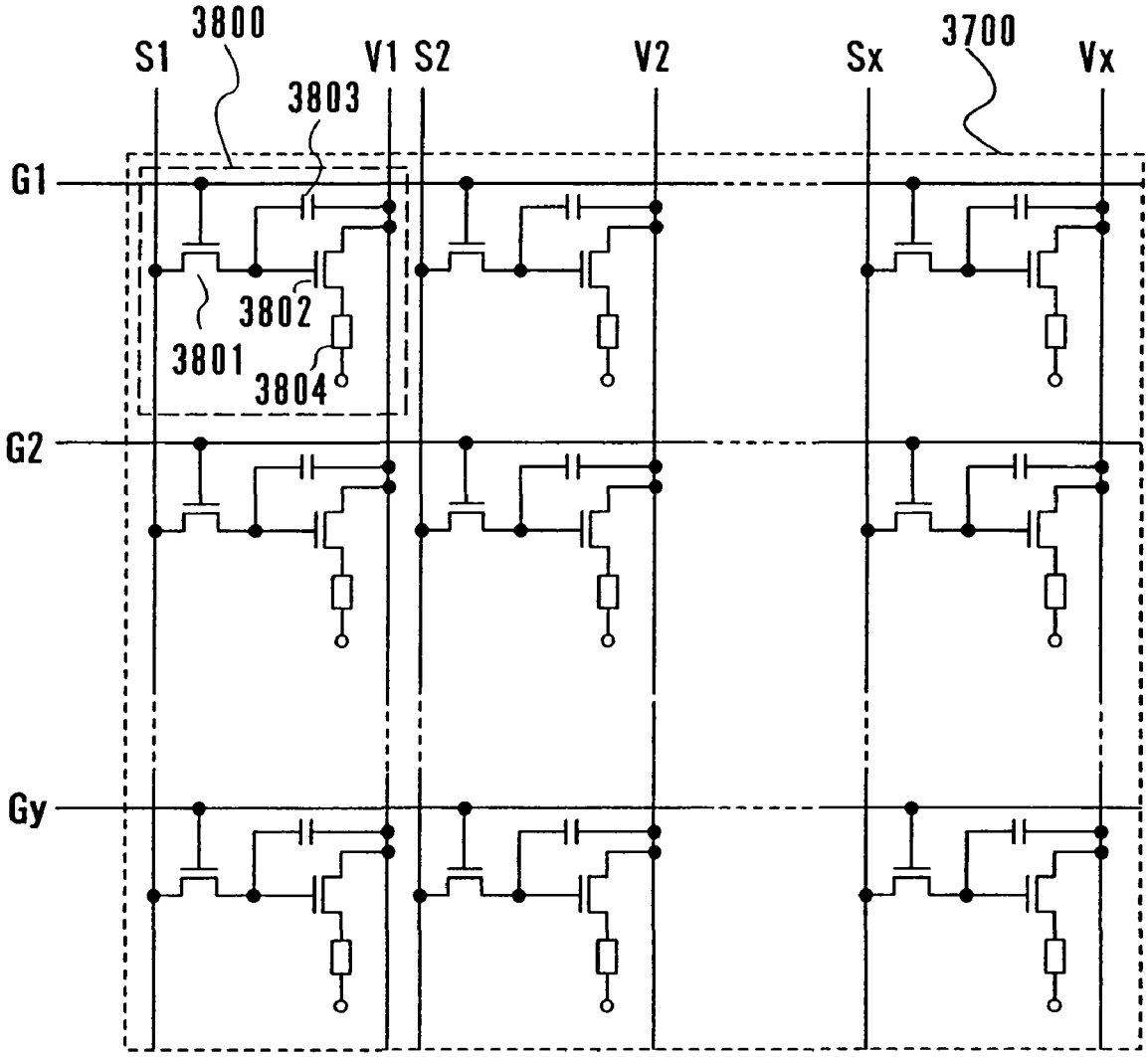
FIG. 37 is a diagram showing a configuration of a pixel portion of a conventional display device.

Note that as a configuration of the pixel portion included in the display of the display device of the invention, pixels with the configuration shown in FIG. 37 in the conventional example can be used. Further, pixels with another known configuration can also be freely used.

Note also that as the source signal line driver circuit and the gate signal line driver circuit included in the display of the display device of the invention, a circuit with known constitution can be freely used.

Further, in driving the display device in the second display mode, the voltage for driving the display controller to be low so that power consumption of the display controller can be small.

Note also that the invention can be applied not only to a display device using an OLED element as a light-emitting element, but also to another self-light-emitting type display device such as an FED or a PDP.

Embodiment Mode 2

Embodiment Mode 2 of the invention is described. Here, similar to the conventional example, an example in which 4 bits are used in the first display mode is described.

Figure 9A:
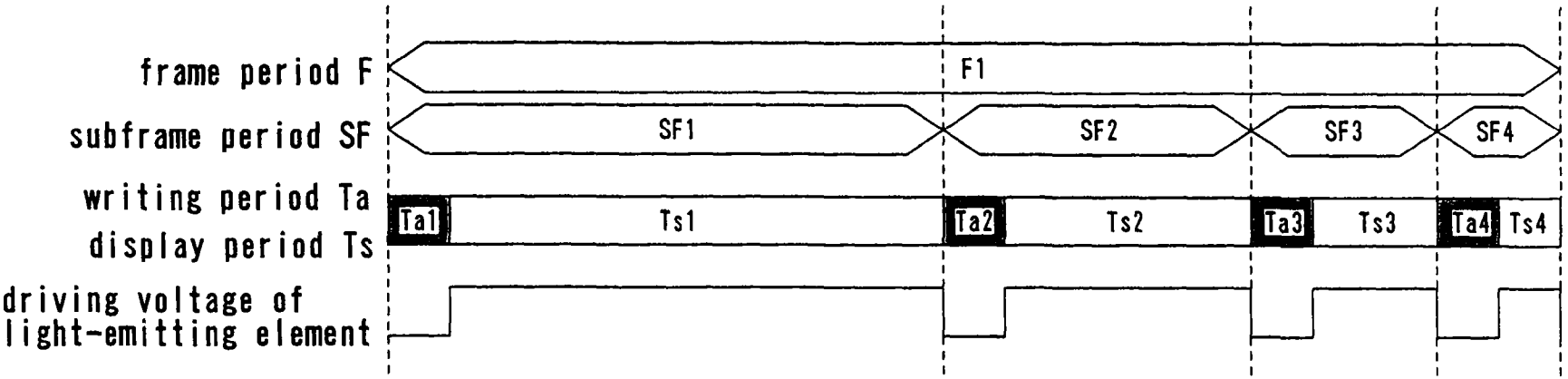
FIGS. 9A and 9B are diagrams of timing charts showing a driving method of a display device of the invention.
Figure 9B:
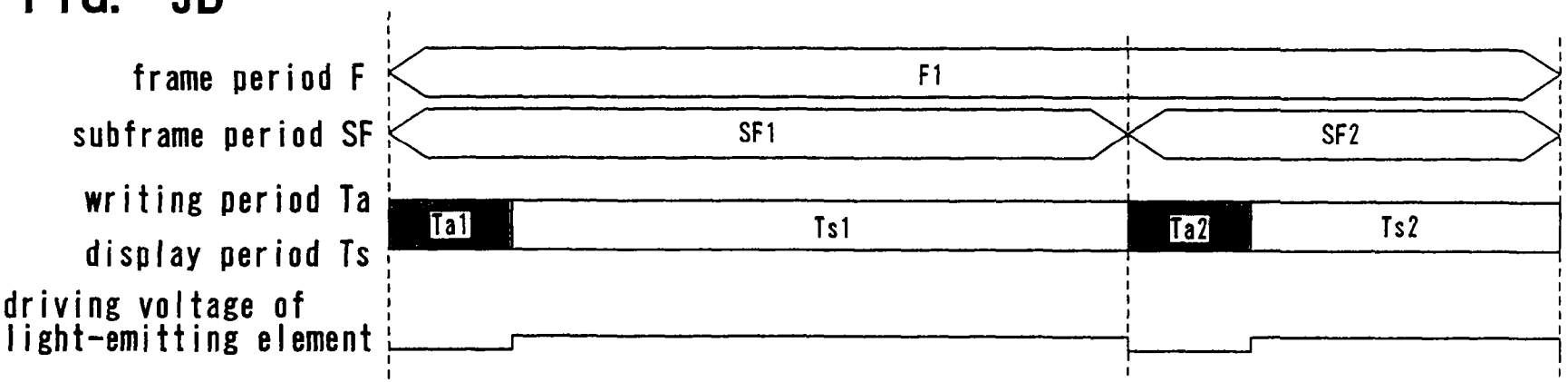

Timing charts for a driving method of a display device of the invention are shown in FIGS. 9A and 9B. In general, considered is a display device into which an n-bit digital video signal (where n is a natural number) is inputted. It is possible to express $2^n$ gray scales by using n subframe periods SF1 to SFn and an n-bit digital image signal in the first display mode. On the other hand, in the second display mode, $2^m$ gray scales are expressed by using an m-bit digital image signal (where m is a natural number smaller than n) by a switching operation.

Further in general, in a display device into which an n-bit digital video signal is inputted (where n is a natural number), it is possible to express n gray scales by inputting an n-bit digital image signal and using at least n subframe periods in the first display mode. On the other hand, in the second display mode, m gray scales (where m is a natural number smaller than n) by using an m-bit digital image signal and at least m subframe periods by a switching operation. Here, the reason why the number of gray scales is not set to be a power of 2 of the number of subframes is to take a measure for a pseudo contour on display. Details thereof have been described in Japanese Patent Laid-Open No. 2002-149113.

FIG. 9A shows a timing chart in a case of the first display mode in which a 4-bit signal is inputted and $2^4$ gray scales are expressed.

A light emitting state or a non-light emitting state of each pixel is selected in respective display periods of subframe periods SF1 to SF4 structuring one frame period. Here, an opposing potential is set to be nearly the same as a power supply potential during writing periods, and is changed in the display periods so as to have a potential difference from the power supply potential to an extent that a light-emitting element emits light. This operation is similar to the conventional example, thus a detailed description is omitted.

In FIG. 9B, shown is a timing chart in a case of the second display mode which expresses a gray scale using only the upper two-bit signal. Compared to the sum total of the subframe periods corresponding to the upper two bits in the first display mode shown in FIG. 9A, a writing period and a display period are set to be longer. Therefore, in the second display mode, the luminance of the light-emitting element of which a light emitting state is selected can be made lower compared to the luminance of the light-emitting element of which a light emitting state is selected in the display periods of the subframe periods corresponding to the upper two bits in the first display mode. Consequently, the voltage applied between the anode and the cathode of the light-emitting element can be set lower in the display period in the second display mode.

As constitution of a display controller, the constitution described in Embodiment Mode 1 can be used.

Here, switching between the first and the second display modes is, similar to that in Embodiment Mode 1, performed based on the intensity of outside light detected by a light sensor provided for the display device of the invention. In the case where an output signal of the light sensor is equal to or larger than a certain value, that is, when the intensity of outside light is high, the display mode is switched to the second display mode in which the number of gray scales is small. That is, it operates to switch to the second display mode in which the number of gray scales is small. On the other hand, in the case where the output signal of the light sensor is smaller than the certain value, that is, when the intensity of outside light is low, the display mode is switched to the first display mode in which the number of gray scales is large.

By changing the number of gray scales of an image in accordance with the intensity of outside light in this manner, an image can be perceived clearly and the visibility can be ensured in a wide range of situations, from under a fluorescent lamp in a dark place or inside, to under sunlight outside.

Note that although the description is made on the display device in which two display modes of the first display mode and the second display mode are switched, the invention can also be applied to a case where, in addition to the first display mode and the second display mode, a mode in which the number of gray scales to be expressed is more minutely changed is set, and display is performed by switching among the plurality of modes.

For example, a third display mode in which the number of gray scales to be expressed is smaller than that of the first display mode while is larger than that of the second display mode, may be provided. Note that in general, in a display device into which an n-bit digital video signal (where n is a natural number) is inputted, it is possible to express $2^q$ gray scales (where q is a natural number satisfying $m<q<n$) by using q subframe periods SF1 to SFq and a q-bit digital image signal in the third display mode. Further, it is also possible to express q gray scales by inputting a q-bit digital image signal and using at least q subframe periods. Note that a display mode to be additionally provided is not limited only to the third display mode. A display mode in which the number of gray scales to be expressed is further more minutely changed may be set as well.

For example, in addition to the first display mode which expresses $2^4$ gray scales and the second display mode which expresses $2^2$ gray scales, a third display mode which expresses $2^3$ gray scales may be provided. Timing charts in this case are shown in FIGS. 10A to 10C. FIG. 10A shows a timing chart in the case of the first display mode which expresses $2^4$ gray scales, FIG. 10B shows a timing chart in the case of the second display mode which expresses $2^2$ gray scales, and FIG. 10C shows a timing chart in the case of the third display mode which expresses $2^3$ gray scales by inputting a 3-bit signal.

In the third display mode, a light emitting state or a non-light emitting state of each pixel is selected in respective display periods of subframe periods SF1 to SF3 structuring one frame period. Here, an opposing potential is set to be nearly the same as a power supply potential during writing periods, and is changed in the display periods so as to have a potential difference from the power supply potential to an extent that a light-emitting element emits light. This operation is similar to the conventional example, thus a detailed description is omitted.

Here, switching among the first, the second, and the third display modes is, similar to the conventional one, performed based on the intensity of outside light detected by the light sensor which is provided for the display device of the invention. If the output signal of the light sensor is large, that is, if the intensity of outside light is high, the display mode is switched to the second display mode in which the number of gray scales is small. On the other hand, if the output signal of the light sensor is small, that is, if the intensity of outside light is low, the display mode is switched to the first display mode in which the number of gray scales is large. In addition, if the output signal of the light sensor is medium, that is, if the intensity of outside light is medium, the display mode is switched to the third display mode in which the number of gray scales is medium.

By changing the number of gray scales of an image in accordance with the intensity of outside light as above, an image can be perceived clearly and the visibility can be ensured in a wide range of situations, from under a fluorescent lamp in a dark place or inside, to under sunlight outside.

As described above, by setting a display mode in which the number of gray scales to be expressed is changed more minutely in addition to the first display mode and the second display mode, the display modes can be used optimally as the situation demands. For example, in the case of displaying a moving image or the like, the first display mode in which the number of gray scales to be expressed is large is suitable. In the case of displaying an image including many characters such as e-mail, the second display mode in which the number of gray scales to be expressed is small is suitable. Further, in the case of displaying a still image or the like such as a cartoon, the third display mode in which the number of gray scales to be expressed is medium is suitable. Note that the number of gray scales to be expressed in the first display mode is desirably $2^4$ gray scales or more. The number of gray scales to be expressed in the third display mode is desirably about $2^3$ gray scales.

Note that although the description is made on an example in which the display mode is switched based on the intensity of outside light in this embodiment mode, a selection switch by which a user selects a display mode in accordance with the application may be provided for the display device as well. In addition, even when a display mode is selected by the selection switch, the number of gray scales of the selected display mode can be automatically increased or decreased in accordance with the intensity of outside light.

Note that when a gray scale is expressed in the first, the second, or the third display mode, the number of subframes is not particularly limited. Further, the length of a display period of each subframe period, or the subframe for lighting, that is, a selecting method of subframes are not also be particularly limited.

Embodiment 1

Hereinafter, an embodiment mode of the invention is described.

Figure 11:
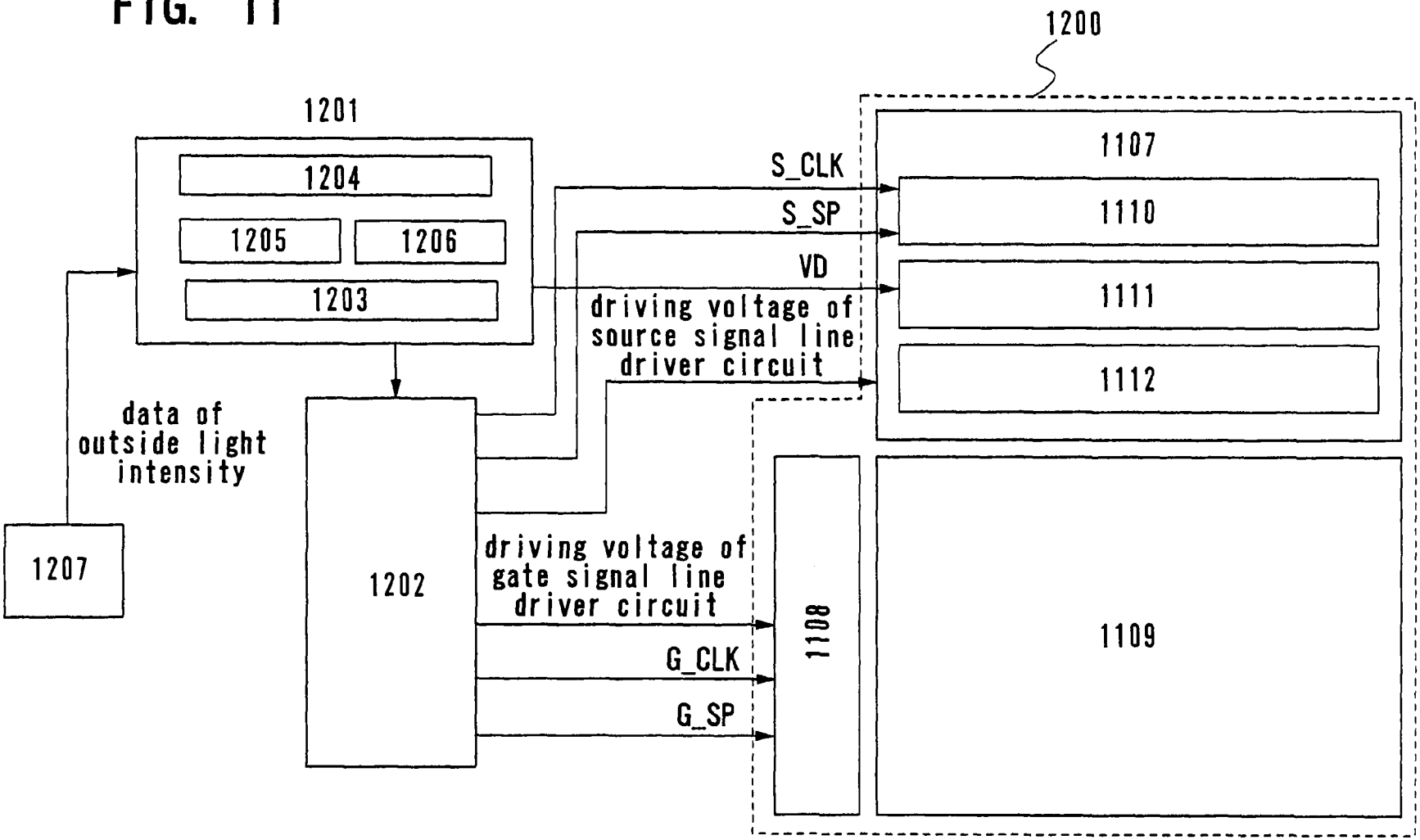
FIG. 11 is a block diagram showing constitution of a display device of the invention.

Description is made on a circuit for inputting a signal to perform a time gray scale driving method to a source signal line driver circuit and a gate signal line driver circuit with reference to FIG. 11.

In this specification, an image signal to be inputted to the display device is called a digital video signal. Note here that description is made on an example of a display device for displaying an image by being inputted a 4-bit digital video signal. Note that the invention is not limited to 4 bits.

A digital video signal is read into a signal controlling circuit 1201, and the signal controlling circuit 1201 outputs a digital image signal (VD) to a display 1200.

Note also that in this specification, a signal to be inputted into the display after being converted by the compilation of a digital video signal in the signal controlling circuit 1201 is called a digital video signal.

A signal and a driving voltage for driving a source signal line driver circuit 1107 and a gate signal line driver circuit 1108 of the display 1200 are inputted by a display controller 1202.

Note that the source signal line driver circuit 1107 of the display 1200 is constituted by a shift register 1110, a LAT (A) 1111, and a LAT (B) 1112. In addition, although not shown, a level shifter, a buffer, or the like may also be provided. The invention is not limited to the above-described constitution.

The signal control circuit 1201 is constituted by a CPU 1204, a memory A 1205, a memory B 1206, and a memory controller 1203.

A digital video signal inputted to the signal controlling circuit 1201 is controlled by the memory controller 1203 to be inputted to the memory A 1205. Here, the memory A 1205 has capacity that is capable of storing the 4-bit digital video signals for all pixels of a pixel portion 1109 of the display 1200. When signals for one frame period are stored in the memory A 1205, the signal for each bit is read out sequentially by the memory controller 1203, and then inputted to the source signal line driver circuit as a digital image signal VD.

When reading of the signals stored in the memory A 1205 starts, a digital video signal corresponding to the next frame period starts to be inputted to the memory B 1206 through the memory controller 1203 and stored. Similarly to the memory A 1205, the memory B 1206 also has capacity that is capable of storing 4-bit digital video signals for all the pixels of the display device.

As described above, the signal controlling circuit 1201 includes the memory A 1205 and the memory B 1206 each of which is capable of storing a 4-bit digital video signal for one frame period. Digital video signals are sampled using the memory A 1205 and the memory B 1206 alternately.

The signal controlling circuit 1201 which stores signals by using the two memories, the memory A 1205 and the memory B 1206, alternately is described here. In general, however, memories each of which is capable of storing data for a plurality of frames are provided and these memories can be used alternately.

Figure 12:
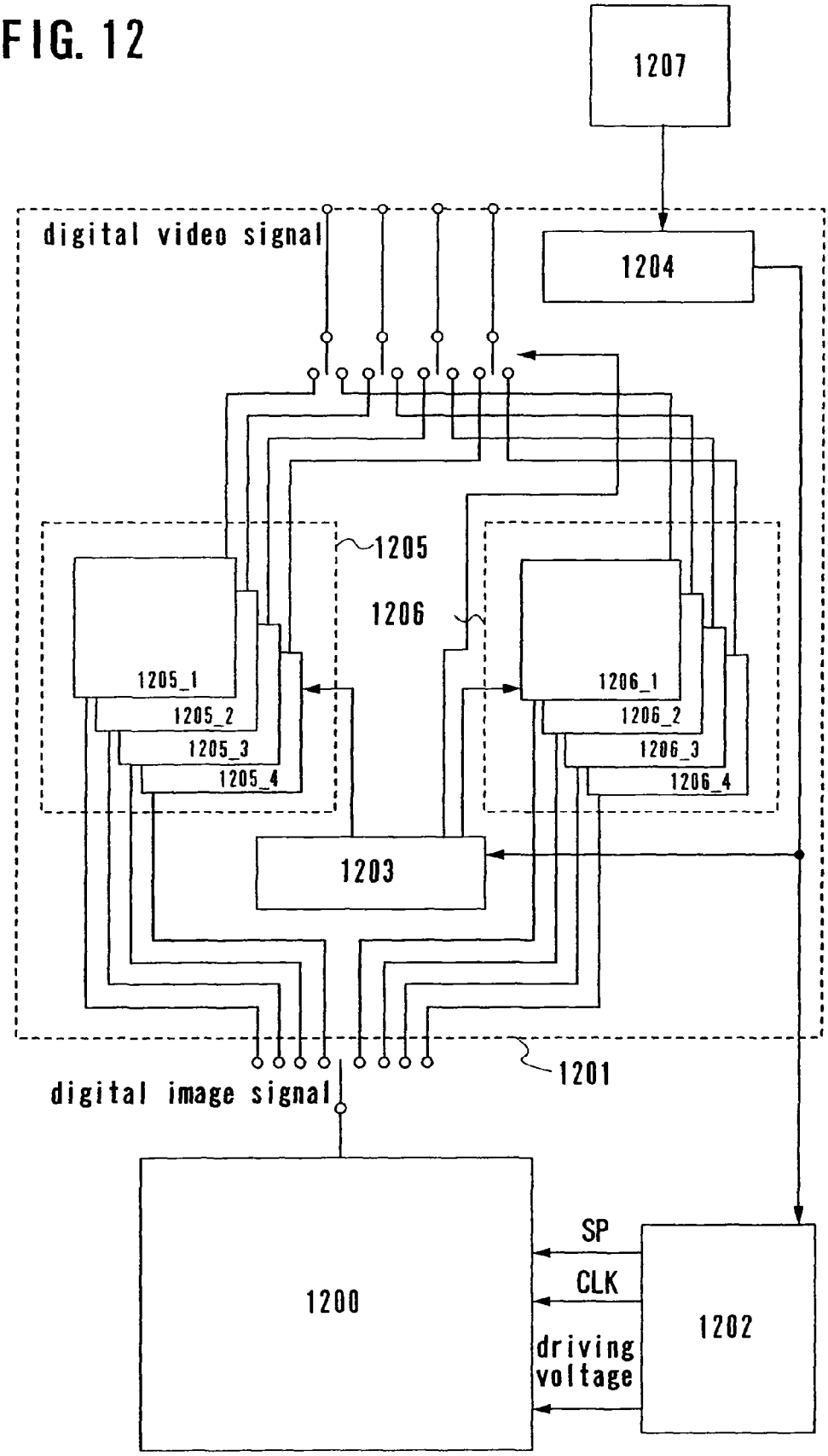
FIG. 12 is a block diagram showing constitution of a display device of the invention.

A block diagram of the display device for performing the above-described operation is shown in FIG. 12. The display device is constituted by the signal controlling circuit 1201, the display controller 1202, the display 1200, and the light sensor 1207.

The display controller 1202 supplies a start pulse SP, a clock pulse CLK, and a driving voltage to the display 1200.

The light sensor 1207 detects outside light, and inputs an electrical signal in accordance with intensity thereof to the CPU 1204 through an amplifier (not shown).

Shown in FIG. 12 is an example of a display device in which a 4-bit digital video signal is inputted and a gray scale is expressed using a 4-bit digital image signal in the first display mode. The memory A 1205 is constituted by memories 1205_1 to 1205_4 for storing data of a first bit to data of a fourth bit of the digital video signal respectively. Similarly, the memory B 1206 is constituted by memories 1206_1 to 1206_4 for storing data of a first bit to data of a fourth bit of the digital video signal respectively. The memories corresponding to respective bits each have a plurality of memory elements by which a signal for one bit can be stored as many as the number of pixels forming one screen.

In general, in a display device which is capable of expressing a gray scale by using an n-bit digital image signal, the memory A 1205 is constituted by memories 1205_1 to 1205_n for storing data of a first bit to data of an n-th bit respectively. Similarly, the memory B 1206 is constituted by memories 1206_1 to 1206_n for storing data of a first bit to data of an n-th bit respectively. The memories corresponding to respective bits each have capacity capable of storing a signal for one bit as many as the number of pixels forming one screen.

Figure 13:
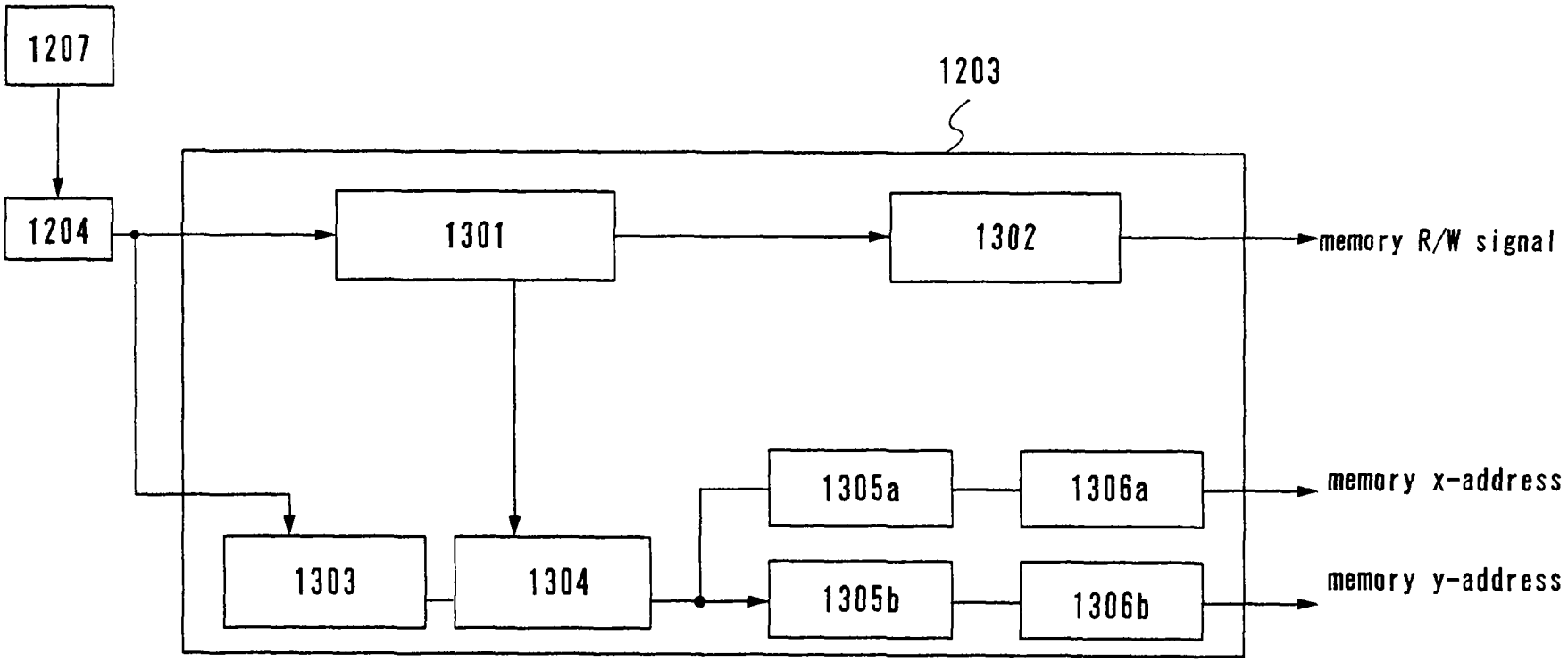
FIG. 13 is a diagram showing constitution of a memory controller of a display device of the invention.

Constitution of the memory controller 1203 is shown in FIG. 13. In FIG. 13, the memory controller 1203 is constituted by a gray scale limiting circuit 1301, a memory R/W circuit 1302, a reference oscillating circuit 1303, a variable frequency dividing circuit 1304, an x-counter 1305*a*, a y-counter 1305*b*, an x-decoder 1306*a*, and a y-decoder 1306*b*.

The memory A 1205 and the memory B 1206 or the like shown in FIGS. 11, 12, or the like are collectively referred to as a memory. In addition, the memory is constituted by a plurality of memory elements. The memory elements are selected by an address (x, y).

A signal from the CPU 1204 is inputted to the memory R/W circuit 1302 through the gray scale limiting circuit 1301. The gray scale limiting circuit 1301 inputs the signal to the memory R/W circuit 1302 in accordance with either the first display mode or the second display mode. The memory R/W circuit 1302 selects whether or not to write a digital video signal corresponding to each bit into the memory, in accordance with the signal from the gray scale limiting circuit 1301. Similarly, an operation of reading a digital image signal which has been written into the memory is selected.

Further, the signal from the CPU 1204 to be inputted to the gray scale limiting circuit 1301 is controlled by an output signal in accordance with the intensity of outside light detected by the light sensor 1207. In the case where the output signal of the light sensor 1207 is equal to or larger than a certain value, that is, when the intensity of outside light is high, a signal by which the gray scale limiting circuit 1301 outputs a signal in accordance with the second display mode in which the number of gray scales is small, is inputted from the CPU 1204. On the other hand, in the case where the output signal of the light sensor 1207 is smaller than the certain value, that is, when the intensity of outside light is low, a signal by which the gray scale limiting circuit 1301 outputs a signal in accordance with the first display mode in which the number of gray scales is large, is inputted from the CPU 1204.

Further, the signal from the CPU 1204 is inputted to the reference oscillating circuit 1303. A signal from the reference oscillating circuit 1303 is inputted to the variable frequency dividing circuit 1304, and converted to a signal with a suitable frequency. Here, to the variable frequency dividing circuit 1304, the signal from the gray scale limiting circuit 1301 in accordance with either the first display mode or the second display mode is inputted. Based on this signal, the signal from the variable frequency dividing circuit 1304 selects an x-address of the memory through the x-counter 1305*a* and the x-decoder 1306*a*. Similarly, the signal from the variable frequency dividing circuit is inputted to the y-counter 1305*b* and to the y-decoder 1306*b*, and selects a y-address of the memory.

By using the memory controller 1203 with the above-described constitution, as well as the number of gray scales to be expressed can be changed in accordance with the intensity of outside light, the amount of data of a signal to be written into and read from the memory, in the digital video signal inputted to the signal controlling circuit can be suppressed when high gray scale display is not required. Further, the frequency for reading out the signal from the memory can be changed.

Constitution of the display controller 1202 is described below.

FIG. 3 is a diagram showing the constitution of the display controller of the invention. The display controller 1202 is constituted by a reference clock generating circuit 301, a variable frequency dividing circuit 302, a horizontal clock generating circuit 303, a vertical clock generating circuit 304, the power source controlling circuit for a light-emitting element 305, and the power supply controlling circuit for a driver circuit 306.

A clock signal 31 inputted from the CPU 1204 is inputted to the reference clock generating circuit 301, and generates a reference clock. This reference clock is inputted to the horizontal clock generating circuit 303 and to the vertical clock generating circuit 304 through the variable frequency dividing circuit 302. To the variable frequency dividing circuit 302, the gray scale controlling signal 34 is inputted from the CPU 1204. The frequency of the reference clock is changed by this gray scale controlling signal 34.

Note that the extent that the frequency of a reference clock is changed in the variable frequency dividing circuit 302 can be determined arbitrarily.

Note that the gray scale controlling signal 34 to be inputted from the CPU 1204 is controlled by an output signal in accordance with the intensity of outside light detected by the light sensor 1207. In the case where the output signal of the light sensor 1207 is equal to or larger than a certain value, that is, when the intensity of outside light is high, a gray scale controlling signal in accordance with the second display mode in which the number of gray scales is small, is inputted. On the other hand, in the case where the output signal of the light sensor 1207 is smaller than the certain value, that is, when the intensity of outside light is low, a signal in accordance with the first display mode in which the number of gray scales is large, is inputted.

Further, a horizontal period signal 32 for determining a horizontal period is inputted to the horizontal clock generating circuit 303 from the CPU 1204, and a clock pulse S_CLK and a start pulse S_SP for the source signal line driver circuit are outputted. Similarly, a vertical period signal 33 for determining a vertical period is inputted to the vertical clock generating circuit 304 from the CPU 1204, and a clock pulse G_CLK and a start pulse G_SP for the gate signal line driver circuit are outputted.

In this manner, as well as the number of gray scales to be expressed can be changed in accordance with the intensity of outside light, reading out of a lower bit signal from the memory is not prevented and the frequency of reading out a signal from the memory is reduced by the memory controller of the signal controlling circuit when high gray scale display is not required. Corresponding to the above-described operation, the display controller lowers the frequencies of the sampling pulse SP and of the clock pulse CLK to be inputted to each of the driver circuits (the source signal line driver circuit and the gate signal line driver circuit), and can set a writing period and a display period of a subframe period for expressing an image to be long.

For example, considered is a display device in which one frame period is divided into four subframe periods, the ratio of respective display periods Ts1, Ts2, Ts3, and Ts4 of the subframe periods is set to be $2^0:2^{-1}:2^{-2}:2^{-2}$, and $2^4$ gray scales are expressed by using a 4-bit digital image signal in the first display mode. For simplicity, the lengths of the display periods Ts1 to Ts4 of the respective subframe periods are assumed to be 8, 4, 2, and 1 respectively. In addition, each length of the writing periods Ta1 to Ta4 of the respective subframe periods is assumed to be 1. Furthermore, considered is a case where a gray scale is expressed by using an upper one-bit signal in the second display mode.

In this case, the proportion occupied by the subframe period which corresponds to the bit relating to the gray scale expression in the second display mode, in the first display mode per frame period is 9/19.

Figure 41:
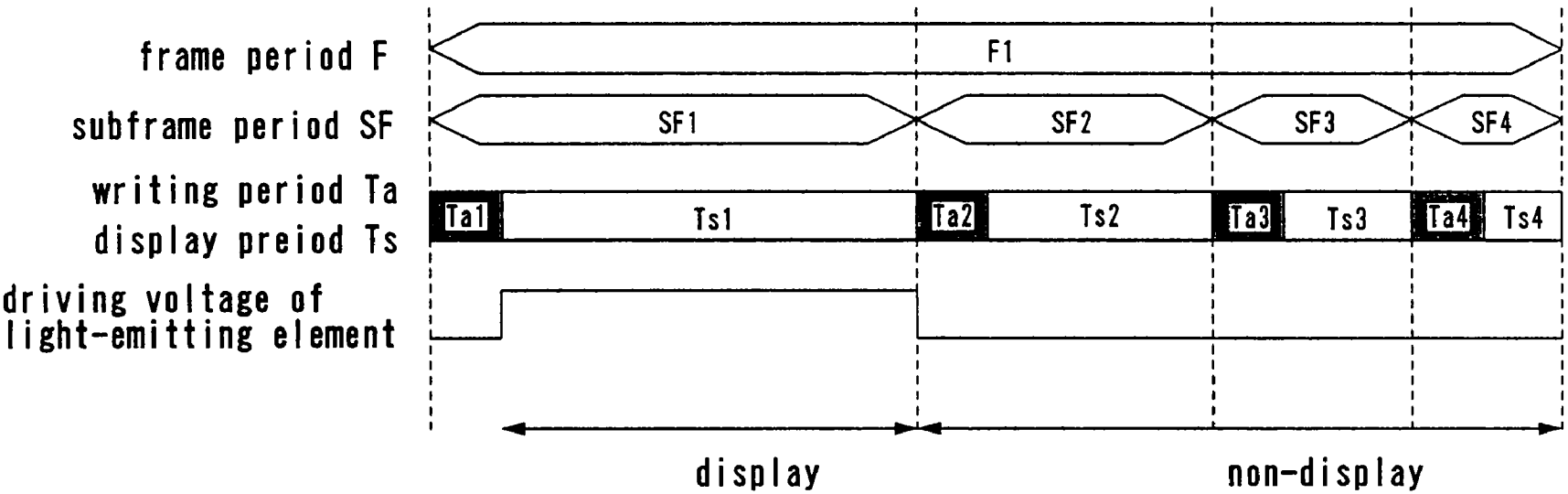
FIG. 41 is a diagram of a timing chart showing a driving method of a conventional display device.
Figure 42B:
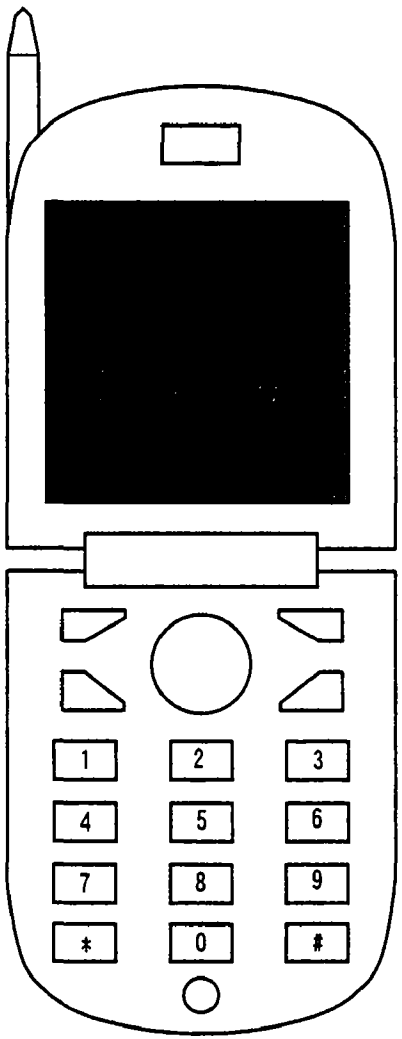
FIGS. 42A and 42B are views showing a problem of a conventional display device.
Figure 42A:
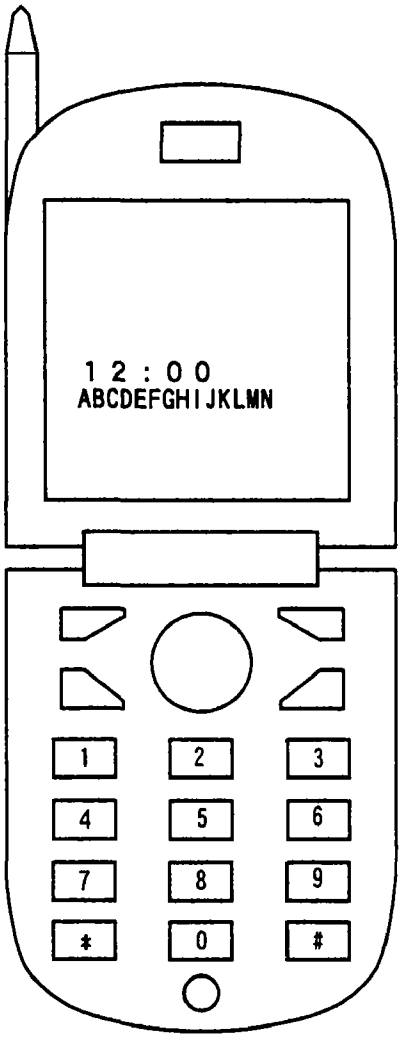

In the case where the structure of the invention is not used, for example, in the case where a conventional driving method as shown in FIG. 41 is used, 10/19 of one frame period becomes a period which does not relate to display in the second display mode.

On the other hand, in the invention according to the above-described structure, in the second display mode, the frequency of the clock signal or the like to be inputted to each driver circuit of the display is changed, a writing period is set to have a length that is 19/9 times the length of the writing period in the first display mode, and similarly, a display period is also set to have a length that is 19/9 times the length of the display period Ts1 of the subframe period SF1 which is corresponding to the first bit in the first display mode. In this manner, one frame period can be occupied by the subframe period SF1. Accordingly, the period which does not relate to display during one frame period can be reduced in the second display mode.

In this manner, a lighting period of a light-emitting element per frame period can be increased also in the second display mode.

Note that in this embodiment, one frame period is divided into four subframe periods, and $2^4$ gray scales are expressed by using a 4-bit digital image signal in the first display mode; however, one subframe period may be further divided into a plurality of subframe periods. For example, one frame period may be divided into six subframe periods.

The power source controlling circuit for a light-emitting element 305 controls the potential of an opposing electrode (opposing potential) of a light-emitting element such that it is maintained at a potential which is nearly the same as the power source potential during the writing period whereas it has a potential difference from the power source potential to an extent that the light-emitting element emits light in the display period. Here, the gray scale controlling signal 34 is also inputted to the power source controlling circuit for a light-emitting element 305. By this, in the pixel in which a light emitting state is selected, the potential of the opposing electrode of the light-emitting element is changed so as to reduce a voltage applied between both electrodes of the light-emitting element, by an amount of the increase in the light emitting period of the light-emitting element. In addition, since the gray scale controlling signal 34 is controlled by an output signal in accordance with the intensity of outside light detected by the light sensor 1207, the voltage to be applied between both the electrodes of the light-emitting element can be changed in accordance with the intensity of the outside light.

Note that description is made on the case where there are two kinds of display modes, the first display mode and the second display mode, in this embodiment; however, the potential of the opposing electrode of the light-emitting element can be similarly changed also in the case where a display mode in which the number of gray scales to be expressed is changed is set in addition to the first and the second display modes.

Figure 14:
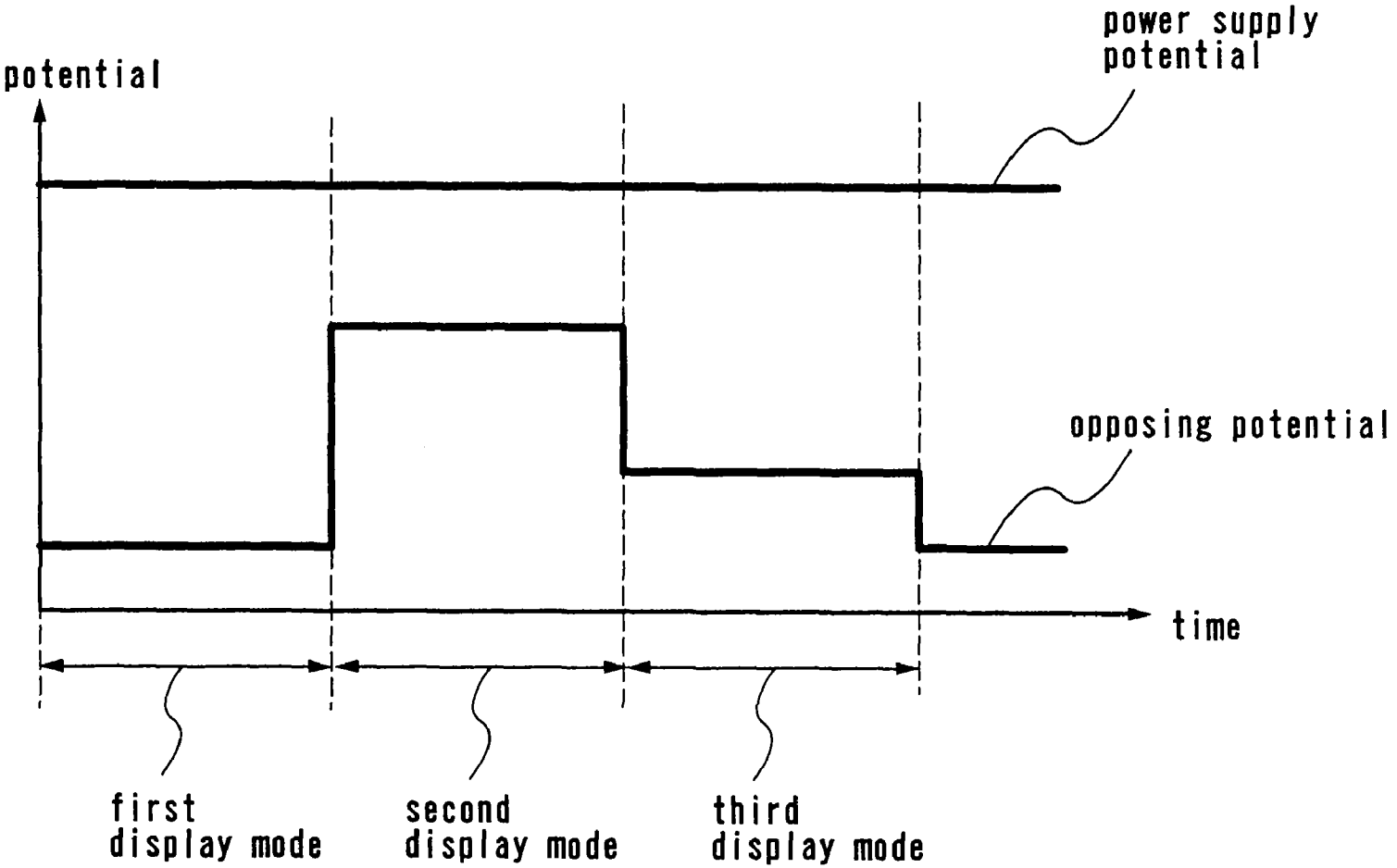
FIG. 14 is a diagram showing a driving method of a display device of the invention.

For example, considered is a case where, in addition to the first display mode which expresses $2^4$ gray scales and the second display mode which expresses 2 gray scales, a third display mode which expresses $2^3$ gray scales is provided. In the third display period, a display period of a light-emitting element per frame period can be longer than the case in the first display mode, by operation of the display controller. Therefore, with respect to the third display period, the voltage to be applied between both the electrodes of the light-emitting element can be reduced. However, the voltage to be applied between both the electrodes of the light-emitting element cannot be lower than the case in the second display mode. Therefore, with respect to the first, the second, and the third display modes, the potential of the opposing electrode of the light-emitting element can be changed by the power source controlling circuit for a light-emitting element 305. Note that shown in FIG. 14 is an example of the potential of the opposing electrode with respect to the first, the second, and the third display modes. Compared lengths of respective display periods per frame period in the display modes, the display period in the second display period is the longest, followed by that in the third display mode and that in the first display mode in this order. Therefore, the potential of the opposing electrode may be controlled such that it is the highest in the second display period, followed by that in the third display mode and that in the first display mode in this order.

In this manner, in the second and the third display modes, the size of a voltage to be applied between both the electrodes of the light-emitting element can be decreased, therefore, the stress on the light-emitting element due to the applied voltage can be reduced.

The power supply controlling circuit for a driver circuit 306 controls a power source voltage to be inputted to each driver circuit. Here, the gray scale controlling signal 34 is inputted also to the power supply controlling circuit for a driver circuit 306, thereby the power source voltage for a driver circuit to be outputted is changed. In the second display mode, the frequency of the clock pulse of each driver circuit is smaller than that in the first display mode, therefore, each driver circuit can be operated at a lower power source voltage. Further, since the gray scale controlling signal 34 is controlled by the output signal in accordance with the intensity of outside light detected by the light sensor 1207, the power source voltage for a driver circuit can be changed in accordance with the intensity of outside light.

Note that the power source controlling circuit for a driver circuit 306 may adopt a known configuration such as a technique disclosed in Japanese Patent No. 3110257.

In addition, a means for setting a voltage of driving the display controller to be low may be provided in order to reduce the power consumption of the display controller in driving the display device in the second display mode.

The above-mentioned signal controlling circuit 1201, memory controller 1203, CPU 1204, memory 1205 and 1206, and display controller 1202 may be formed on the same substrate as pixels of the display 1200, or may be formed by LSI chips and then be attached to the display 1200 by COG, or may be attached to the substrate by using TAB, or may be formed on a substrate different from that of the display and connected to the display by using an electric wiring.

Embodiment 2

Figure 43:
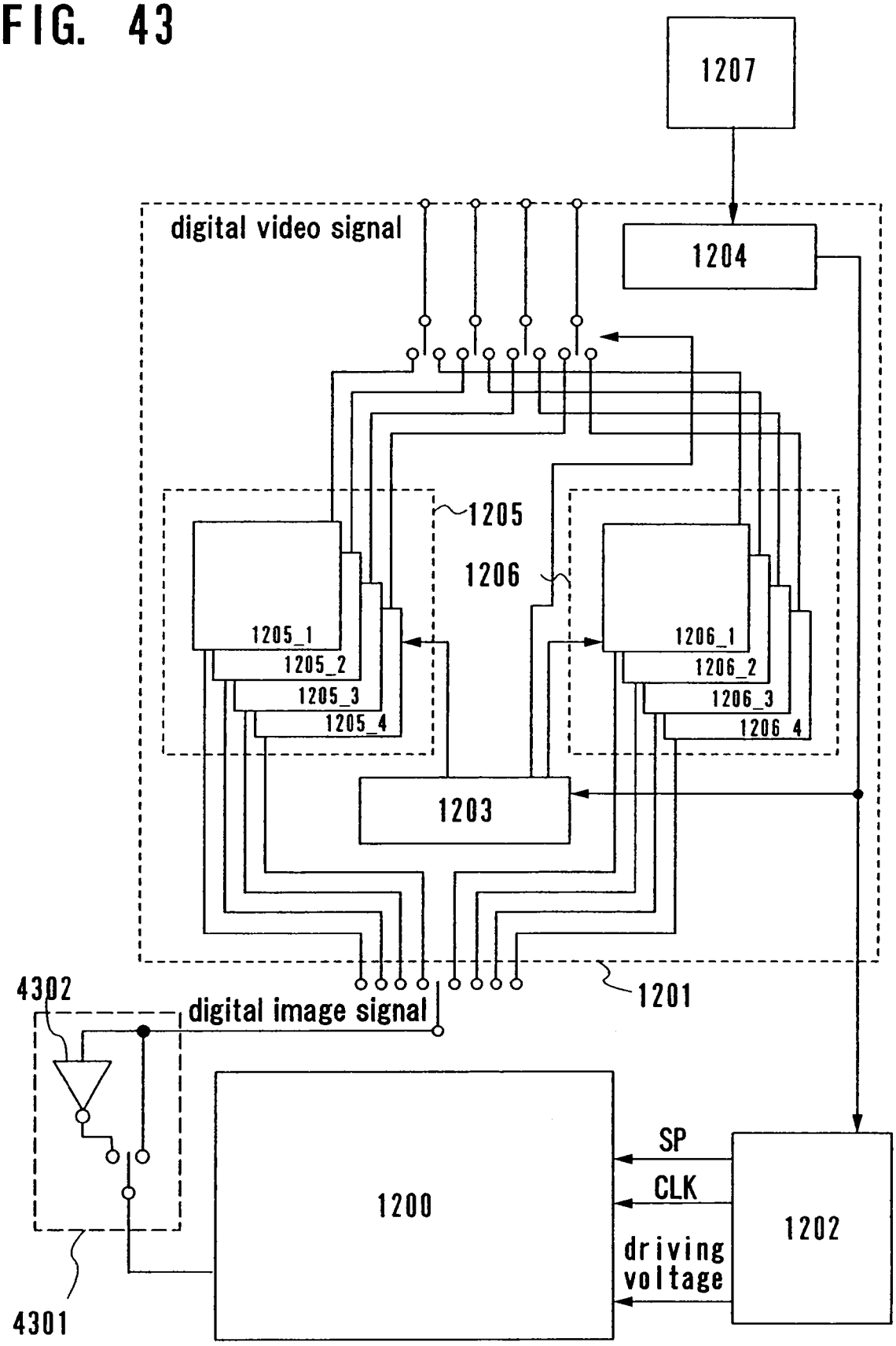
FIG. 43 is a block diagram showing constitution of a display device of the invention.

In this embodiment, described is a display device provided with a means for inverting the contrast between light and dark of a display image when the second display mode which expresses 2 gray scales is selected by an output of the light sensor 1207. A block diagram of the display device of this embodiment is shown in FIG. 43. Compared to the example of the display device described in Embodiment 1, there is a difference in that a digital image signal is not inputted directly to the display 1200 from the signal controlling circuit 1201, but is inputted through a switch 4301. The switch 4301 includes an inverter circuit 4302, and by switching the switch 4301, whether a digital image signal is to be inputted to the display as it is or to be inputted with the contrast inverted can be selected. Consequently, normally, a white background image and a black display image are inverted so that a white display image can be displayed on a black background image. Accordingly, as well as the visibility of the display screen can be further improved, the area of the light emitting portion can be reduced so that power consumption can be reduced since the background image is black. Further, by increasing the luminance of the white display image, the visibility of the display screen can be further more improved.

Note that the display controller, the memory controller, the configuration of the display portion, or the like may adopt those described in Embodiment 1.

Figure 44B:
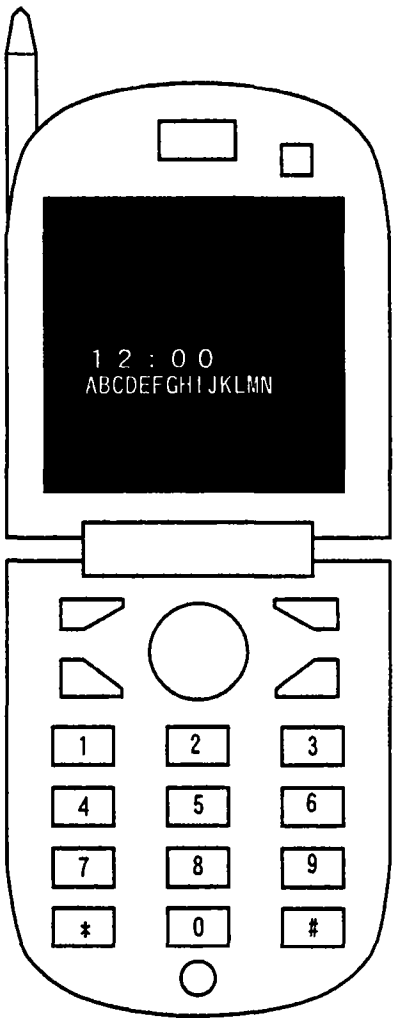
FIGS. 44A and 44B are views showing an example of a mobile phone provided with a display device of the invention.
Figure 44A:
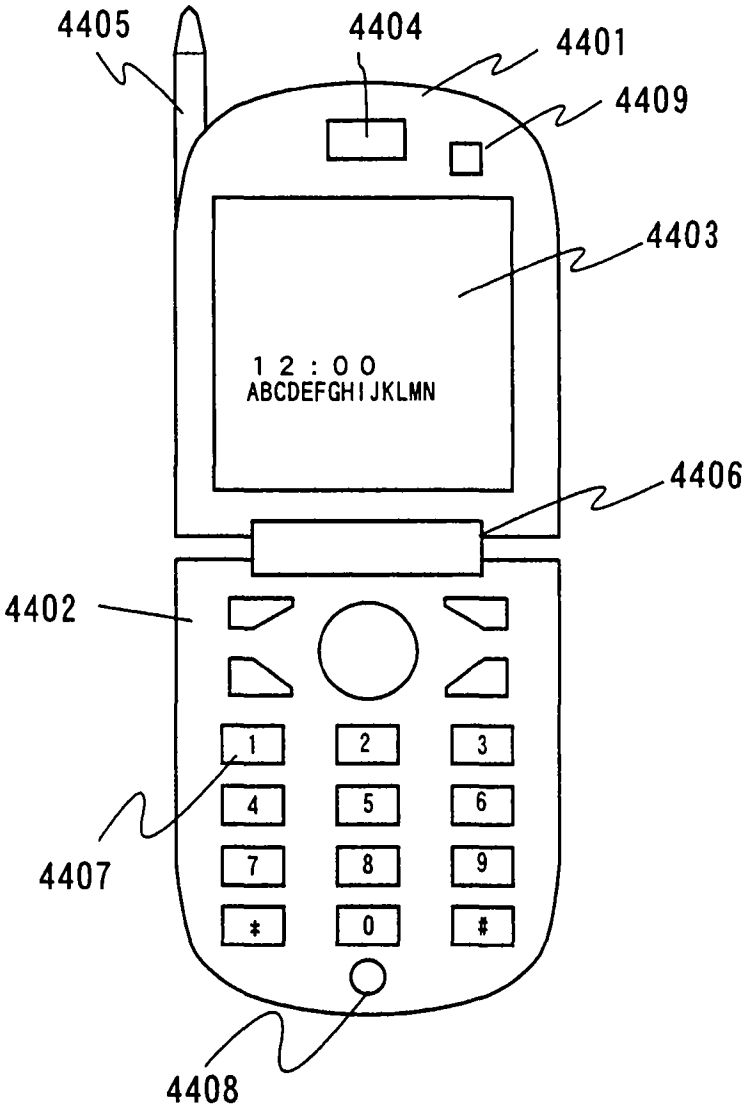

An example of a mobile phone provided with the display device shown in FIG. 43 is shown in FIGS. 44A and 44B. The mobile phone shown in FIG. 44A is constituted by a first chassis 4401, a second chassis 4402, a display screen 4403, a speaker 4404, an antenna 4405, a hinge 4406, a keyboard 4407, a microphone 4408, and a light sensor 4409. The display device of the invention is put in the first chassis 4401.

FIG. 44A shows display in the case where outside light is weak. On the display screen 4403, black characters are displayed on a white background image. When the outside light is weak, sensitivity of eyes can adapt to the light-emitting luminance of the display screen.

FIG. 44B shows display in the case where outside light is strong. In the case where outside light is strong, the outside light exceeds the luminance of the white background image, therefore, the intensity of outside light is detected by the light sensor 4409 and the contrast of the images is inverted such that the background image is black and the characters are white. By displaying the background image with black like this, the white characters can be perceived clearly. Further, the background image which is displayed with black can reduce the area of the light-emitting portion so that the power consumption can be reduced. Further, by increasing the luminance of the white characters, the visibility of the display screen can be further more improved.

Note that although this embodiment describes the example of the mobile phone, the invention is not limited to this and can be used for various electronic apparatuses using a display device, such as a portable information terminal, a personal computer, a video camera, or an image reproducing device.

Note that this embodiment can be implemented freely combining with the content of Embodiment 1.

Embodiment 3

Figure 15:
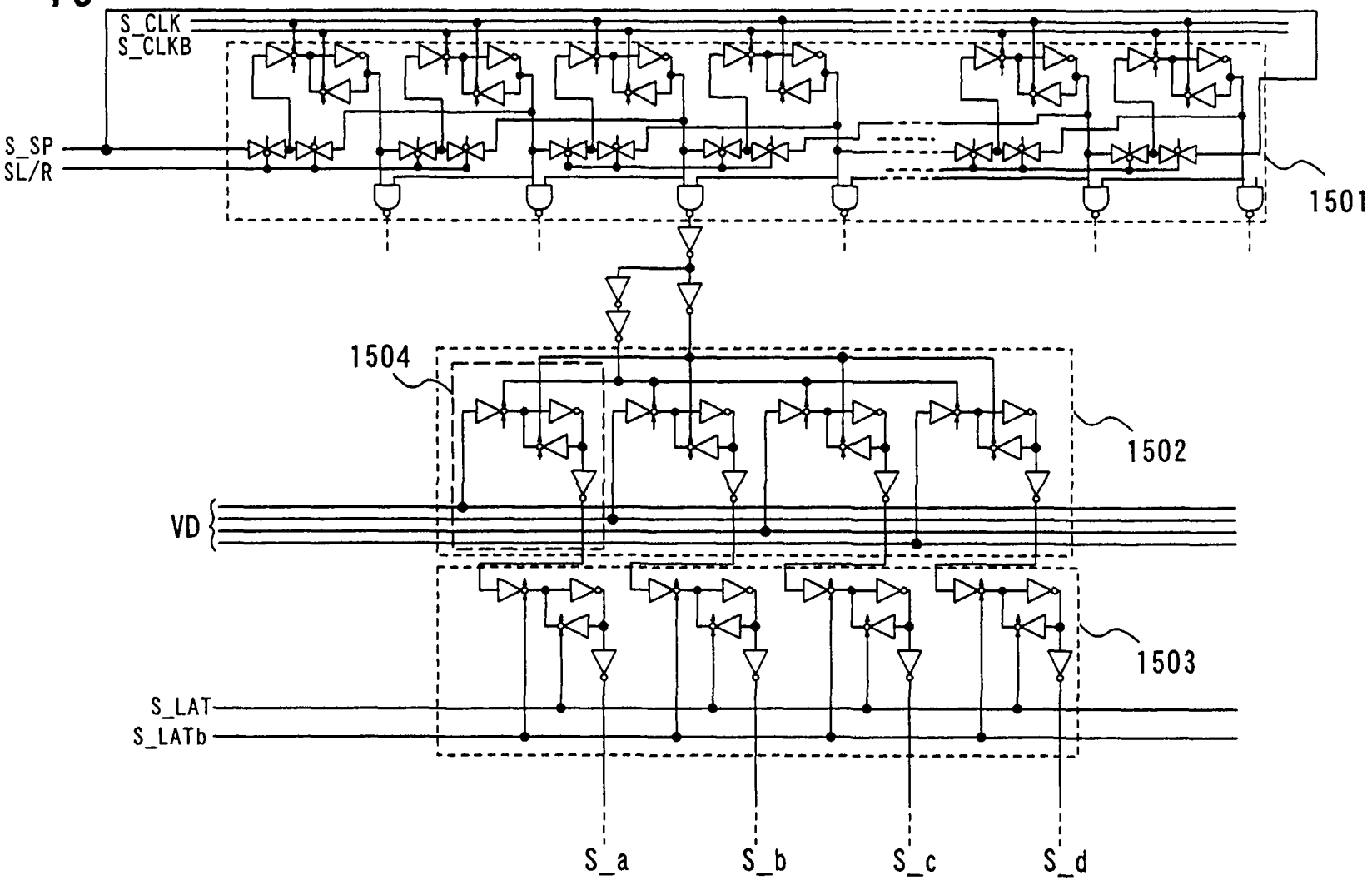
FIG. 15 is a diagram showing a configuration of a source signal line driver circuit of a display device of the invention.

In this embodiment, described is a configuration example of the source signal line driver circuit of the display device of the invention. The configuration example of the source signal line driver circuit is shown in FIG. 15.

The source signal line driver circuit is constituted by a shift register 1501, a scanning direction switching circuit, a LAT (A) 1502, and a LAT (B) 1503. Note that although only a part of the LAT (A) 1502 and a part of the LAT (B) 1503 which are corresponding to one of outputs from the shift register 1501 are illustrated in FIG. 15, the LAT (A) 1502 and the LAT (B) 1503 having the respective same configurations correspond to each output from the shift register 1501.

The shift register 1501 is constituted by a clocked inverter, an inverter, and a NAND circuit. A start pulse S_SP for a source signal line driver circuit is inputted to the shift register 1501. By changing the state of the clocked inverter between a conductive state and a non-conductive state in accordance with a clock pulse S_CLK for a source signal line driver circuit and an inverted clock pulse S_CLKB for a source signal line driver circuit that is a signal of which polarity is inverse to that of the clock pulse S_CLK, a sampling pulse is outputted sequentially from the NAND circuit to the LAT (A) 1502.

The scanning direction switching circuit is constituted by a switch, and functions to switch the scanning direction of the shift register 1501 between left and right directions. In FIG. 15, the shift register 1501 outputs the sampling pulse sequentially from the left to the right in the case where a scanning direction switching signal L/R corresponds to a Lo signal. On the other hand, in the case where the scanning direction switching signal L/R corresponds to a Hi signal, the sampling pulse is outputted sequentially from the right to the left.

Each stage of the LAT (A) 1502 is constituted by a clocked inverter and an inverter.

Here, "each stage of the LAT (A) 1502" means a LAT (A) 1504 for taking in an image signal to be inputted to one source signal line.

Here, the digital image signal VD outputted from the signal controlling circuit described in Embodiment 1 is inputted by being divided into p (where p is a natural number). That is, signals corresponding to respective outputs to p source signal lines are inputted in parallel. When a sampling pulse is inputted at the same time to the clocked inverters of p stages of the LAT (A) 1502 through buffers, the respective inputted signals after being divided into p are sampled at the same time in the p stages of the LAT (A) 1502.

A source signal line driver circuit for outputting a signal voltage to x source signal lines is described here, therefore, x/p sampling pulses are outputted sequentially from the shift register per horizontal period. In accordance with each sampling pulse, the p stages of the LAT (A) 1502 sample respective digital image signals which correspond to outputs to the p source signal lines, at the same time.

In this specification, a method in which a digital image signal inputted to the source signal line driver circuit is divided into a p-phase parallel signals and the p digital image signals are taken in at the same time by using one sampling pulse, is called a p-division drive. A 4-division drive is performed in FIG. 15.

By performing the above-described division drive, there can be a margin on the sampling of the shift register in the source signal line driver circuit. Reliability of the display device can thus be increased.

When all of the signals for one horizontal period are inputted to the respective stages of the LAT (A) 1502, a latch pulse LS and an inverted latch pulse LSB of which polarity is inverse to that of the latch pulse LS are inputted, and the respective signals inputted to the stages of the LAT (A) 1502 are all outputted to respective stages of the LAT (B) 1503.

Note that "each stage of the LAT (B) 1503" means a LAT (B) to which the signal from each stage of the LAT (A) 1502 is inputted.

Each stage of the LAT (B) 1503 is constituted by a clocked inverter and an inverter. The respective signals outputted from the stages of the LAT (A) 1502 are stored in the LAT (B) 1503, and are outputted to source signal lines S1 to Sx.

Note that a level shifter, a buffer, or the like may be arbitrarily provided although not shown here.

The start pulse S_SP, the clock pulse S_CLK, or the like to be inputted to the shift register 1501, the LAT (A) 1502, and the LAT (B) 1503, are inputted from the display controller described in Embodiment Mode of the invention.

In the invention, an operation of inputting a digital image signal with a small number of bits to the LAT (A) of the source signal line driver circuit is performed by the signal controlling circuit. Meanwhile, an operation of reducing the frequency of the clock pulse S_CLK, the start pulse S_SP, or the like to be inputted to the shift register of the source signal line driver circuit and decreasing a driving voltage of operating the source signal line driver circuit is performed by the display controller.

In this manner, an operation of sampling the digital image signal by the source signal line driver circuit is reduced in the second display mode, so that the power consumption of the display device can be suppressed.

Note that the display device of the invention can freely adopt a source signal line driver circuit having a known configuration, as well as the source signal line driver circuit having the configuration of this embodiment.

Further, depending on the configuration of the source signal line driver circuit, the number of signal lines to be inputted to the source signal line driver circuit from the display controller and the number of power supply lines of a driving voltage are changed.

Note that this embodiment can be implemented freely combining with Embodiment 1 and Embodiment 2.

Embodiment 4

In this embodiment, described is a configuration example of the gate signal line driver circuit of the display device of the invention.

The gate signal line driver circuit is constituted by a shift register, a scanning direction switching circuit, or the like. Note that a level shifter, a buffer, or the like may be arbitrarily provided although not shown here.

A start pulse G_SP, a clock pulse G_CLK, a driving voltage, or the like are inputted to the shift register, and a gate signal line selection signal is outputted.

Figure 16:
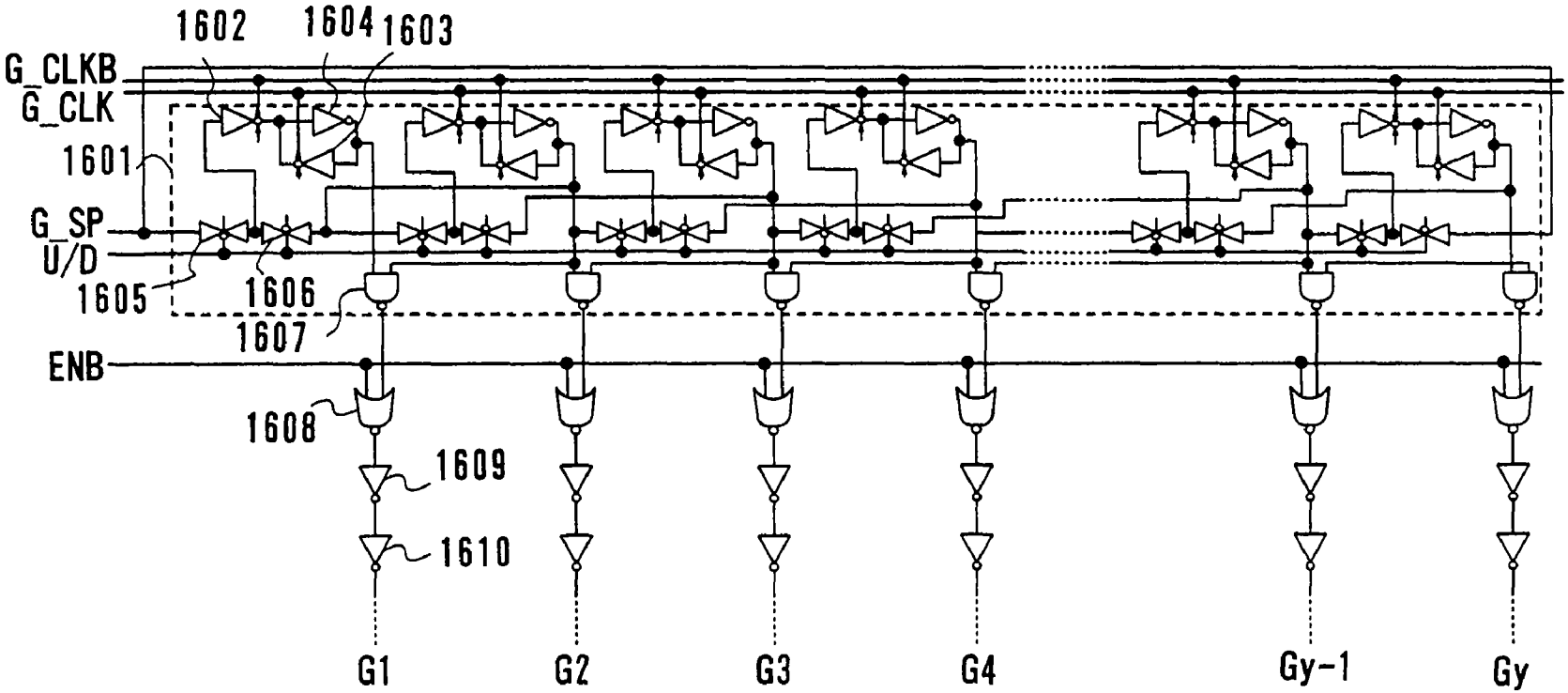
FIG. 16 is a diagram showing a configuration of a gate signal line driver circuit s of a display device of the invention.

A configuration of the gate signal line driver circuit is described using FIG. 16. A shift register 1601 is constituted by clocked inverters 1602 and 1603, an inverter 1604, and a NAND circuit 1607. The start pulse G_SP is inputted to the shift register 1601. By changing the state of the clocked inverters 1602 and 1603 between a conductive state and a non-conductive state in accordance with the clock pulse G_CLK and an inverted clock pulse G_CLKB which is a signal of which polarity is inverse to that of the clock pulse G_CLK, sampling pulses are outputted sequentially from the NAND circuit 1607.

The scanning direction switching circuit is constituted by a switch 1605 and a switch 1606, and functions to switch the scanning direction of the shift register between left and right directions. In FIG. 16, the shift register outputs the sampling pulse sequentially from the left to the right in the case where a scanning direction switching signal U/D corresponds to a Lo signal. On the other hand, in the case where the scanning direction switching signal U/D corresponds to a Hi signal, the sampling pulse is outputted sequentially from the right to the left.

The sampling pulse outputted from the shift register is inputted to a NOR circuit 1608, and operation is performed with an enable signal ENB. This operation is performed in order to prevent a condition in which adjacent gate signal lines are selected at the same time due to dullness of the sampling pulses. A signal outputted from the NOR circuit 1608 is outputted to each of gate signal lines G1 to Gy, through buffers 1609 and 1610.

Note that a level shifter, a buffer, or the like may be arbitrarily provided although not shown here.

The start pulse G_SP, the clock pulse G_CLK, the driving voltage, or the like to be inputted to the shift register are inputted from the display controller described in Embodiment Mode.

In the invention, in the second display mode, an operation of reducing the frequency of the clock pulse G_CLK, the start pulse G_SP, or the like to be inputted to the shift register of the gate signal line driver circuit and decreasing a driving voltage of operating the gate signal line driver circuit is performed by the display controller.

In this manner, an operation of sampling in the gate signal line driver circuit is reduced in the second display mode, so that the power consumption of the display device can be suppressed.

Note that the display device of the invention can freely adopt a gate signal line driver circuit having a known configuration, as well as the gate signal line driver circuit having the configuration of this embodiment.

Further, depending on the configuration of the gate signal line driver circuit, the number of signal lines to be inputted to the gate signal line driver circuit from the display controller and the number of power supply lines of a driving voltage are changed.

This embodiment can be implemented freely combining with Embodiments 1 to 3.

Embodiment 5

As for the display device using a time gray scale method, in addition to a method in which a writing period and a display period are separated which is described hereinabove, a driving method of simultaneously performing writing and display has been proposed. It has been specifically disclosed in Japanese Patent Laid-Open No. 2001-343933. According to this method, in addition to the conventional selecting TFT and driving TFT, an erasing TFT is provided so that the number of gray scales can be increased.

Specifically, a plurality of gate signal line drive circuits are provided, writing is performed by a first gate signal line drive circuit, and erasing is performed by a second gate signal line drive circuit before wiring is completed for all lines. In the case of about 4 bits, this does not affect so much, however, in the case where the number of gray scales is 6 bits or more or in the case where it is necessary to increase the number of subframes for a measure against pseudo contour, this is a very effective measure. The invention can also be applied to a display device using such a driving method.

Figure 18:
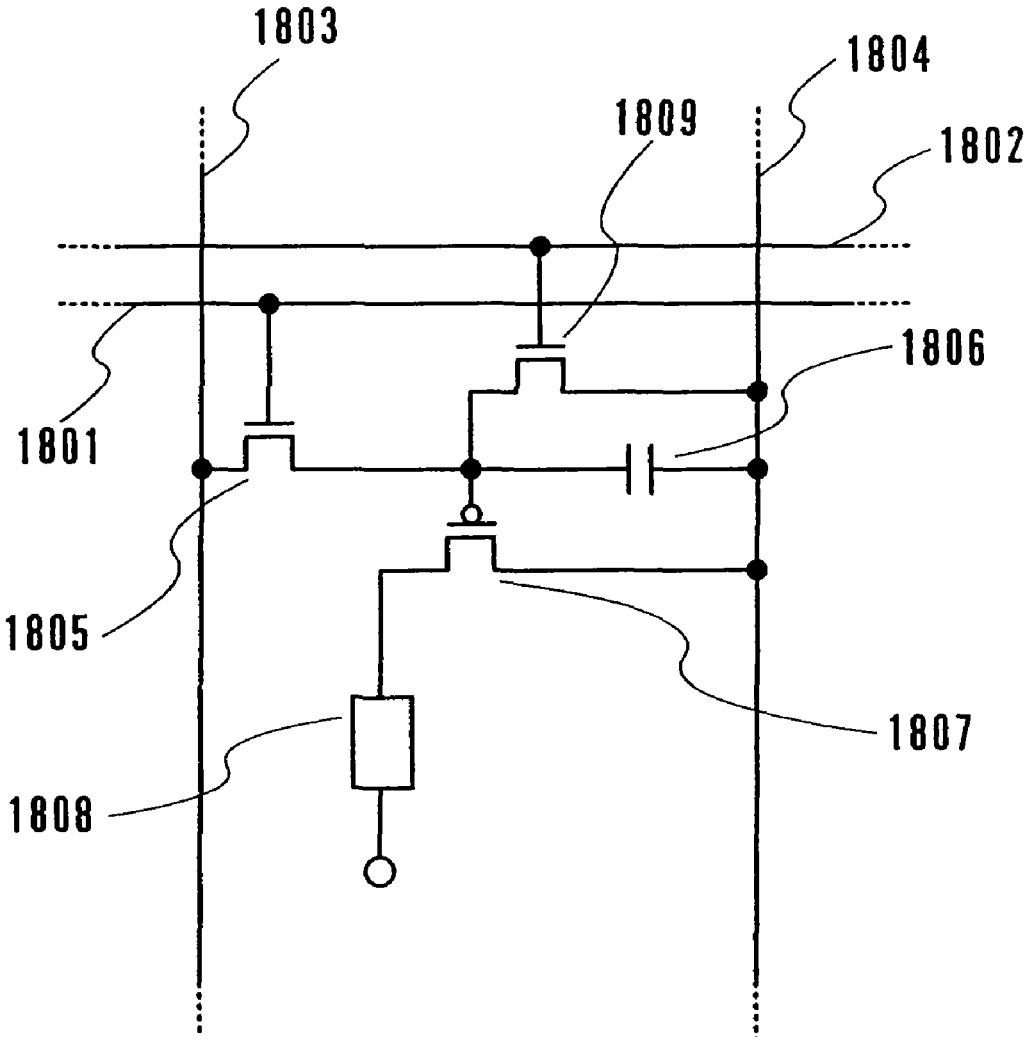
FIG. 18 is a diagram showing a configuration of a pixel of a display device of the invention.
Figure 19:
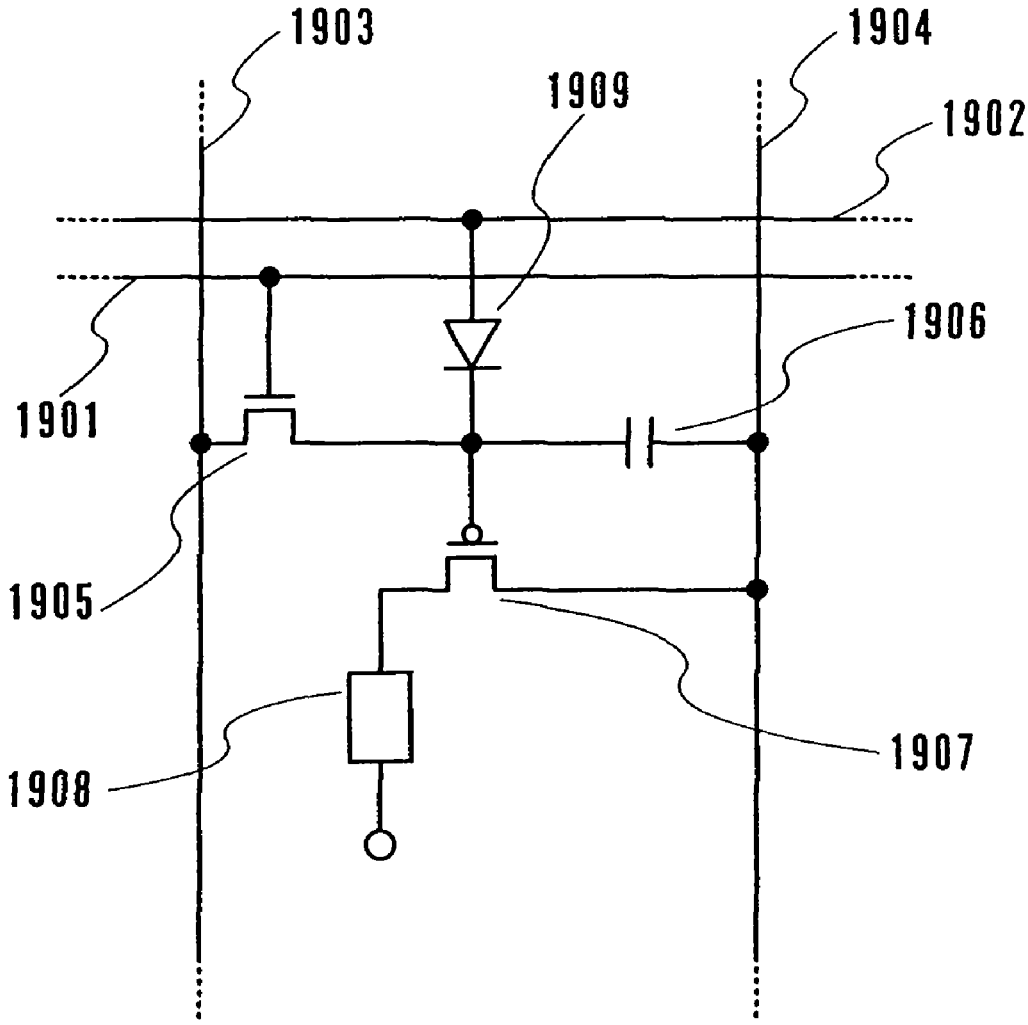
FIG. 19 is a diagram showing a configuration of a pixel of a display device of the invention.
Figure 20:
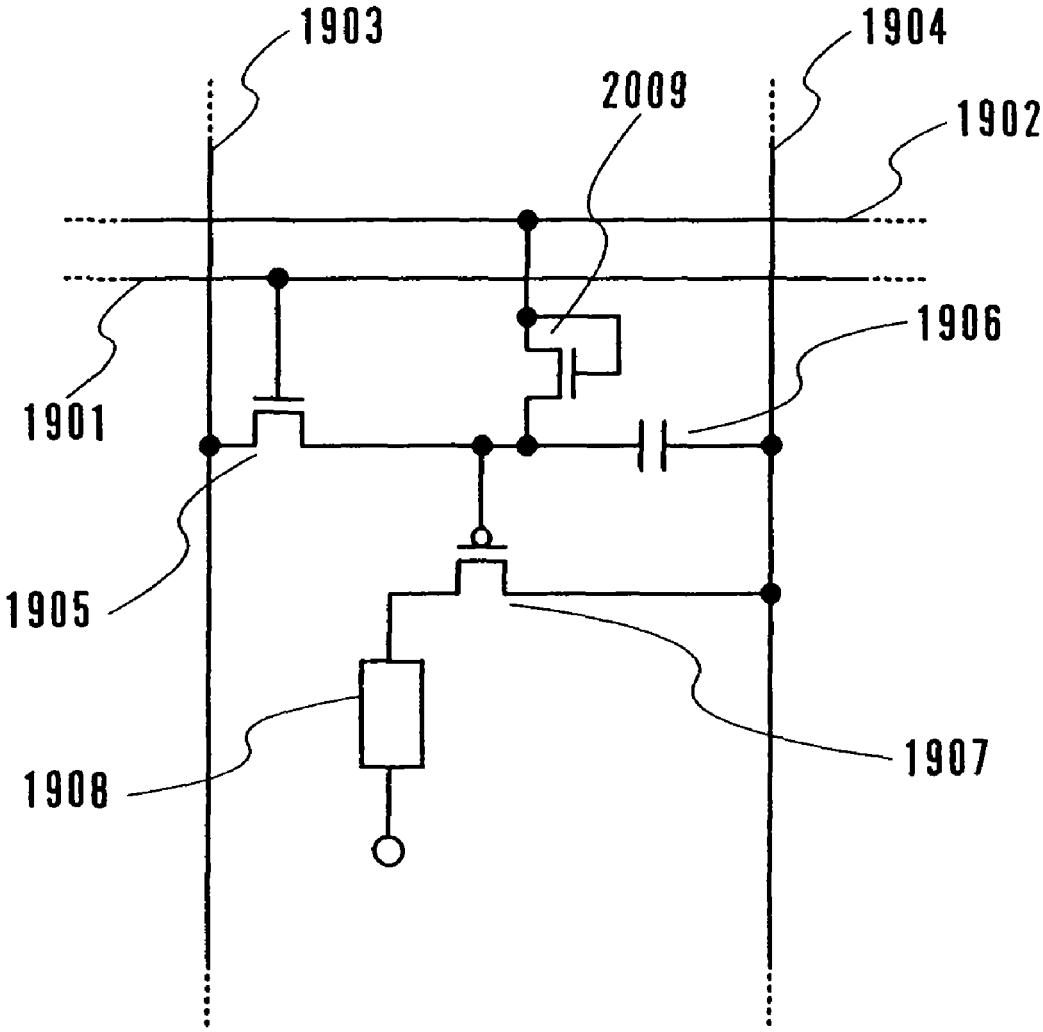
FIG. 20 is a diagram showing a configuration of a pixel of a display device of the invention.

Examples of a pixel configuration for realizing this driving method are shown in FIG. 18, FIG. 19, and FIG. 20.

FIG. 18 shows an example in which an erasing TFT is provided. The pixel shown in FIG. 18 is constituted by a first gate signal line 1801, a second gate signal line 1802, a source signal line 1803, a power supply line 1804, a selecting TFT 1805, a storage capacitor 1806, a driving TFT 1807, a light-emitting element 1808, and an erasing TFT 1809.

A gate electrode of the selecting TFT 1805 is connected to the first gate signal line 1801, a first electrode thereof is connected to the source signal line 1803, and a second electrode thereof is connected to a second electrode of the storage capacitor 1806, a second electrode of the erasing TFT 1809, and a gate electrode of the driving TFT 1807. A first electrode of the driving TFT 1807 is connected to the power supply line 1804, and a second electrode thereof is connected to an anode of the light-emitting element 1808. A gate electrode of the erasing TFT 1809 is connected to the second gate signal line 1802, and a first electrode thereof is connected to the power supply line 1804.

Next, an operation of the pixel configuration shown in FIG. 18 is described. When writing a signal, a potential of the first gate signal line 1801 is made higher than the highest potential of the source signal line 1803 or a potential of the power supply line 1804, thereby the first gate signal line 1801 is selected, the selecting TFT 1805 is turned on, and a signal is inputted from the source signal line 1803 to the storage capacitor 1806. As a result of this, in accordance with the signal stored in the storage capacitor 1806, a current of the driving TFT 1807 is controlled and from the power supply line 1804, a current flows to the light-emitting element 1808. Consequently, the light-emitting element 1808 emits light.

When erasing a signal, a potential of the second gate signal line 1802 is made higher than the highest potential of the source signal line 1803 or the potential of the power supply line 1804, thereby the second gate signal line 1802 is selected, the erasing TFT 1809 is turned on, and the driving TFT 1807 is turned off. As a result of this, a current is prevented from flowing from the power supply line 1804 to the light-emitting element 1808. Consequently, a non-lighting period can be formed so that the length of a lighting period can freely be controlled.

Although the erasing TFT 1809 is used in FIG. 18, another method can also be used. This is because a non-lighting period may forcibly be formed by preventing a current from being supplied to the light-emitting element 1808. Therefore, a non-lighting period may be formed by arranging a switch somewhere in a path where a current flows from the power supply line 1804 to the light-emitting element 1808 and controlling on/off of the switch. Alternatively, a gate-source voltage of the driving TFT 1807 may be controlled to forcibly turn the driving TFT 1807 off.

FIG. 19 shows an example in the case where the driving TFT 1807 is forcibly turned off. A pixel shown in FIG. 19 is constituted by a first gate signal line 1901, a second gate signal line 1902, a source signal line 1903, a power supply line 1904, a selecting TFT 1905, a storage capacitor 1906, a driving TFT 1907, a light-emitting element 1908, and an erasing diode 1909.

Agate of the selecting TFT 1905 is connected to the first gate signal line 1901, a first electrode thereof is connected to the source signal line 1903, and a second electrode thereof is connected to a second electrode of the storage capacitor 1906, a second electrode of the erasing diode 1909, and a gate electrode of the driving TFT 1907. A first electrode of the driving TFT 1907 is connected to the power supply line 1904, and a second electrode thereof is connected to an anode of the light-emitting element 1908. A first electrode of the erasing diode 1909 is connected to the second gate signal line 1902.

Note that the storage capacitor 1906 has a function to store a gate potential of the driving TFT 1907. Therefore, it is connected between the gate electrode of the driving TFT 1907 and the power supply line 1904, however, the invention is not limited to this as long as it is arranged so as to store the gate potential of the driving TFT 1907. Further, if the gate potential of the driving TFT 1907 can be stored by using gate capacitance of the driving TFT 1907 or the like, the storage capacitor 1906 may be omitted.

Next, an operation of the pixel configuration shown in FIG. 19 is described. When writing a signal, a potential of the first gate signal line 1901 is made higher than the highest potential of the source signal line 1903 or a potential of the power supply line 1904, thereby the first gate signal line 1901 is selected, the selecting TFT 1905 is turned on, and a signal is inputted from the source signal line 1903 to the storage capacitor 1906. As a result of this, in accordance with the signal stored in the storage capacitor 1906, a current of the driving TFT 1907 is controlled and from the power supply line 1904, a current flows to the light-emitting element 1908. Consequently, the light-emitting element 1908 emits light.

When erasing a signal, a potential of the second gate signal line 1902 is made higher than the highest potential of the source signal line 1903 or the potential of the power supply line 1904, thereby the second gate signal line 1902 is selected, the erasing diode 1909 is turned on, and a current is made to flow from the second gate signal line 1902 to the gate electrode of the driving TFT 1907. As a result of this, the driving TFT 1907 is turned off. Consequently, a current is prevented from flowing from the power supply line 1904 to the light-emitting element 1908. As a result of this, a non-lighting period can be formed so that the length of a lighting period can freely be controlled.

When storing a signal, the potential of the second gate signal line 1902 is made lower than the highest potential of the source signal line 1903 or the potential of the power supply line 1904, thereby the second gate signal line 1902 is not selected. Accordingly, the erasing diode 1909 is turned off so that the gate potential of the driving transistor 1907 is stored.

Note that the erasing diode 1909 may be any element as long as it has a is rectifying property. It may be a PN diode, a PIN diode, a Schottky diode, or a zener diode.

Further, the erasing diode may be a diode-connected transistor (a gate and a drain thereof are connected). FIG. 20 is a circuit diagram in that case. As the erasing diode 1909, a diode-connected transistor 2009 is used. Although an N-channel transistor is used here, the invention is not limited to this. A P-channel transistor may also be used.

Figure 17A:
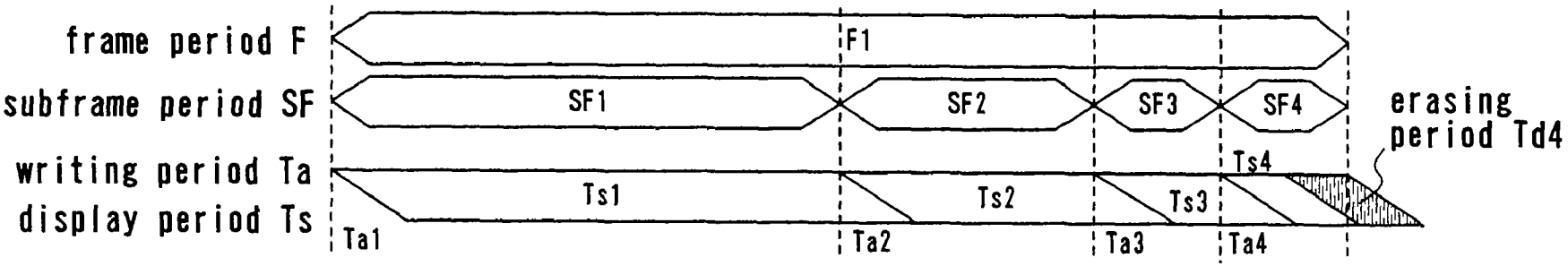
FIGS. 17A and 17B are diagrams of timing charts showing a driving method of a display device of the invention.

FIG. 17A shows a timing chart when display is performed in the first display mode. In FIG. 17A, erasing is performed by the second gate signal line driver circuit at the fourth bit to shorten a lighting period.

Figure 17B:
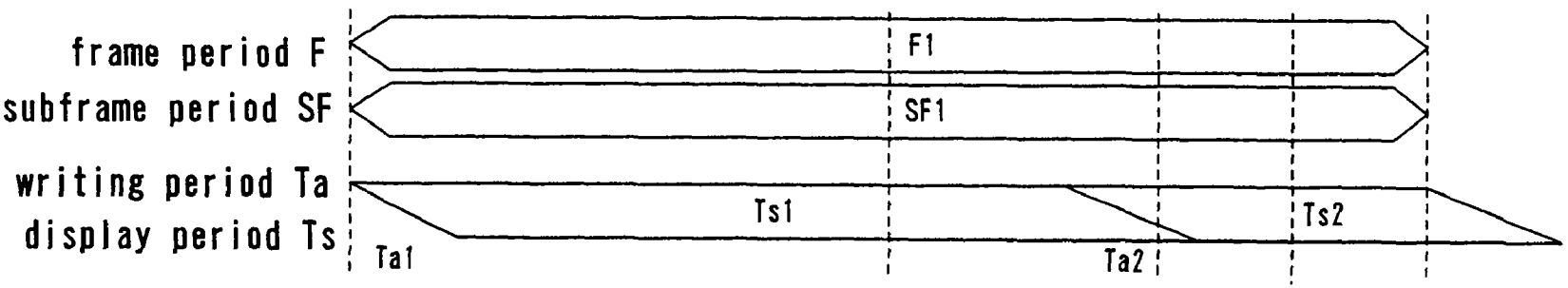

FIG. 17B shows a timing chart when display is performed in the second display mode. In the second display mode shown in FIG. 17B, it is not necessary to perform erasing by the second gate signal line driver circuit, therefore, it is not necessary to input the start pulse G_SP and the clock pulse G_CLK to the second gate signal line driver circuit.

This embodiment can be freely combined with Embodiments 1 to 4.

Embodiment 6

Figure 21A:
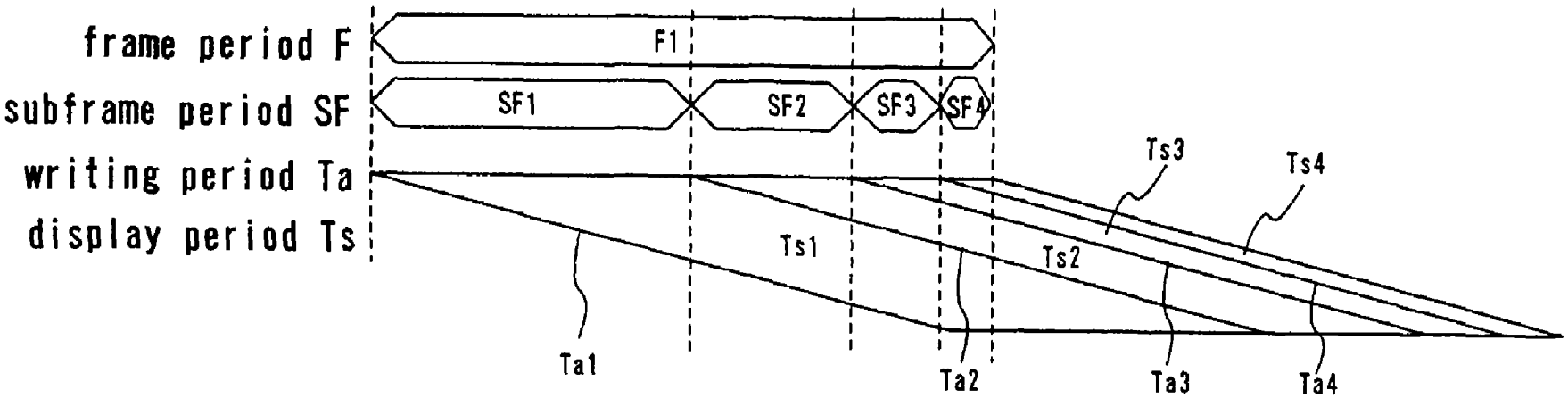
FIGS. 21A and 21B are diagrams of timing charts showing a driving method of a display device of the invention.
Figure 21B:
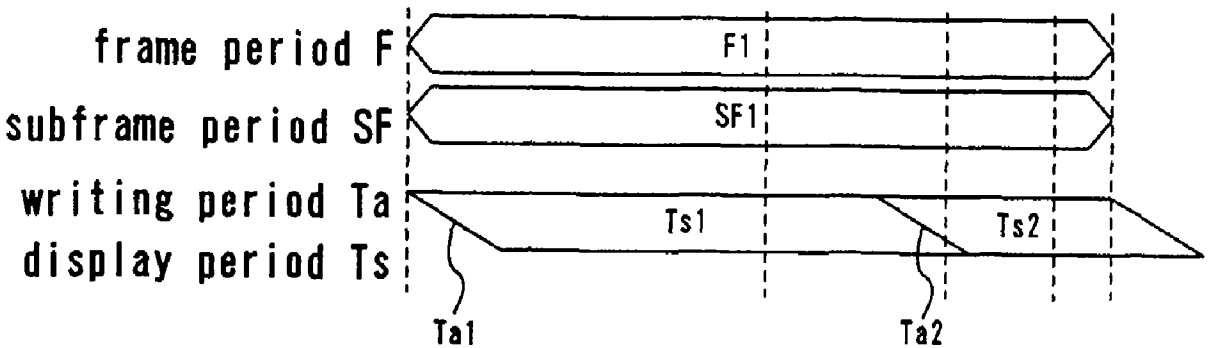
Figure 38:
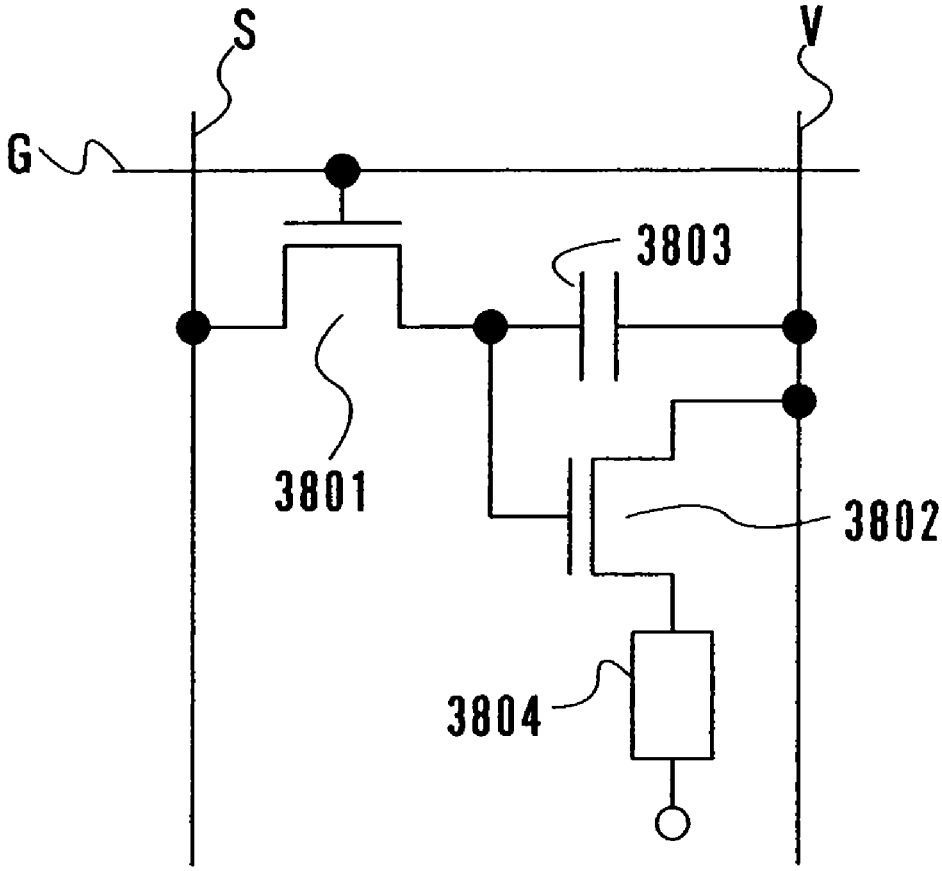
FIG. 38 is a diagram showing a configuration of a pixel of a conventional display device.
Figure 39A:
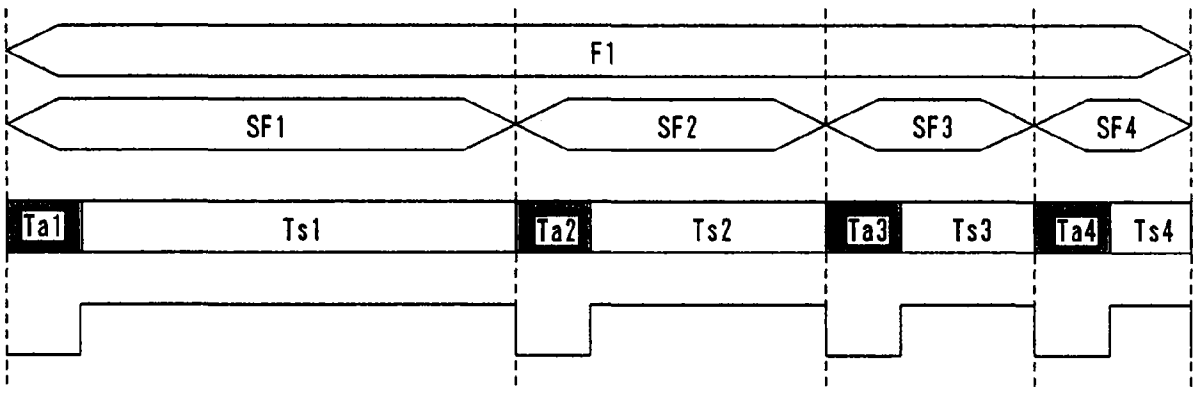
FIGS. 39A and 39B are diagrams of timing charts showing a driving method of a conventional time gray scale method.
Figure 39B:
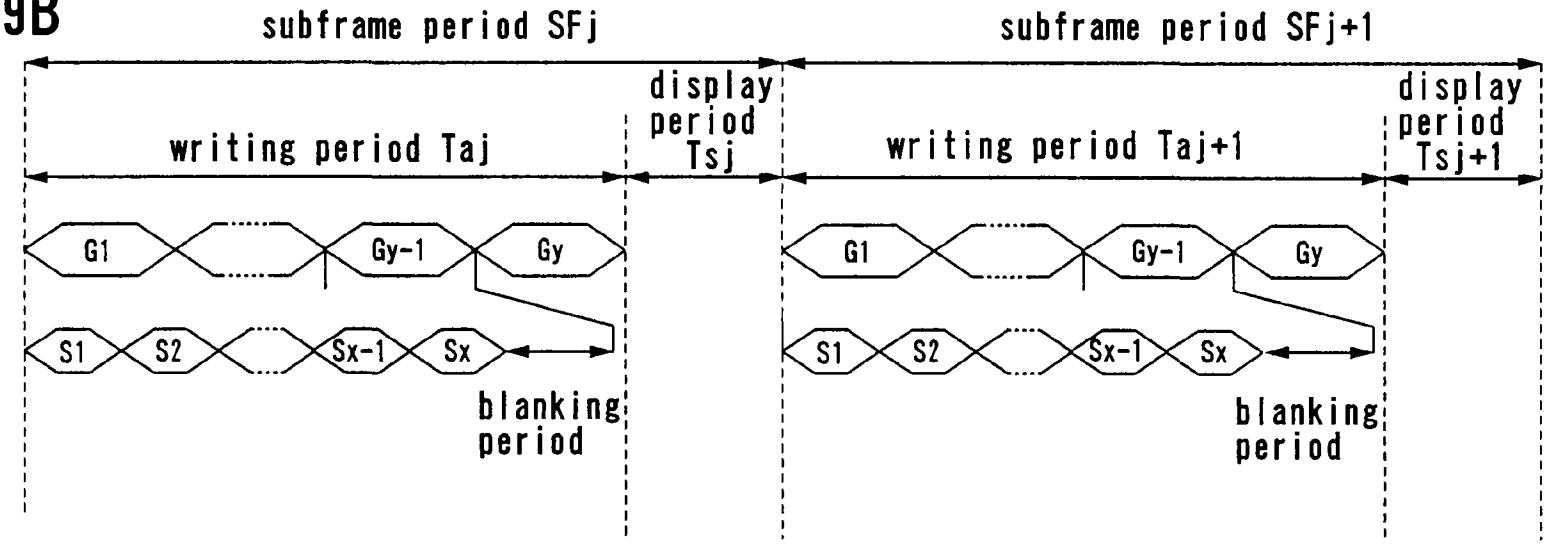
Figure 40A:
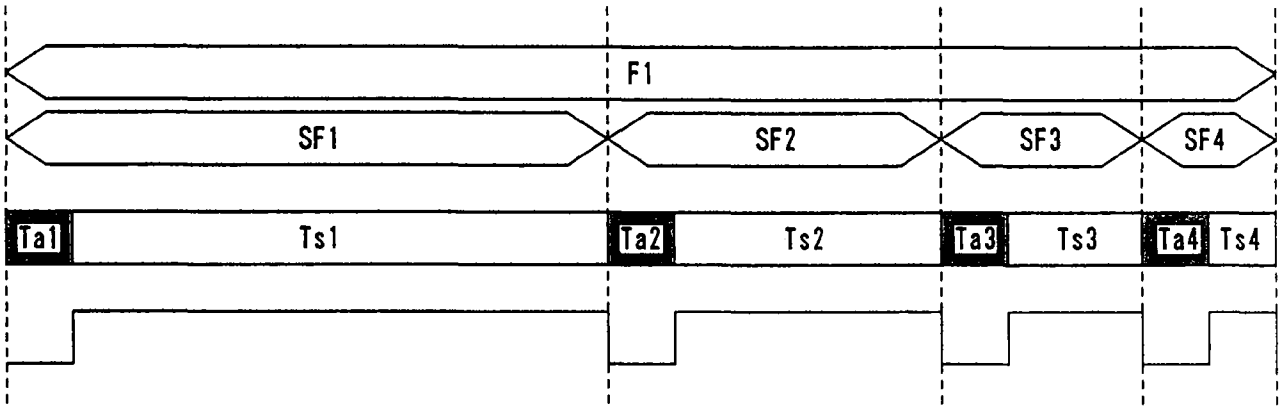
FIGS. 40A and 40B are diagrams of timing charts showing a driving method of a conventional display device.
Figure 40B:
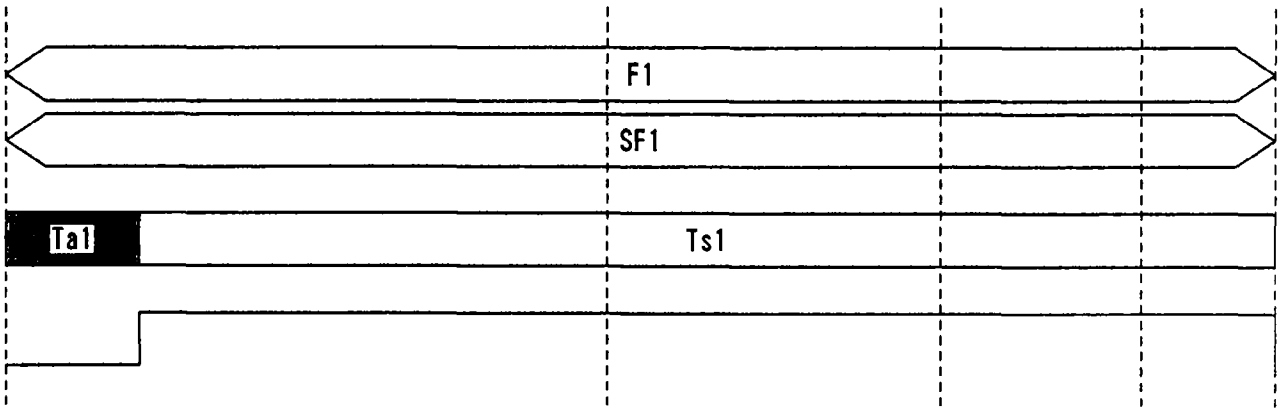

Further, another method of simultaneously performing writing and display similarly to Embodiment 5 has also been proposed. A timing chart in the first display mode and a timing chart in the second display mode in this case are shown in FIGS. 21A and 21B respectively. A pixel configuration in this case is the same as the conventional one shown in FIG. 38. According to the driving method shown in FIGS. 21A and 21B, a plurality of rows are selected at the same time during one gate selection period in the first display mode, and only one row is selected during one gate selection period in the second display mode.

Figure 22:
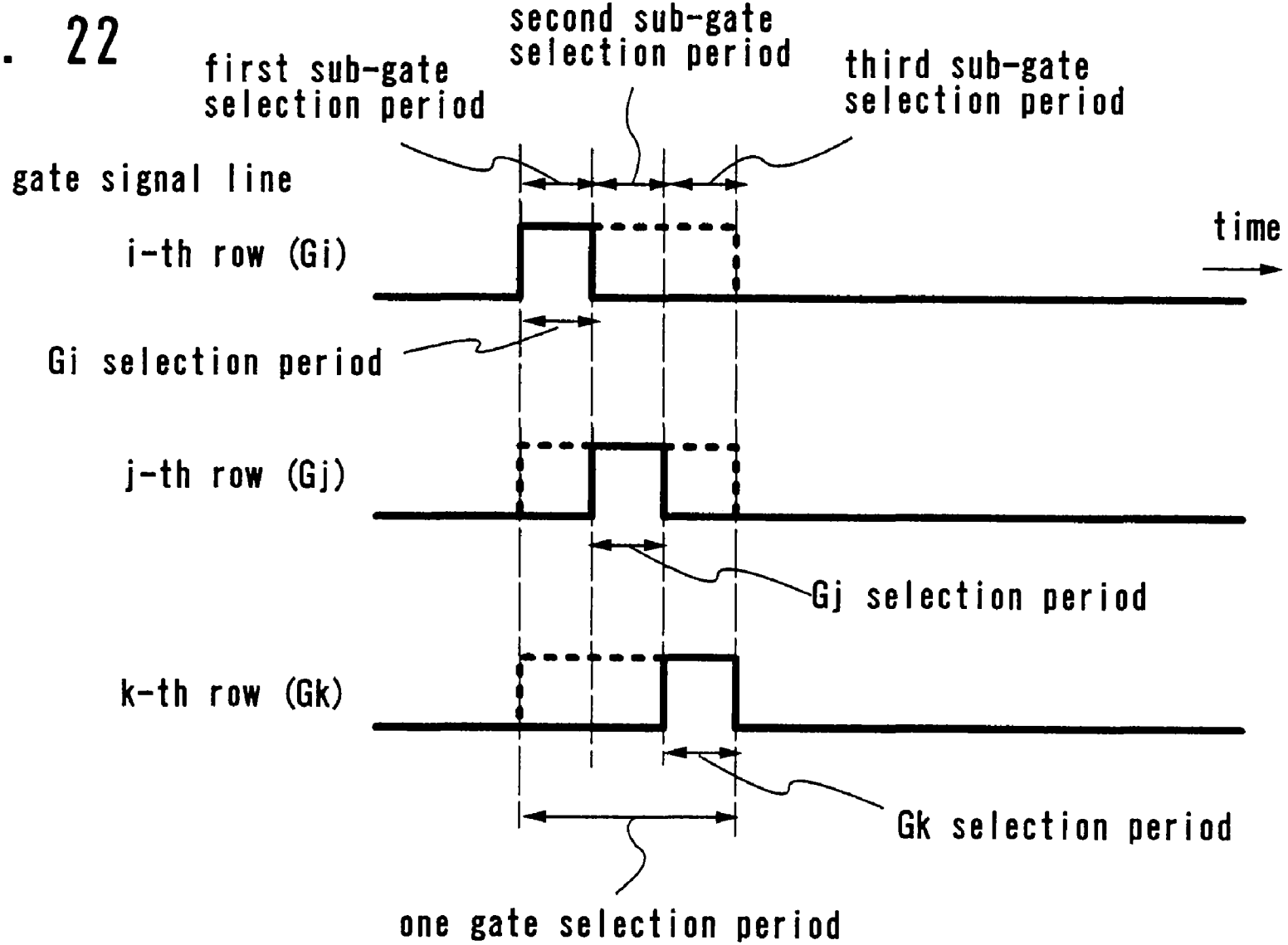
FIG. 22 is a diagram of a timing chart showing a driving method of a display device of the invention.

The driving method in the first display mode is specifically described below. As shown in FIG. 22, one gate selection period is divided into a plurality of sub-gate selection periods (it is divided into three in the case of FIG. 22). Then, in each sub-gate selection period, a potential of each gate signal line is made high, thereby each gate signal line is selected and a corresponding signal is inputted to a source signal line. For example, in one gate selection period, the i-th row is selected in the first sub-gate selection period, the j-th row is selected in the second sub-gate selection period, and the k-th row is selected in the third sub-gate selection period. Then, in the next one gate selection period, the (i+1)-th row is selected in the first sub-gate selection period, the (j+1)-th row is selected in the second sub-gate selection period, and the (k+1)-th row is selected in the third sub-gate selection period. According to this, such operation that three rows seem to be selected at the same time in one gate selection period can be realized.

Figure 23:
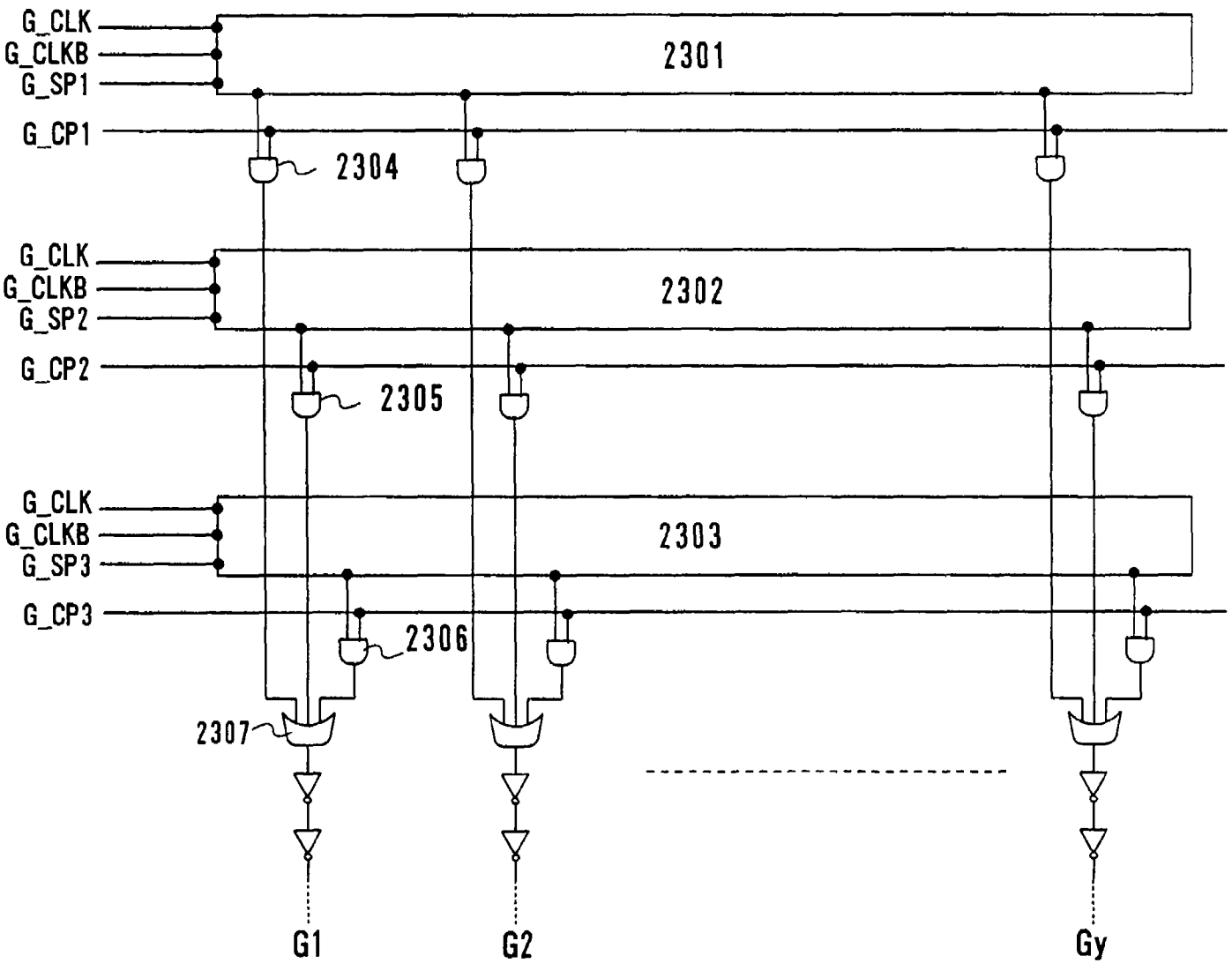
FIG. 23 is a diagram showing constitution of a gate signal line driver circuit of a display device of the invention.

A constitution example of the gate signal line driver circuit when implementing the driving method of this embodiment is shown in FIG. 23. For example, in the case where one gate selection period is divided into three sub-gate selection methods, a first shift register 2301, a second shift register 2302, and a third shift register 2303 are prepared. Note that as for the shift register, for example, the shift register 1601 shown in the gate signal line driver circuit (FIG. 16) described in Embodiment 5 may be used. The shift registers 2301, 2302, and 2303 are operated by start pulses G_SP1, G_SP2, and G_SP3 respectively and outputs sampling pulses respectively. Next, the respective sampling pulses and signals for dividing one gate selection period G_CP1, G_CP2, and G_CP3 are inputted to AND circuits 2304, 2305, and 2306 respectively so that a logical AND operation is performed. Finally, respective outputs of the AND circuits 2304, 2305, and 2306 are inputted to an OR circuit 2307 so that logical OR operation is performed. Then, only in a period during which an output signal of the OR circuit 2307 is Hi, the gate signal line is selected.

Figure 24:
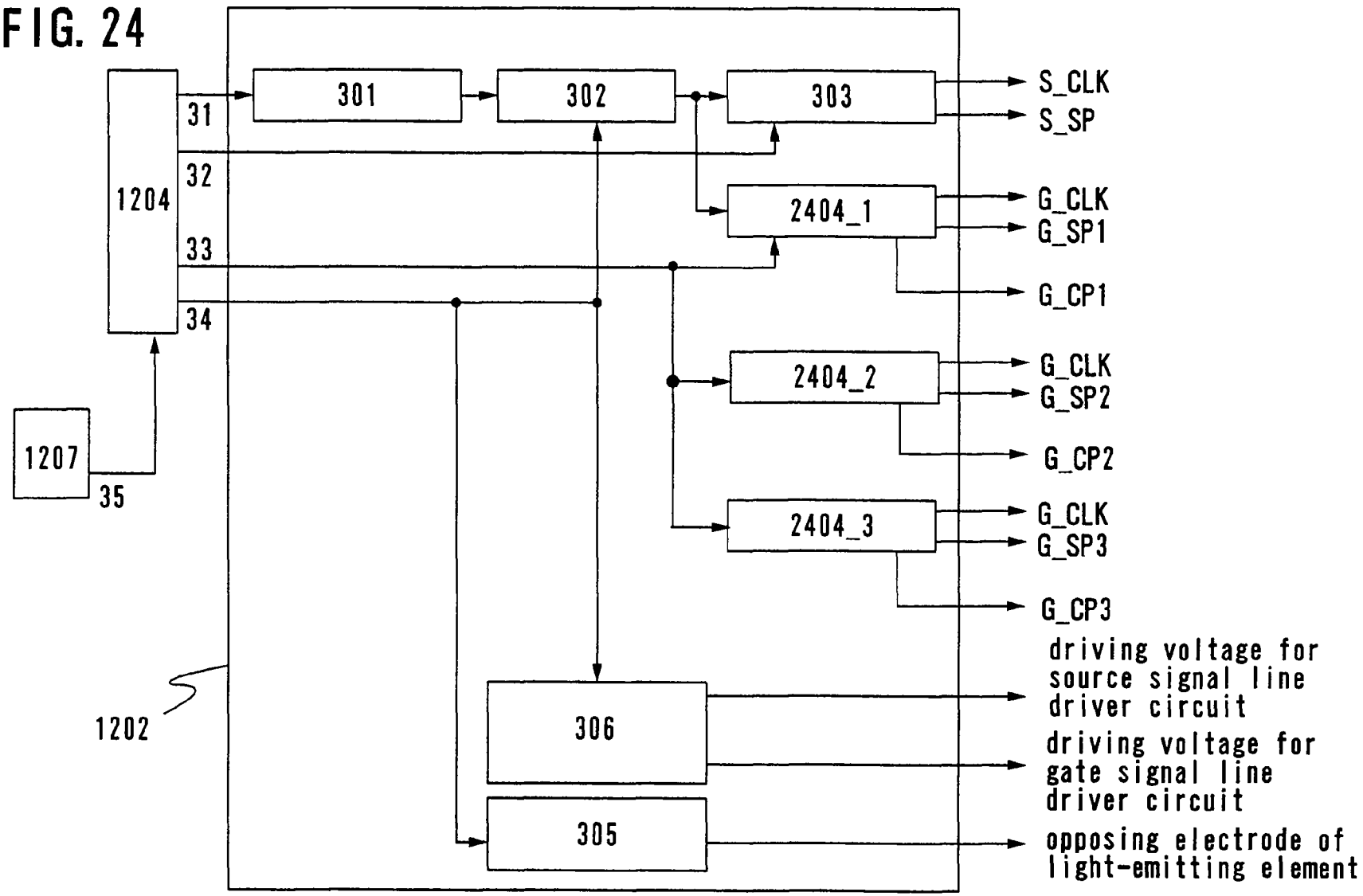
FIG. 24 is a diagram showing constitution of a display controller of a display device of the invention.

The start pulses G_SP1, G_SP2, and G_SP3 and the signals for dividing one gate selection period G_CP1, G_CP2, and G_CP3 are sent from the display controller. A constitution example of the display controller in this embodiment is shown in FIG. 24. In the example shown in FIG. 24, vertical clock generating circuits 2404_1, 2404_2, and 2404_3 for producing the respective start pulses and the respective signals for dividing one gate selection period for the respective shift registers are provided. According to this, the respective shift registers can be operated independently.

Figure 25:
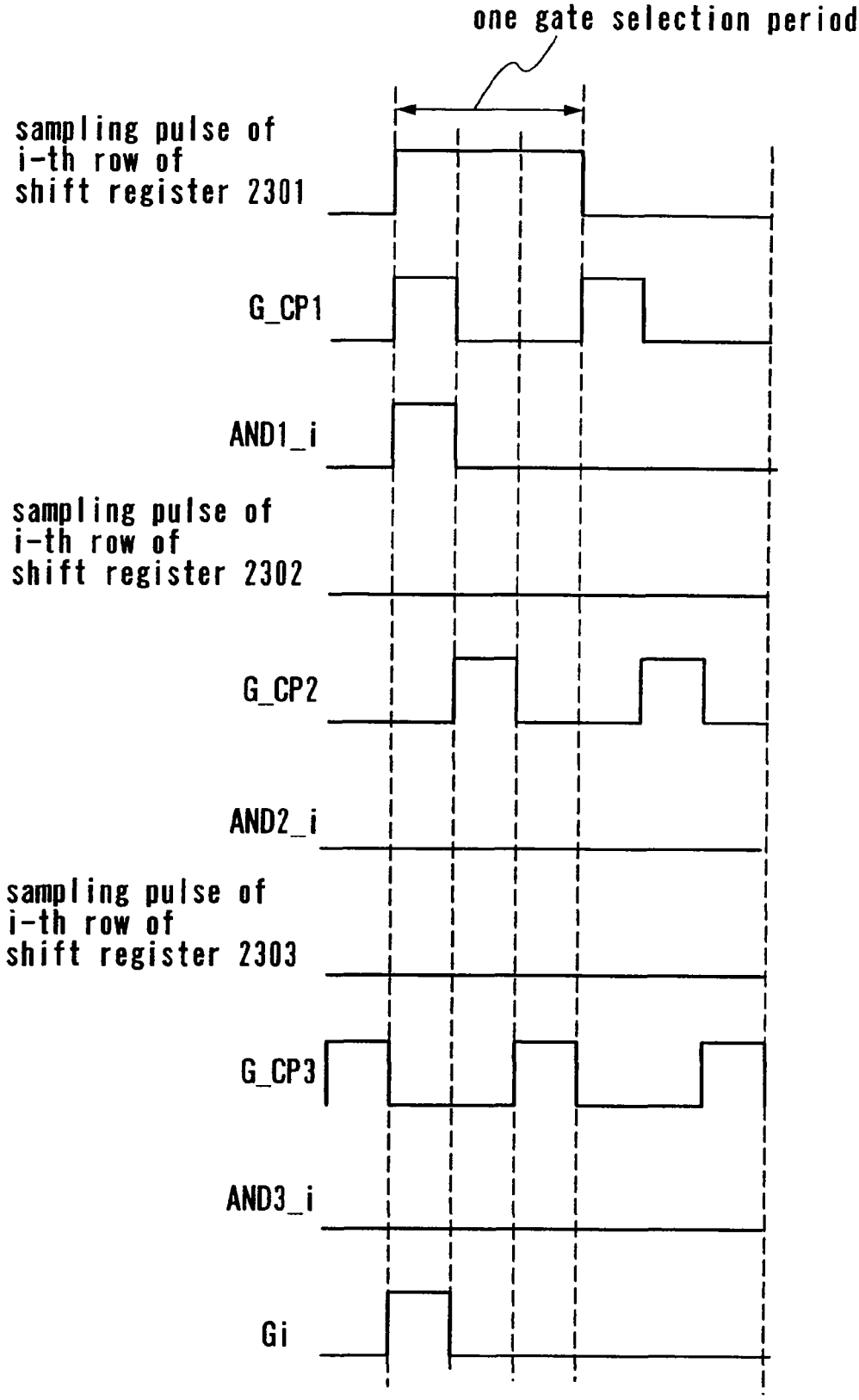
FIG. 25 is a diagram of a timing chart showing a driving method of a display device of the invention.
Figure 26:
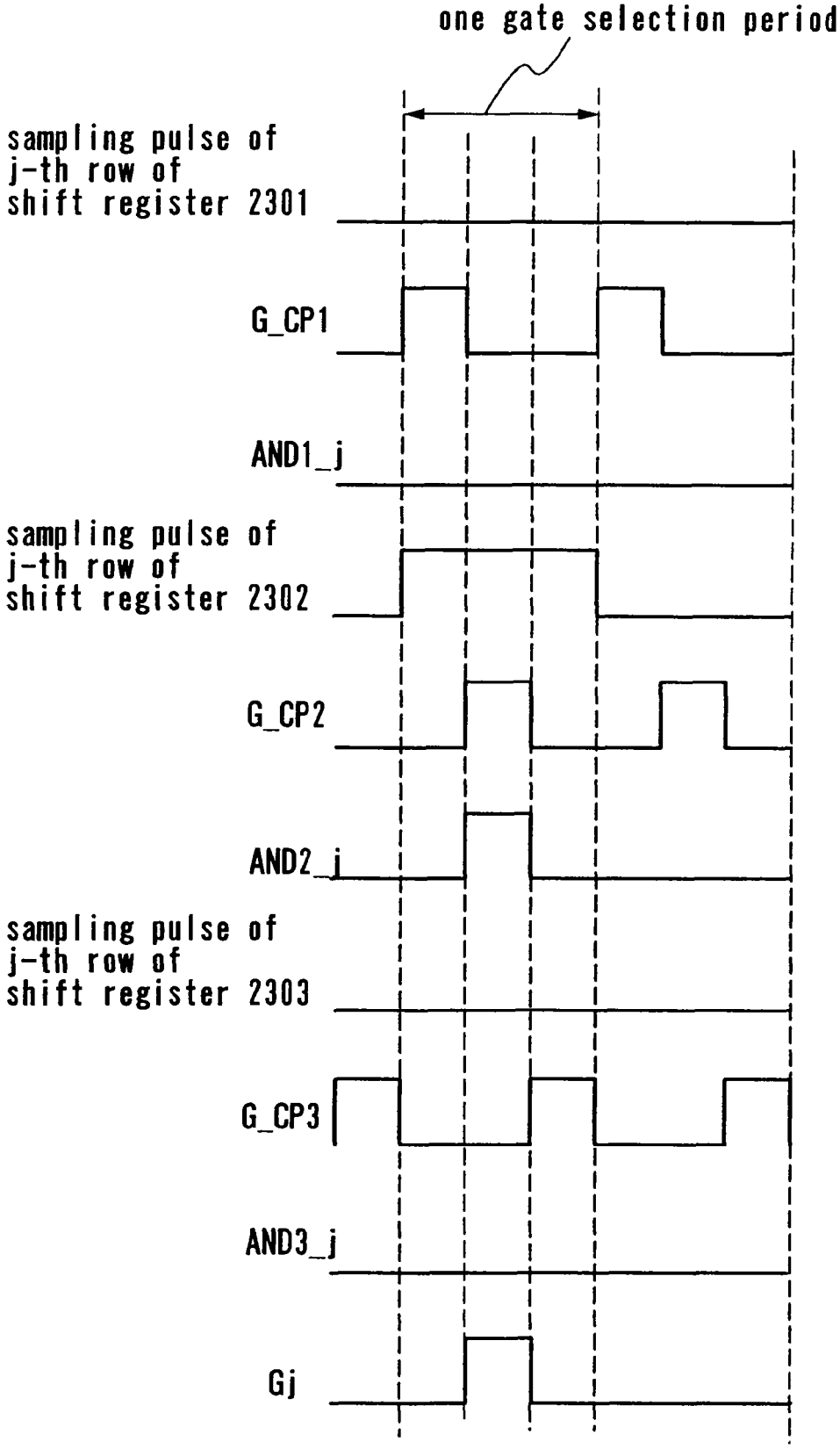
FIG. 26 is a diagram of a timing chart showing a driving method of a display device of the invention.
Figure 27:
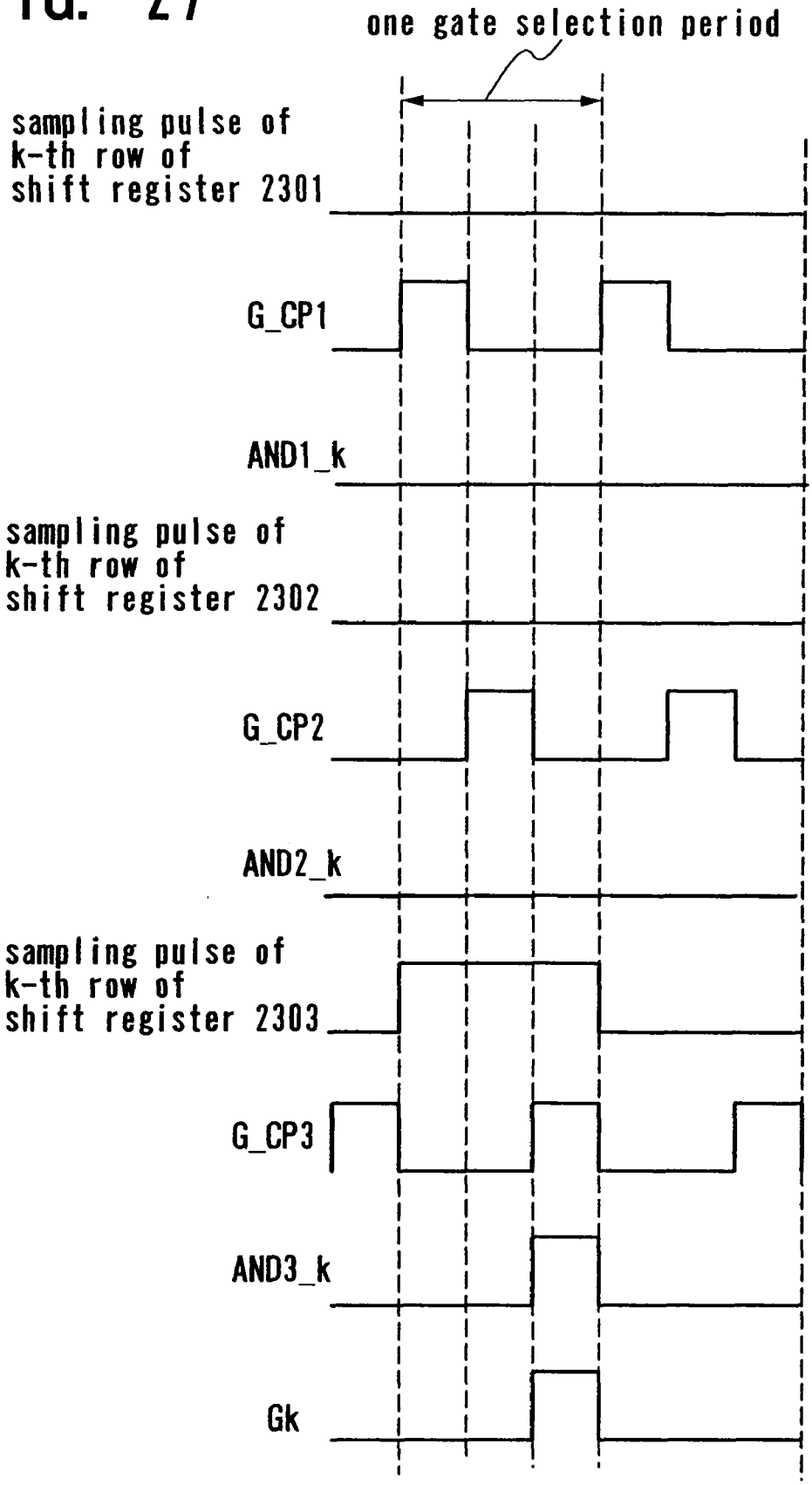
FIG. 27 is a diagram of a timing chart showing a driving method of a display device of the invention.

Next, timing charts of the gate signal line driver circuit are shown in FIG. 25, FIG. 26, and FIG. 27. FIG. 25 shows a case of selecting the gate line of the i-th row by using the shift register 2301.

Note here that the signal for dividing one gate selection period is a signal of which one cycle is one gate selection period, and the signal for dividing one gate selection period G_CP1 is a Hi signal only in the first ⅓ period of one gate selection period and is a Lo signal in the rest ⅔ period of the one gate selection period. Similarly, the signal for dividing one gate selection period G_CP2 is a Hi signal only in the middle ⅓ period of one gate selection period and is a Lo signal in the rest ⅔ period of the one gate selection period. The signal for dividing one gate selection period G_CP3 is a Hi signal only in the last ⅓ period of one gate selection period and is a Lo signal in the rest ⅔ period of the one gate selection period For example, considered is a case where only a sampling pulse of the i-th row of the shift register 2301 is a Hi signal. Here, respective output signals of the AND circuits with respect to sampling pulses of the i-th rows of the shift registers and the signals for dividing one gate selection period are denoted by AND1_i, AND2_i, and AND3_i. Since only the sampling pulse of the i-th row of the shift register 2301 is a Hi signal, when performing a logical AND operation with the signal for dividing one gate selection period G_CP1, a signal which is Hi only in the first ⅓ period of one gate selection period can be obtained. In addition, since the respective sampling pulses of the i-th rows of the shift register 2302 and 2303 are Lo signals, when performing logical AND operations with the respective signals for dividing one gate selection period, signals which are Lo during one gate selection period can be obtained. Finally, a logical OR operation of AND1_i, AND2_i, and AND3_i is performed, so that a signal which is Hi only in the first ⅓ period of one gate selection period can be obtained. Therefore, the gate signal line of the j-th row is selected only in the first ⅓ period of one gate selection period.

FIG. 26 shows a case of selecting the gate line of the j-th row by using the shift register 2302. For example, considered is a case where only a sampling pulse of the j-th row of the shift register 2302 is a Hi signal. Here, respective output signals of the AND circuits with respect to sampling pulses of the j-th rows of the shift registers and the signals for dividing one gate selection period are denoted by AND1_j, AND2_j, and AND3_j. Since only the sampling pulse of the j-th row of the shift register 2302 is a Hi signal, when performing a logical AND operation with the signal for dividing one gate selection period G_CP2, a signal which is Hi only in the middle ⅓ period of one gate selection period can be obtained. In addition, since the respective sampling pulses is of the j-th rows of the shift register 2301 and 2303 are Lo signals, when performing logical AND operations with the respective signals for dividing one gate selection period, signals which are Lo during one gate selection period can be obtained. Finally, a logical OR operation of AND1_j, AND2_j, and AND3_j is performed, so that a signal which is Hi only in the middle ⅓ period of one gate selection period can be obtained. Therefore, the gate signal line of the j-th row is selected only in the middle ⅓ period of one gate selection period.

FIG. 27 shows a case of selecting the gate line of the k-th row by using the shift register 2303. For example, considered is a case where only a sampling pulse of the k-th row of the shift register 2303 is a Hi signal. Here, respective output signals of the AND circuits with respect to sampling pulses of the k-th rows of the shift registers and the signals for dividing one gate selection period are denoted by AND1_k, AND2_k, and AND3_k. Since only the sampling pulse of the k-th row of the shift register 2303 is a Hi signal, when performing a logical AND operation with the signal for dividing one gate selection period G_CP3, a signal which is Hi only in the last ⅓ period of one gate selection period can be obtained. In addition, since the respective sampling pulses of the k-th rows of the shift register 2301 and 2302 are Lo signals, when performing logical AND operations with the respective signals for dividing one gate selection period, signals which are Lo during one gate selection period can be obtained. Finally, a logical OR operation of AND1_k, AND2_k, and AND3_k is performed, so that a signal which is Hi only in the last ⅓ period of one gate selection period can be obtained. Therefore, the gate signal line of the k-th row is selected only in the last ⅓ period of one gate selection period.

Figure 30:
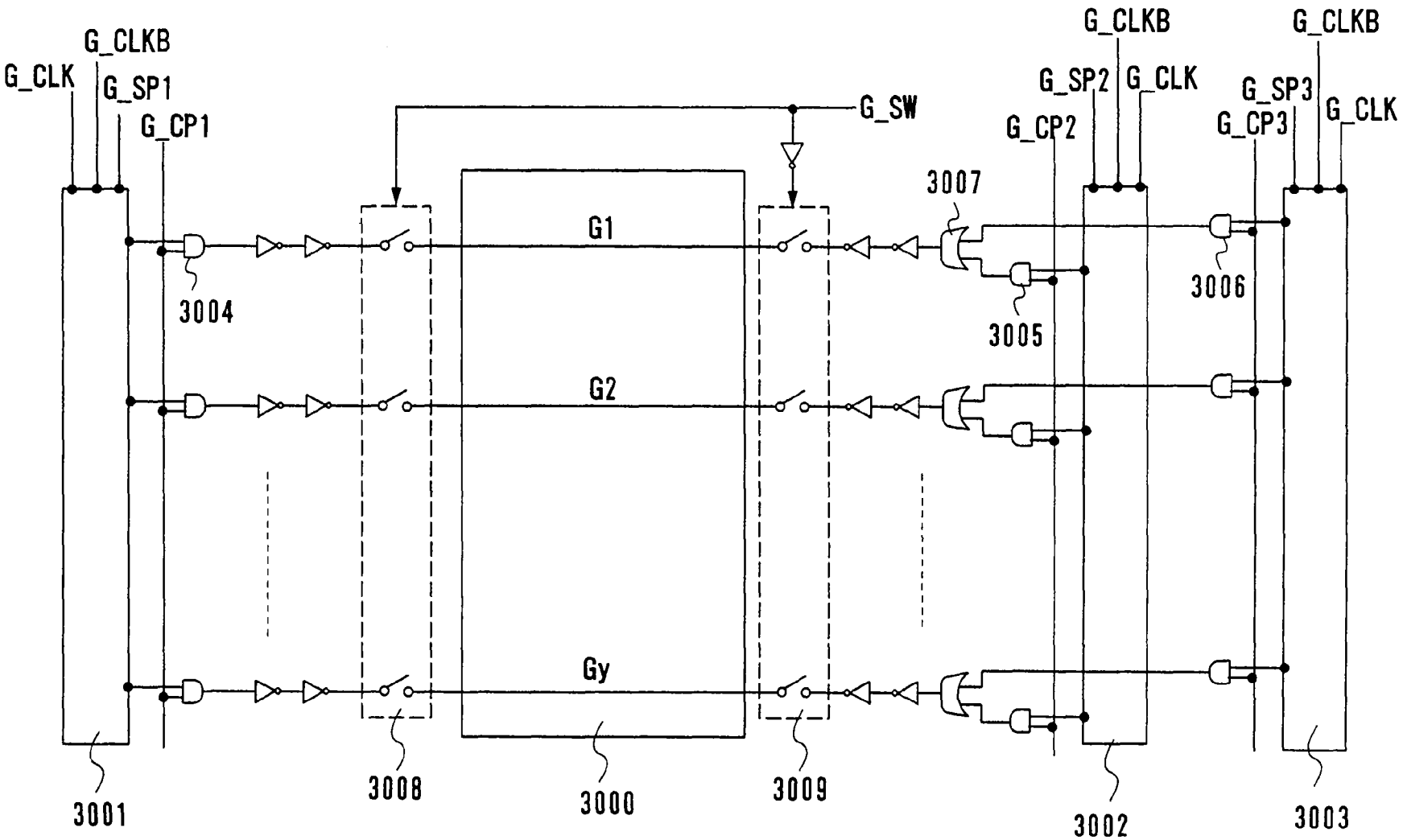
FIG. 30 is a diagram showing constitution of a gate signal line driver circuit of a display device of the invention.

Further, another constitution example of the gate signal line driver circuit is shown in FIG. 30. For example, in the case where one gate selection period is divided into three sub-gate selection methods, a first shift register 3001, a second shift register 3002, and a third shift register 3003 are prepared, and the shift register 3001, and the shift register 3002 and the shift register 3003 are disposed on both sides of a pixel portion 3000 respectively. The shift register 3001 inputs a sampling pulse which is an output of the shift register 3001 and the signal for dividing one gate selection period G_CP1, to an AND circuit 3004. Then, only in a period during which an output signal of the AND circuit 3004 is Hi, the gate signal line is selected. Meanwhile, the shift registers 3002 and 3003 input respective sampling pulses which are outputted from the respective shift registers and the respective signal for dividing one gate selection period G_CP2 and signal for dividing one gate selection period G_CP3, to an AND circuit 3005 and an AND circuit 3006 respectively, and outputs thereof are inputted to an OR circuit 3007. Then, only in a period during which an output signal of the OR circuit 3007 is Hi, the gate signal line is selected. Note that a switches 3008 and 3009 are connected between an output line of the AND circuit 3004 and the gate signal line and between an output line of the OR circuit 3007 and the gate signal line, respectively. These switches are controlled by a switch controlling signal G_SW sent from the display controller, and turns on the switches connected to the gate signal line where the respective output signals of the AND circuit 3004 and the OR circuit 3007 are Hi, thereby the gate signal line is selected.

Note that a pair of the switches 3008 and 3009 which are connected to both sides of each gate signal line respectively are controlled so as to operate exclusively. For example, when the gate signal line of the i-th row is selected by using the shift register 3001, the switch 3008 is turned on and the switch 3009 is turned off among the switches connected to the gate signal line of the i-th row. As a result of this, only an output of the shift register 3001 is inputted to the gate signal line of the i-th row. When the gate signal line of the j-th row is selected by using the shift register 3002, the switch 3009 is turned on and the switch 3008 is turned off among the switches connected to the gate signal line of the j-th row. As a result of this, only an output of the shift register 3002 is inputted to the gate signal line of the j-th row.

As described above, by using the gate signal line driver circuit of this embodiment, gate signal lines of three rows can be selected during one gate selection period.

Figure 28:
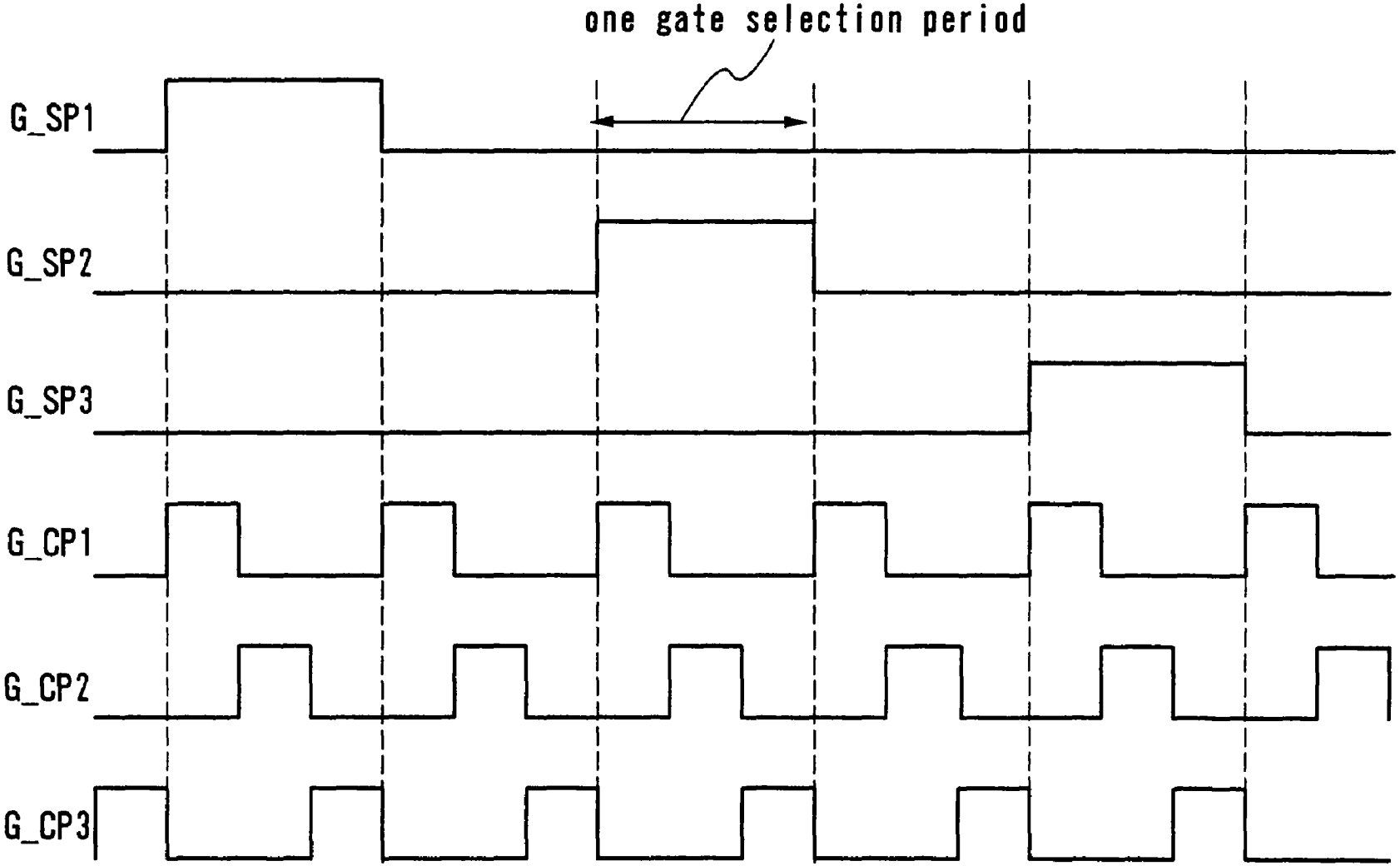
FIG. 28 is a diagram of a timing chart showing a driving method of a display device of the invention.
Figure 29A:
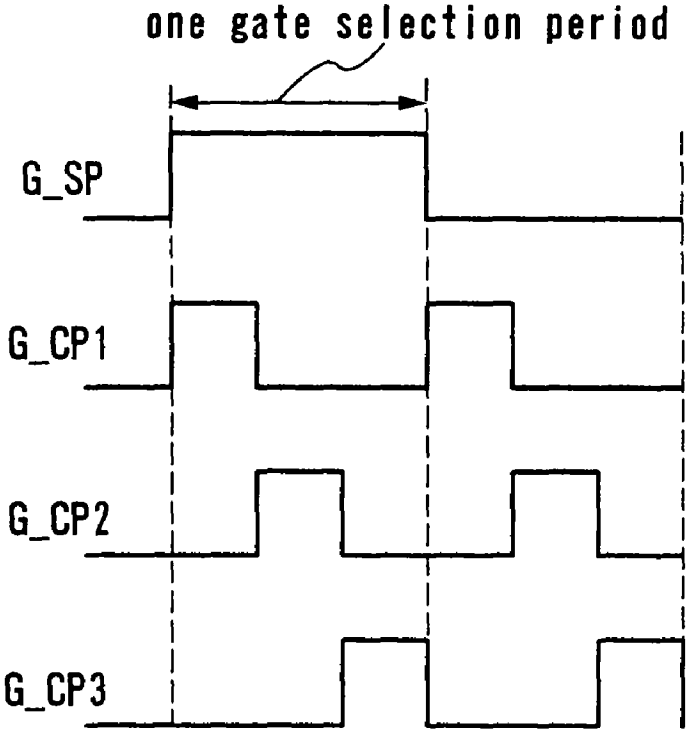
FIGS. 29A and 29B are diagrams of timing charts each showing a driving method of a display device of the invention.
Figure 29B:
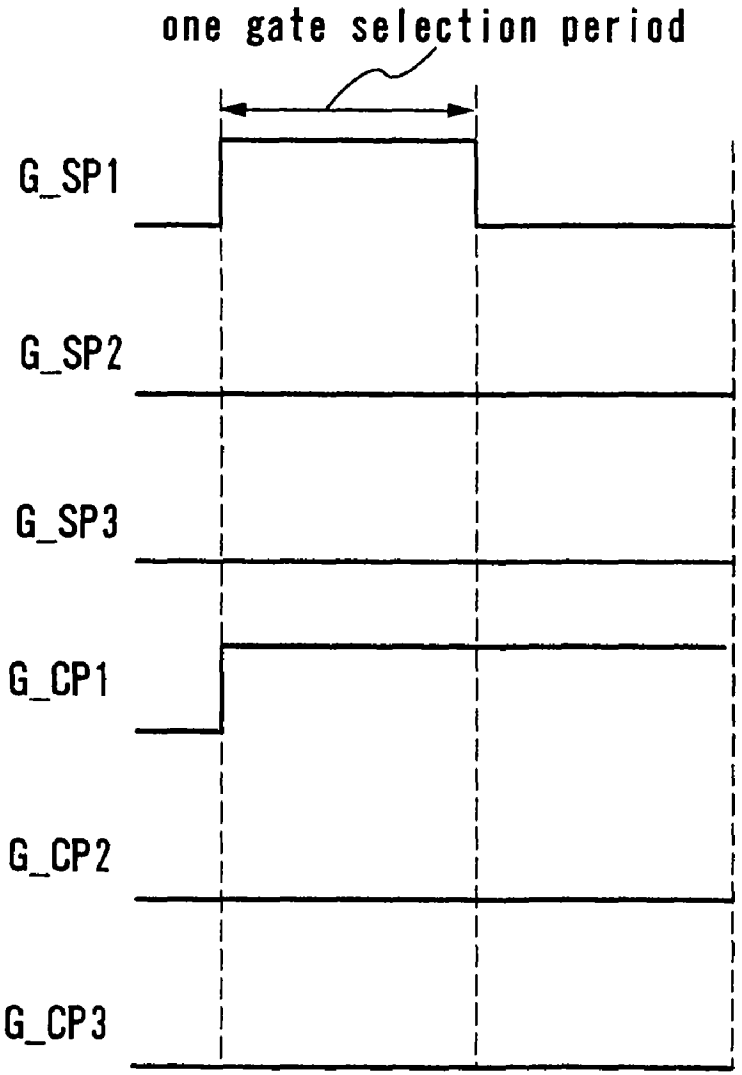

It is to be noted that the timing of the start pulse and the signal for dividing one gate selection period may be changed in switching each display mode. For example, in the case where the first display mode which expresses $2^4$ gray scales, the second display mode which expresses 2 gray scales, and the third display mode which expresses $2^3$ gray scales are provided, an example of respective timing charts of the start pulse and the signal for dividing one gate selection period in the display modes is shown in FIG. 28, and FIGS. 29A and 29B. Note that the example shown in FIG. 28, and FIGS. 29A and 29B is described on the case where a plurality of rows are selected at the same time in one gate selection period in the first and the third display modes, and only one row is selected in one gate selection period in the second display mode.

The timing of the signals shown in FIG. 28 is adopted in the first and the third display modes. FIG. 28 is the same one used in FIG. 25 to 27. According to this, a plurality of gate signal lines can be selected during one gate selection period, the frequency of the clock pulse G_CLK, the start pulse G_SP, or the like to be inputted to the shift register of the gate signal line driver circuit can be reduced, and the driving voltage of operating the gate signal line driver circuit can be decreased.

In addition, the timing of the signals shown in FIG. 29A or 29B is adopted in the second display mode. FIG. 29A shows a method for inputting the common start pulse G_SP to the three stages of shift registers. As for the signal for dividing one gate selection period, it is the same one shown in FIG. 28. According to this, the same gate signal line is selected by using the three stages of shift registers for respective ⅓ periods of one gate selection period. That is, a gate signal line of one row can be selected in one gate selection period. FIG. 29B shows a method for selecting a gate signal line by using only one stage of the three stages of shift registers. For example, as for the start pulse, G_SP1 is made to be a Hi signal only during one gate selection period, and G_SP2 and G_SP3 are always made to be Lo signals. Further, as for the signal for dividing one gate selection period, G_CP1 is always made to be a Hi signal and G_CP2 and G_CP3 are always made to be Lo signals. According to this, a gate signal line of one row can be selected in one gate selection period by using the first shift register 2301.

Note that in general, in the case where one gate selection period is divided into a sub-gate selection periods (where a is a natural number equal to or more than 2), a stages of shift registers are prepared and a gate signal line driver circuit may be constituted by the same manner as this embodiment.

Figure 31:
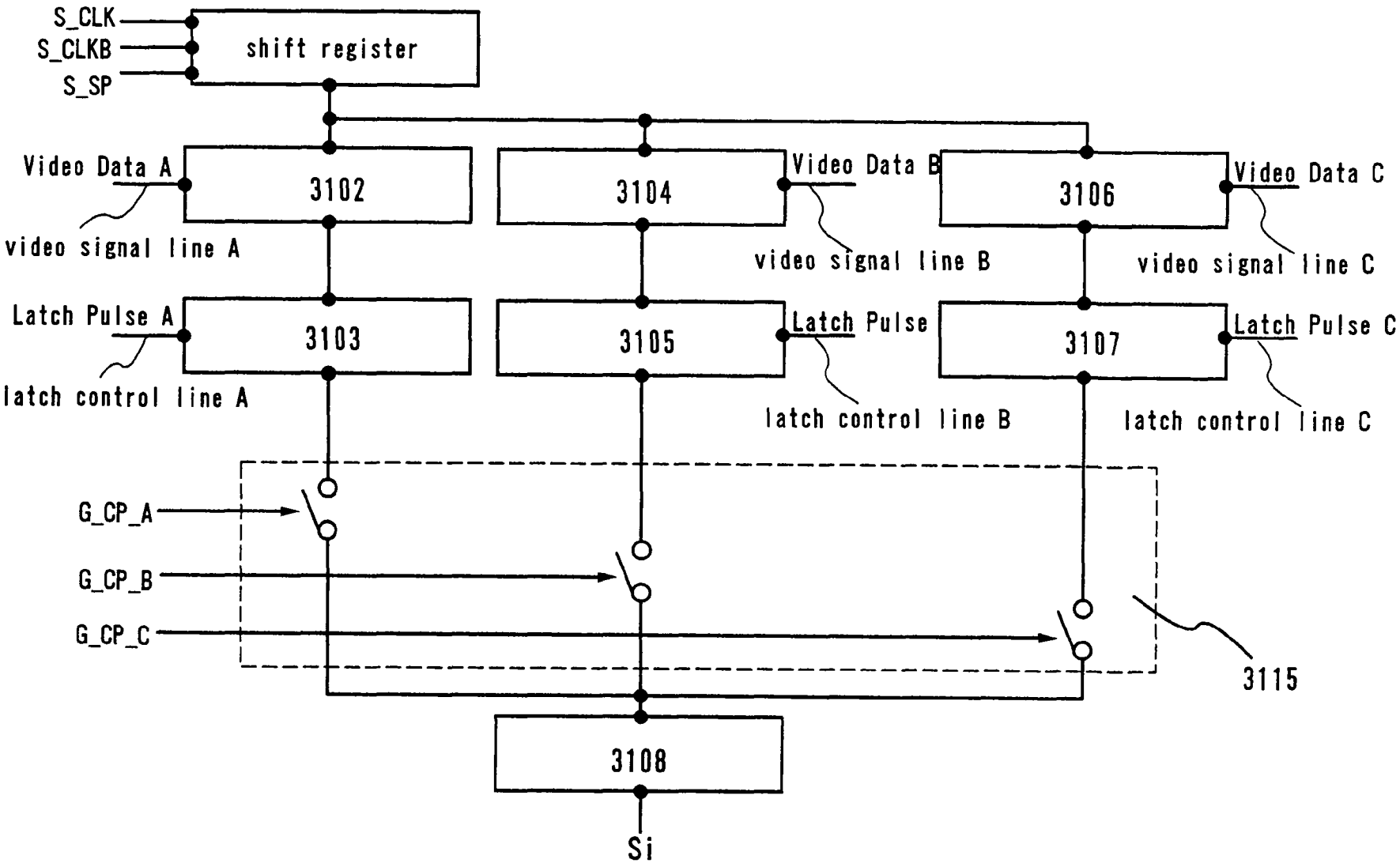
FIG. 31 is a diagram showing constitution of a source signal line driver circuit of a display device of the invention.

A constitution example of the source signal line driver circuit when implementing the driving method of this embodiment is shown in FIG. 31. FIG. 31 illustrates a source signal line driver circuit of the i-th column. For example, in the case where one gate selection period is divided into three sub-gate selection periods as shown in FIG. 22, three pairs of a first latch circuit and a second latch circuit are prepared. In each pair of the first latch circuit and the second latch circuit, a video signal of a different row is stored. For example, a video signal of the i-th row is stored in a first latch circuit A 3102 and a second latch circuit A 3103, a video signal of the j-th row is stored in a first latch circuit B 3104 and a second latch circuit B 3105, and a video signal of the k-th row is stored in a first latch circuit C 3106 and a second latch circuit C 3107. Then, a video signal of a row to be inputted to the source signal line of the i-th column is selected by a switching switch 3115, and is inputted through a level shifter 3108. Note that the operation of the switching switch is controlled such that a different switch is turned on for each of the three sub-gate selection periods. For example, using the signal for dividing one gate selection period G_CP used in the gate signal line driver circuit shown in FIGS. 10A to 10C, and FIG. 23, only the video signal of the i-th row which is stored in the first latch circuit A 3102 and the second latch circuit A 3103 is inputted to the source signal line in the first ⅓ period of one gate selection period. Similarly, only the video signal of the j-th row which is stored in the first latch circuit B 3104 and the second latch circuit B 3105 is inputted to the source signal line in the middle ⅓ period of the one gate selection period, and only the video signal of the k-th row which is stored in the first latch circuit C 3106 and the second latch circuit C 3107 is inputted to the source signal line in the last ⅓ period of the one gate selection period.

By using such the source signal line driver circuit, video signals of three rows can be inputted to the source signal line during one gate selection period. By using both the source signal line driver circuit and the gate signal line driver circuit shown in FIGS. 10A to 10C, and FIG. 23, the driving method can be implemented in which a plurality of gate signal lines are selected during one gate selection period.

By using the above-described driving method, a lighting period of a light-emitting element per frame period can be increased so that luminance can be improved. In addition, the respective frequencies of the clock pulse, the start pulse, or the like inputted to the shift register of each driver circuit (the source signal line driver circuit and the gate signal line driver circuit) can be reduced, and the driving voltage of operating each driver circuit can be decreased. Further, because the circuit configuration can be simplified, it can be applied to an inexpensive display device.

Note that as for details of such the driving method, Japanese Patent Laid-Open No. 2001-324958, Japanese Patent Laid-Open No. 2002-108264, Japanese Patent Laid-Open No. 2004-4501, or the like has described, the content of which can be combined with this application.

Note that one frame period is divided in the second display mode in this embodiment, however, the division is not necessarily performed.

Note that only one row is selected in one gate selection period in the second display mode in this embodiment, however, a plurality of rows may be selected at the same time in one gate selection period in the second display mode.

Note that this embodiment can be freely combined with Embodiments 1 to 4.

Embodiment 7

Figure 32:
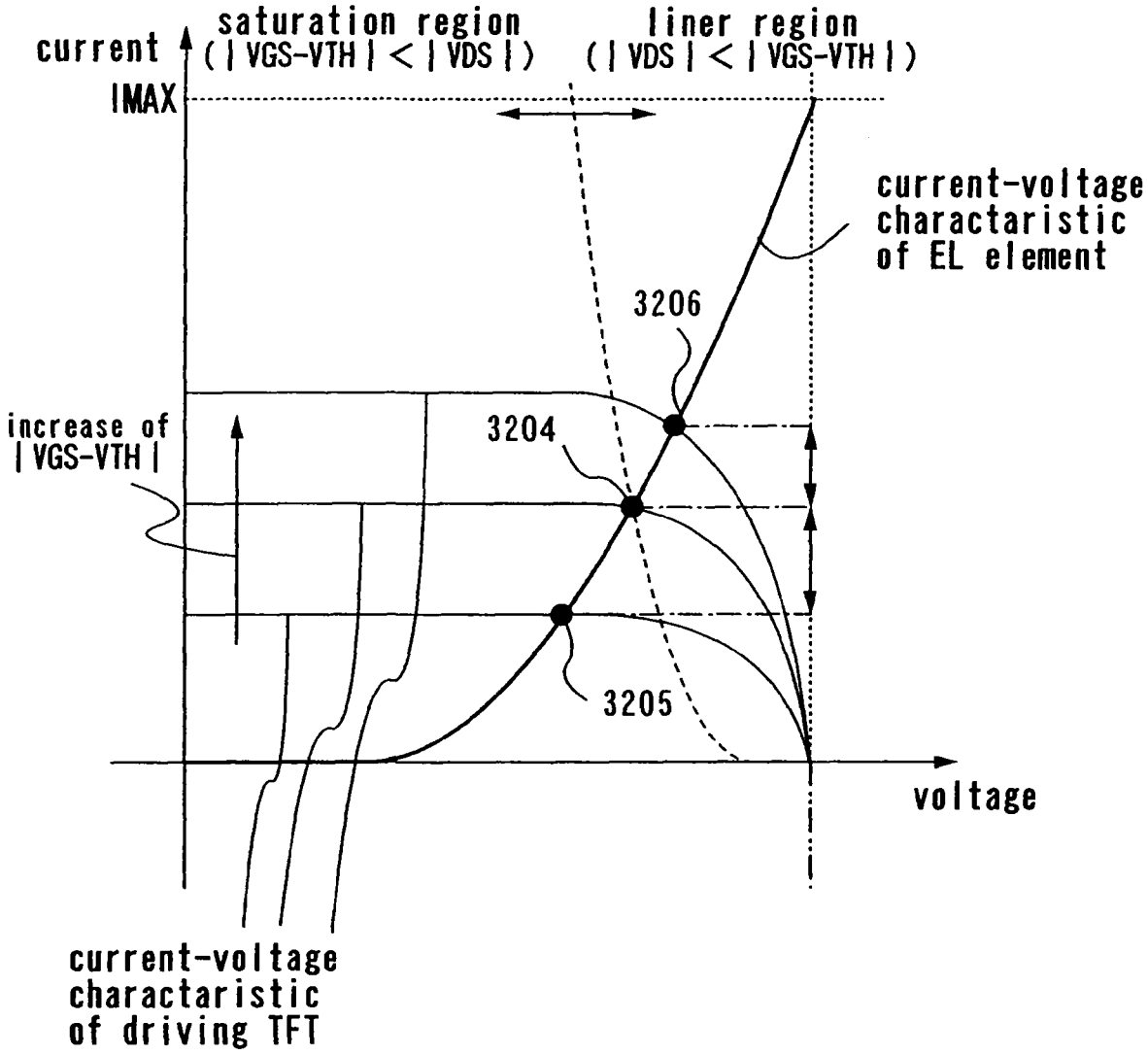
FIG. 32 is a chart showing an operation condition of a driving TFT of the invention.

Further, according to the above method, time gray scale operation is conducted by constant voltage drive. In other words, a driving TFT in a pixel is operated in a linear region. Thus, an external power source voltage is applied to a light-emitting element as it is. However, there is a following defect in this method; when the light-emitting element is deteriorated to change its characteristic between an applied voltage and luminance, burn-in is caused so that display quality is deteriorated. Therefore, there is a constant current drive, that is, a driving method of operating a driving TFT in a pixel in a saturation region so that the driving TFT is used as a current source. Even in this case, by controlling an operating period of the driving TFT, time gray scale can be conducted. This has been described in Japanese Patent Laid-Open No. 2002-108285. The invention can be applied to such a constant current time gray scale method. An operating point of the driving TFT is shown in FIG. 32. When the constant current drive is conducted, the driving TFT is operated in a saturation region in which there exists an operating point 3205. When the constant voltage drive is conducted, the driving TFT is operated in a linear region in which there exists an operating point 3206.

Note that this embodiment can be implemented freely combining with Embodiments 1 to 6.

Embodiment 8

Figure 33:
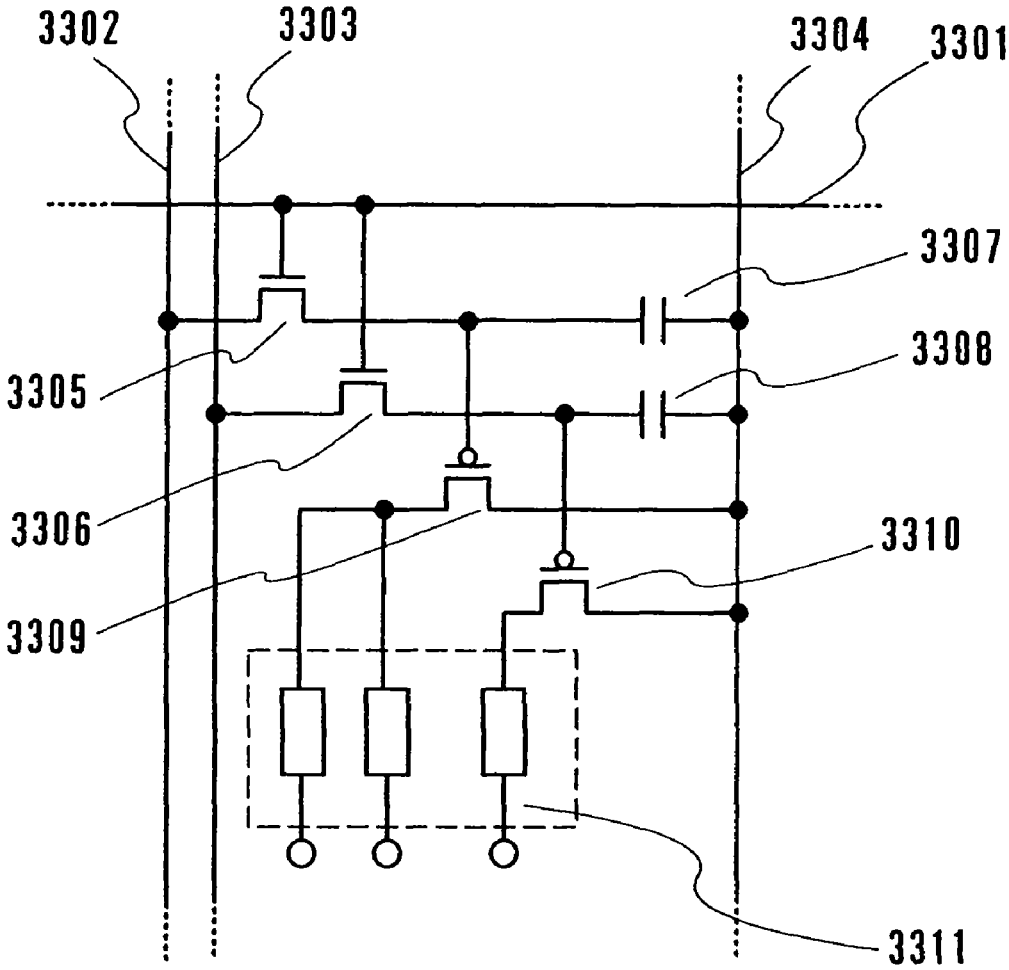
FIG. 33 is a diagram showing a configuration of a pixel of a display device of the invention.
Figure 34:
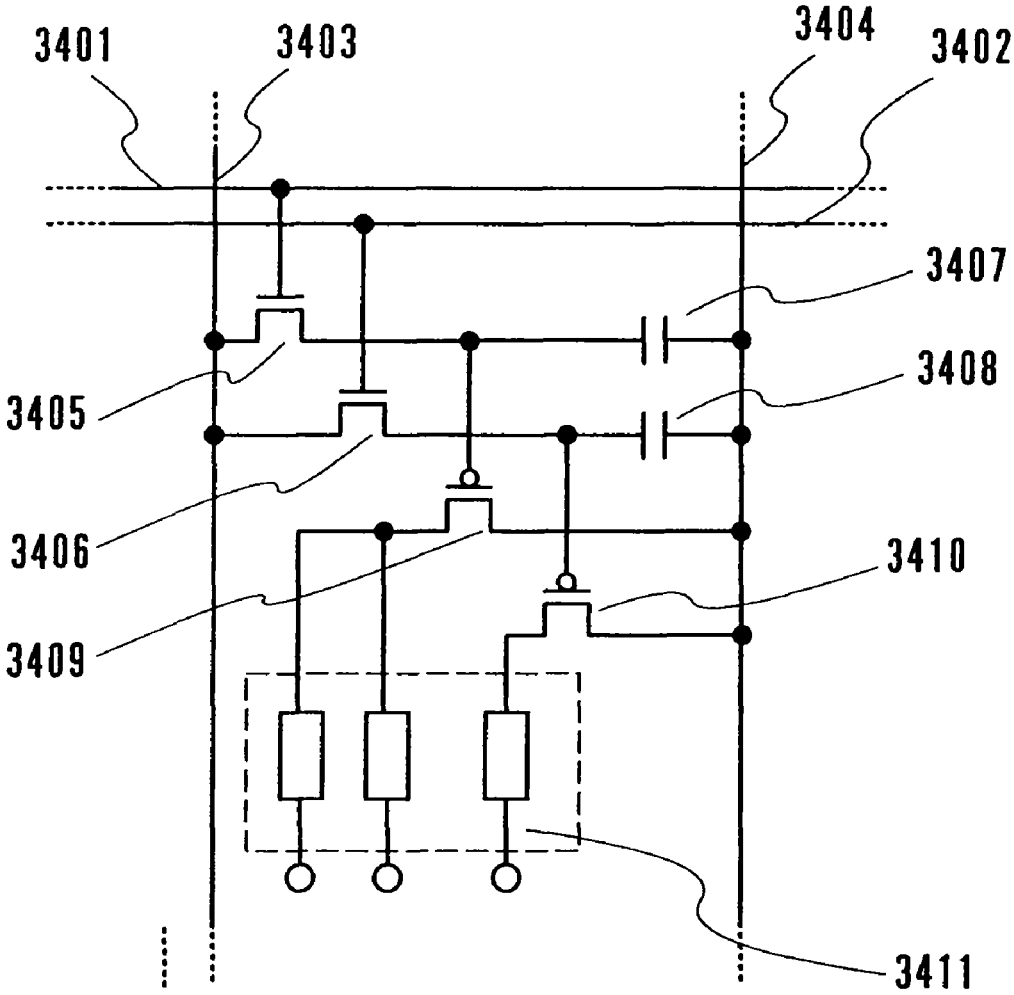
FIG. 34 is a diagram showing a configuration of a pixel of a display device of the invention.

Described hereinabove is the example in which the time gray scale method is used as a gray scale expression method, however, the invention may be applied to the case of another gray scale expression method. For example, the invention can be applied even in the case of a driving method using an area gray scale method. FIGS. 33 and 34 show examples of a pixel configuration in the case of applying the area gray scale method. The pixel by which the area gray scale method is conducted has a feature that one pixel includes a plurality of light-emitting elements each of which can be controlled independently. Each of a light-emitting element 3311 and a light-emitting element 3411 in FIGS. 33 and 34 includes three light-emitting elements, two of which can be controlled independently. Relatively, one of the two light-emitting elements capable of being controlled independently can emit light at a luminance of 1 while the other can emit light at a luminance of 2. According to this, luminances of 0, 1, 2, and 3 can be expressed in one pixel even when the light-emitting element is driven with a binary of light emission and non-light emission.

FIG. 33 is a configuration example of the case where a plurality of source signal lines are provided, a source signal line to which a signal is inputted and the signal are controlled so that the number of light-emitting elements which emit light is changed to express a gray scale. In FIG. 33, by increasing a potential of a gate signal line 3301, the gate signal line 3301 is selected, a first selecting TFT 3305 and a second selecting TFT 3306 are turned on, and respective signals of a first source signal line 3302 and a second source signal line 3303 are inputted to a first storage capacitor 3307 and a second storage capacitor 3308. Consequently, in accordance with the respective signals, currents of a first driving TFT 3309 and a second driving TFT 3310 are controlled, and a current flows from a power supply line 3304 to the light-emitting element 3311.

At this time, depending on the signals inputted to the first and the second source signal lines, the light-emitting element 3311 which emits light is changed in number. For example, when a Hi signal is inputted to the first source signal line 3302 whereas a Lo signal is inputted to the second source signal line 3303, only the first driving TFT 3309 is turned on, thereby the two light-emitting elements emit light. On the other hand, when a Lo signal is inputted to the first source signal line 3302 whereas a Hi signal is inputted to the second source signal line 3303, only the second driving TFT 3310 is turned on, thereby the one light-emitting element emits light. Further, when Hi signals are inputted to the first source signal line 3302 and the second source signal line 3303, both the first driving TFT 3309 and the second driving TFT 3310 are turned on, thereby the three light-emitting elements emit light.

FIG. 34 is a configuration example of the case where a plurality of gate signal lines are provided, a gate signal line to which a signal is inputted is controlled so that the number of light-emitting elements which emit light is changed to express a gray scale. In FIG. 34, by increasing respective potentials of a first gate signal line 3401 and a second gate signal line 3402, the first gate signal line 3401 and the second gate signal line 3402 are selected, a first selecting TFT 3405 and a second selecting TFT 3406 are turned on, and a signal of a first source signal line 3403 is inputted to a first storage capacitor 3407 and a second storage capacitor 3408. Consequently, in accordance with the signal, currents of a first driving TFT 3409 and a second driving TFT 3410 are controlled, and a current flows from a power supply line 3404 to the light-emitting element 3411.

At this time, depending on the gate signal line selected between the first and the second gate signal lines, the light-emitting element 3411 which emits light is changed in number. For example, when only the first gate signal line 3401 is selected, only the first selecting TFT 3405 is turned on and the current only of the first driving TFT 3409 is controlled, thereby the two light-emitting elements emit light. On the other hand, when only the second gate signal line 3402 is selected, only the second switching TFT 3406 is turned on and the current only of the second driving TFT 3410 is controlled, thereby the one light-emitting element emits light. Further, when both the first gate signal line 3401 and the second gate signal line 3402 are selected, the first selecting TFT 3405 and the second selecting TFT 3406 are turned on and the respective currents of the first driving TFT 3409 and the second driving TFT 3410 are controlled, thereby the three light-emitting elements emit light.

By using such a pixel circuit, the invention can be applied to an area gray scale method.

Note that this embodiment can be implemented freely combining with Embodiments 1 to 7.

Embodiment 9

In this embodiment, a structure of a TFT constituting the display device of the invention is described. In this embodiment, description is made on the case where an amorphous silicon (a-Si:H) film is used as a semiconductor layer of the TFT. The case is of a top-gate TFT is shown in FIGS. 45A and 45B, and the case of a bottom-gate TFT is shown in FIGS. 46A and 46B, and FIGS. 47A and 47B.

Figure 45A:
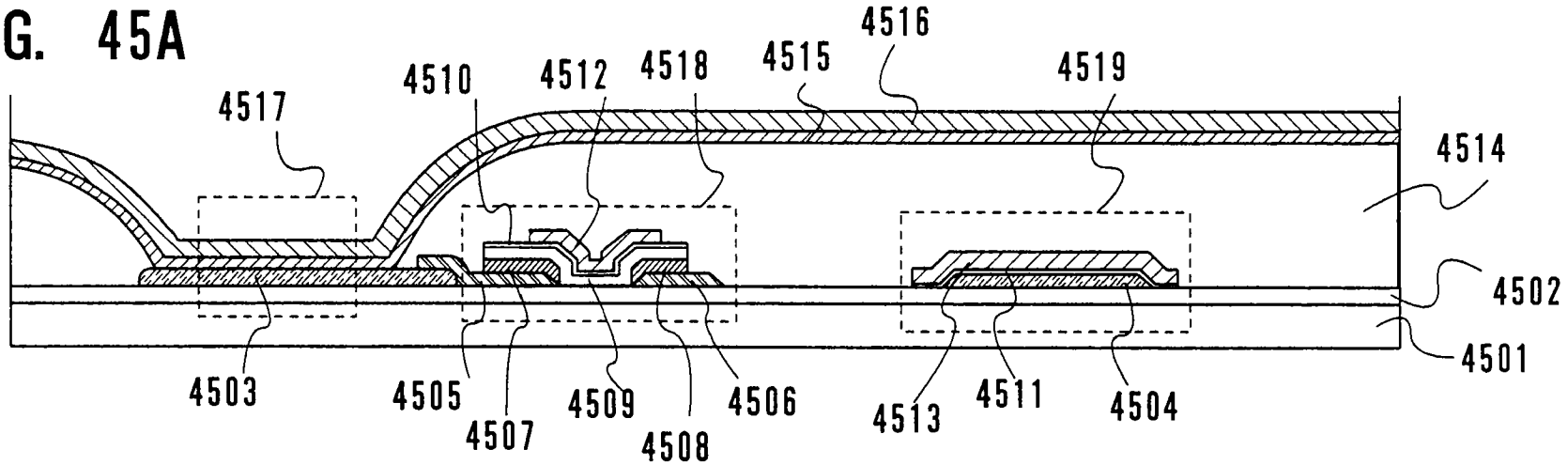
FIGS. 45A and 45B are diagrams showing a structure of a TFT used in a display device of the invention.
Figure 45B:
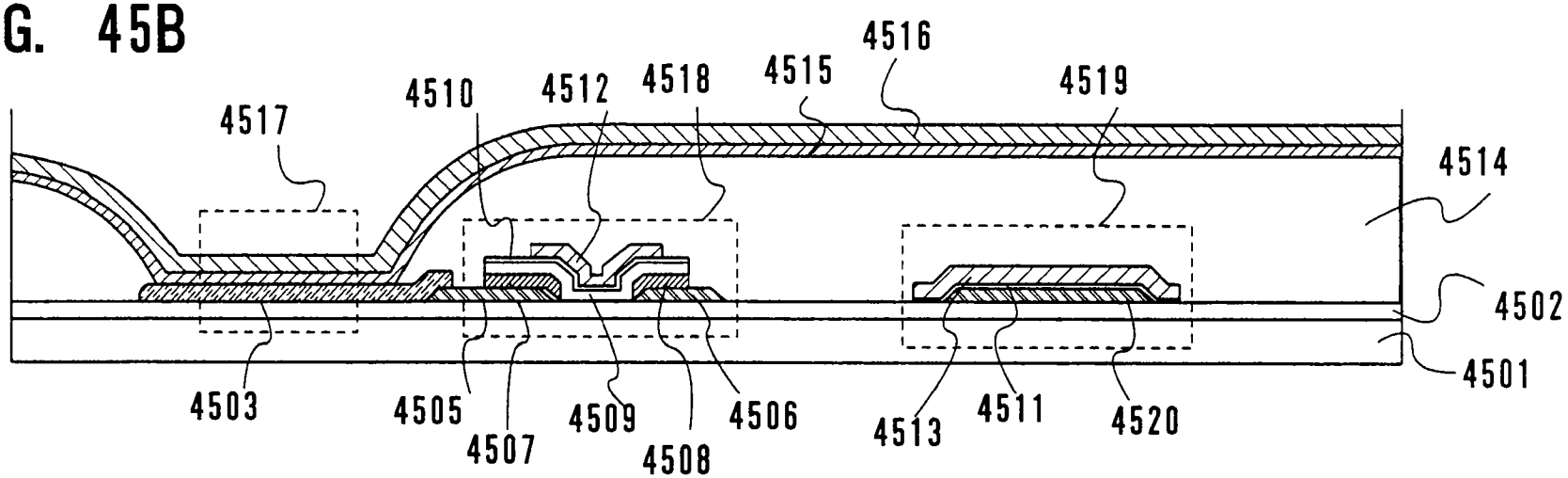

FIG. 45A shows a cross section of a TFT having a top-gate structure in which amorphous silicon is used for its semiconductor layer. As shown in FIG. 45A, a base film 4502 is formed on a substrate 4501. On the base film 4502, a pixel electrode 4503 is formed. In addition, a first electrode 4504 is formed in the same layer and of the same material as the pixel electrode 4503.

As the substrate, a glass substrate, a quartz substrate, a ceramic substrate, or the like can be used. As the base film 4502, a single layer of aluminum nitride (AlN), silicon oxide ($SiO_2$), silicon oxynitride ($SiO_xN_y$), or the like, or a stacked layer thereof can be used.

A wire 4505 and a wire 4506 are formed on the base film 4502, and an end portion of the pixel electrode 4503 is covered with the wire 4505. On the wire 4505 and the wire 4506, an n-type semiconductor layer 4507 and an n-type semiconductor layer 4508 having n-type conductivity are formed respectively. In addition, a semiconductor layer 4509 is formed between the wire 4505 and the wire 4506 on the base film 4502, which is partially extended on the n-type semiconductor layer 4507 and the n-type semiconductor layer 4508. Note that this semiconductor layer is formed of a semiconductor film having non-crystallinity such as amorphous silicon (a-Si:H) or a microcrystalline semiconductor (μ-Si:H). Then, a gate insulating film 4510 is formed on the semiconductor layer 4509, and an insulating film 4511 is formed in the same layer and of the same material as the gate insulating film 4510, on the first electrode 4504. Note that a silicon oxide film, a silicon nitride film, or the like is used as the gate insulating film 4510.

Further, on the gate insulating film 4510, a gate electrode 4512 is formed. Then, a second electrode 4513 is formed in the same layer and of the same material as the gate electrode, over the first electrode 4504 with the insulating film 4511 interposed therebetween. A capacitor 4519 is formed in which the insulating film 4511 is interposed between the first electrode 4504 and the second electrode 4513. In addition, an interlayer insulating film 4514 is formed to cover end portions of the pixel electrode 4503, a driving transistor 4518, and the capacitor 4519.

On the interlayer insulating film 4514 and the pixel electrode 4503 corresponding to an opening of the interlayer insulating film 4514, a layer containing an organic compound 4515 and an opposing electrode 4516 are formed. A light-emitting element 4517 is formed in a region where the layer containing an organic compound 4515 is interposed between the pixel electrode 4503 and the opposing electrode 4516.

Note that the first electrode 4504 in FIG. 45A may be a first electrode 4520 as shown in FIG. 45B. The first electrode 4520 is formed in the same layer and of the same material as the wires 4505 and 4506.

Figure 46A:
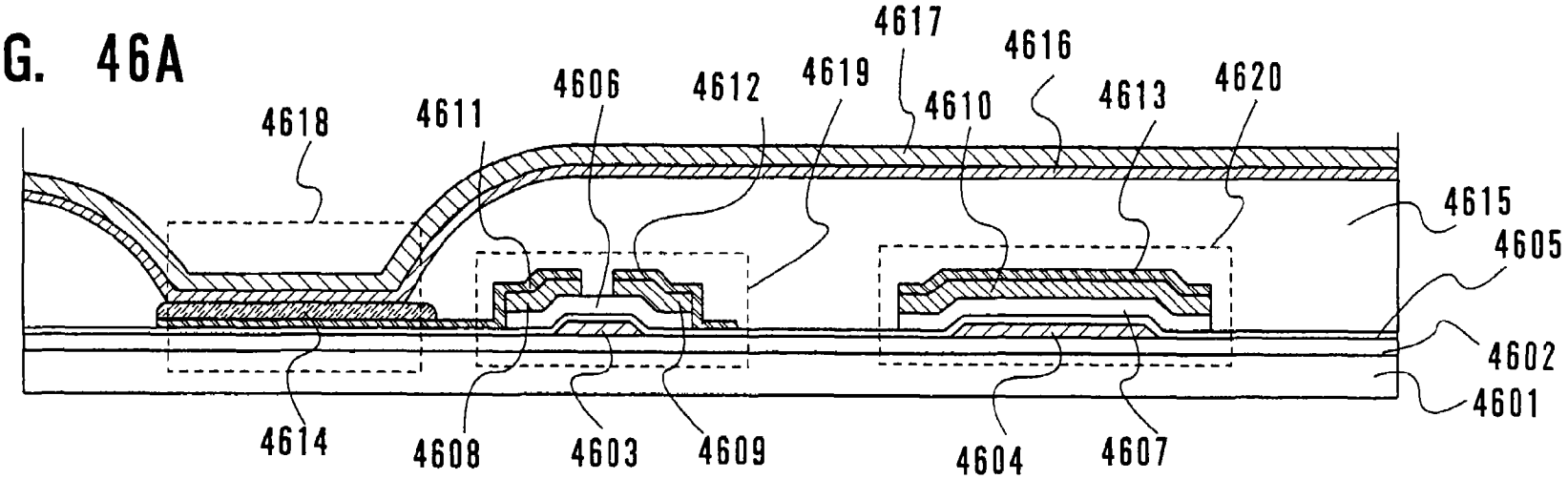
FIGS. 46A and 46B are diagrams showing a structure of a TFT used in a display device of the invention.
Figure 46B:
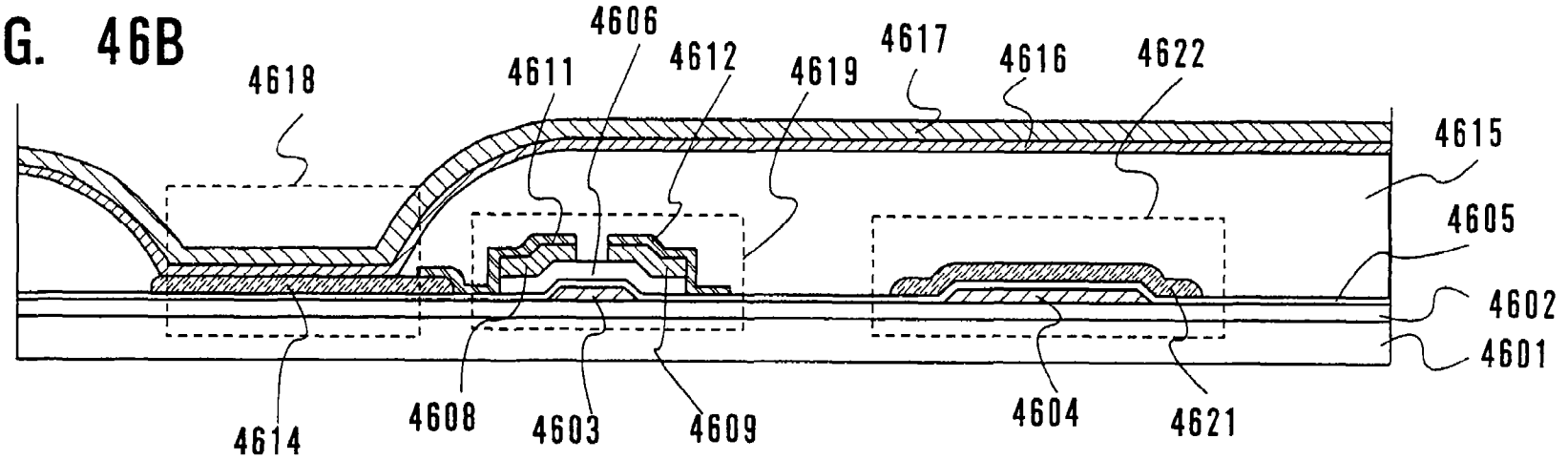

FIGS. 46A and 46B show partial cross sections of panels of a display device in which a TFT having a bottom-gate structure using amorphous silicon as its semiconductor layer.

A base film 4602 is formed on a substrate 4601. On the base film 4602, a gate electrode 4603 is formed. In addition, a first electrode 4604 is formed in the same layer and of the same material as the gate electrode. As a material for the gate electrode 4603, phosphorus-added polycrystalline silicon can be used. Other than polycrystalline silicon, silicide that is a compound of metal and silicon may be used as well.

Then, a gate insulating film 4605 is formed to cover the gate electrode 4603 and the first electrode 4604. As the gate insulating film 4605, a silicon oxide film, a silicon nitride film, or the like is used.

On the gate insulating film 4605, a semiconductor layer 4606 is formed. In addition, a semiconductor layer 4607 is formed in the same layer and of the same material as the semiconductor layer 4606.

As the substrate, a glass substrate, a quartz substrate, a ceramic substrate, or the like can be used. As the base film 4602, a single layer of aluminum nitride (AlN), silicon oxide ($SiO_2$), silicon oxynitride ($SiO_xN_y$), or the like, or a stacked layer thereof can be used.

N-type semiconductor layers 4608 and 4609 having n-type conductivity are formed on the semiconductor layer 4606, and an n-type semiconductor layer 4610 is formed on the semiconductor layer 4607.

Wires 4611 and 4612 are formed on the n-type semiconductor layers 4608 and 4609 respectively, and a conductive layer 4613 is formed in the same layer and of the same material as the wires 4611 and 4612, on the n-type semiconductor layer 4610.

The semiconductor layer 4607, the n-type semiconductor layer 4610, and the conductive layer 4613 constitute a second electrode. Note that a capacitor 4620 is formed with a structure in which the gate insulating film 4605 is interposed between the second electrode and the first electrode 4604.

One end portion of the wire 4611 is extended, and a pixel electrode 4614 is formed on the extended wire 4611.

In addition, an interlayer insulating film 4615 is formed so as to cover end portions of the pixel electrode 4614, a driving transistor 4619, and the capacitor 4620.

Then, a layer containing an organic compound 4616 and an opposing electrode 4617 are formed on the pixel electrode 4614 and the interlayer insulating film 4615. A display element 4618 is formed in a region where the layer containing an organic compound 4616 is sandwiched between the pixel electrode 4614 and the opposing electrode 4617.

The semiconductor layer 4607 and the n-type semiconductor layer 4610 which form a part of the second electrode of the capacitor is not necessarily provided. That is, the second electrode may be the conductive layer 4613, so that the capacitor may be formed in which the gate insulating film is interposed between the first electrode 4604 and the conductive layer 4613.

Note that, by forming the pixel electrode 4614 prior to forming the wire 4611 in FIG. 46A, a capacitor 4622 can be formed with a structure in which the gate insulating film 4605 is interposed between a second electrode 4621 which is formed of the pixel electrode 4614 and the first electrode 4604 as shown in FIG. 46B.

It is to be noted that FIGS. 46A and 46B show inversely staggered, channel etch type TFTs; however, a channel protective type TFT may be used. The case of a channel protective type TFT is described with reference to FIGS. 47A and 47B.

Figure 47A:
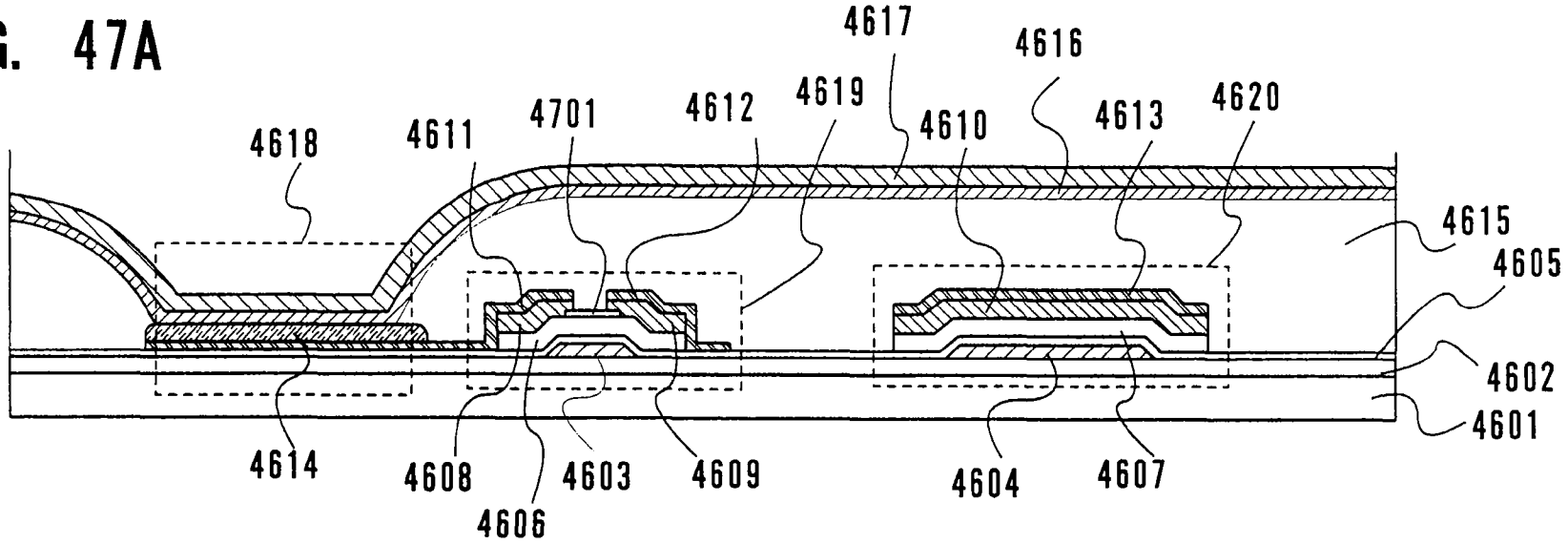
FIGS. 47A and 47B are diagrams showing a structure of a TFT used in a display device of the invention.

A channel protective type TFT shown in FIG. 47A is different from the driving TFT of the channel etch type 4619 shown in FIG. 46A in that an insulator 4701 which is an etching mask is provided on the channel forming region in the semiconductor layer 4606. The other portions identical to FIG. 46A are denoted by the same reference numerals.

Figure 47B:
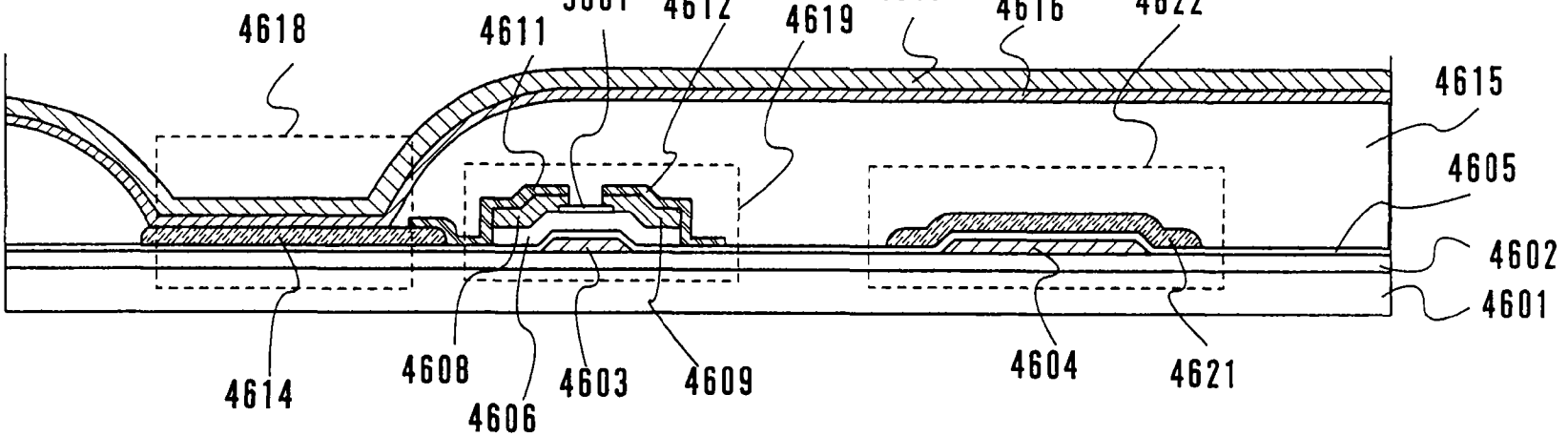

Similarly, a channel protective type TFT shown in FIG. 47B is different from the driving TFT of the channel etch type 4619 shown in FIG. 46B in that the insulator 4701 which is an etching mask is provided on the channel forming region in the semiconductor layer 4606. The other portions identical to FIG. 46B are denoted by the same reference numerals.

By using an amorphous semiconductor film as a semiconductor layer (e.g., a channel forming region, a source region, and a drain region) of a TFT constituting the pixel of the invention, manufacturing cost can be reduced.

Note that a structure of a transistor and a structure of a capacitor to which the pixel configuration of the invention are not limited to the above-described ones, and various structures can be used.

For example, description in this embodiment is made on the case where an amorphous silicon (a-Si:H) film is used as a semiconductor layer of a TFT, however, the invention is not limited to this. A polysilicon (p-Si) film may be used as the semiconductor layer as well.

Note that transistors of various modes can be applied to a transistor of the invention. Therefore, the kind of transistor applicable to the invention is not limited. Thus, a thin film transistor (TFT) using an amorphous semiconductor film typified by amorphous silicon or polycrystalline silicon, a MOS transistor formed using a semiconductor substrate or an SOI substrate, a junction transistor, a bipolar transistor, a transistor using a compound semiconductor such as ZnO or a-InGaZnO, a transistor using an organic semiconductor or a carbon nanotube, or another transistor can be applied. It is to be noted that an amorphous semiconductor film may contain hydrogen or halogen. As for the substrate over which a transistor is disposed, a substrate of various kinds can be used and it is not limited to a particular one. Therefore, a transistor can be provided over, for example, a single crystalline substrate, an SOI substrate, a glass substrate, a quartz substrate, a plastic substrate, a paper substrate, a cellophane substrate, a stone substrate, or the like. Further, a transistor formed over a certain substrate may be transferred and arranged over another substrate.

Note also that the structure of the TFT can employ various modes and is not limited to a particular structure. For example, a multi-gate structure may be used in which the number of gates is at least two. By adopting the multi-gate structure, off-current can be reduced and resistance to pressure of the transistor can be improved to improve the reliability, and when operating in a saturation region, a drain-source current does not change so much even if a drain-source voltage changes so that a flat characteristic can be realized. Further, a structure may be used as well in which a gate electrode is disposed above and below the channel. By adopting the structure in which a gate electrode is disposed above and below the channel, the channel region is increased, thereby the current value can be increased, a depletion layer can be easily formed to improve the S-value. Further, there may be a structure in which a gate electrode is disposed above the channel, a structure in which a gate electrode is disposed below the channel, a staggered TFT structure, and an inversely staggered TFT structure. Further, the channel region may be divided into a plurality of regions, and may be connected in parallel or in series. Further, a source electrode or a drain electrode may be overlapped with the channel (or a part thereof). By adopting the structure in which a source electrode or a drain electrode is overlapped with the channel (or a part thereof), prevented can be destabilization of an operation due to accumulation of charge in a part of the channel. Further, an LDD region may be provided. By providing an LDD region, off-current can be reduced and resistance to pressure of the transistor can be improved to improve the reliability, and when operating in a saturation region, a drain-source current does not change so much even if a drain-source voltage changes so that a flat characteristic can be realized.

Note that each of the wire and the electrode is formed containing one or a plurality of elements selected from a group including aluminum (Al), tantalum (Ta), titanium (Ti), molybdenum (Mo), tungsten (W), neodymium (Nd), chromium (Cr), nickel (Ni), platinum (Pt), gold (Au), silver (Ag), copper (Cu), magnesium (Mg), scandium (Sc), cobalt (Co), zinc (Zn), niobium (Nb), silicon (Si), phosphorus (P), boron (B), arsenic (As), gallium (Ga), indium (In), tin (Sn), and oxygen (O), a compound or an alloy material containing one or a plurality of elements selected from the above-described group as its main component (e.g., indium tin oxide:ITO, indium zinc oxide:IZO, indium tin oxide to which silicon oxide is added:ITSO, zinic oxide:Zno, aluminum-neodymium:Al—Nd, or magnesium-silver:Mg—Ag), or a material obtained by combining the above-described compounds. Alternatively, it is formed containing a compound of the above-described compound and silicon (silicide) (e.g., aluminum silicon, molybdenum silicon, or nickel silicide), or a compound of the above-described compound and nitrogen (e.g., titanium nitride, tantalum nitride, or molybdenum nitride). Note that in the silicon (Si), a large amount of n-type impurity (e.g., phosphorus) or p-type impurity (e.g., boron). When such impurity is contained, silicon is easily used for a wire or an electrode since the conductivity of silicon is increased and silicon acts as a normal conductor. Note also that silicon may be single crystalline silicon, polycrystalline silicon (polysilicon), or amorphous silicon. When single crystalline silicon or polycrystalline silicon is used, resistance can be reduced. When amorphous silicon is used, manufacturing steps can be simplified. Note that aluminum and silver can reduce signal delay since the conductivity thereof is high, and can be easily etched so that patterning thereof can be easily conducted and microfabrication can be performed. Copper can reduce signal delay since the conductivity thereof is high. Molybdenum is desirable because it can be formed without causing a problem such as a defect of material even if it contacts with an oxide semiconductor such as ITO or IZO or silicon, patterning or etching thereof can be easily performed, and the heat resistance is high. Titanium is desirable because it can be formed without causing a problem such as a defect of material even if it contacts with an oxide semiconductor such as ITO or IZO or silicon, and the heat resistance is high. Tungsten is desirable because of its high heat resistance. Neodymium is desirable because of its high heat resistance. In particular, an aluminum-neodymium alloy is desirable since the heat resistance increases and the formation of hillocks in aluminum can be suppressed. Silicon is desirable because it can be formed simultaneously with a semiconductor layer of a transistor and the high heat resistance is high. Indium tin oxide (ITO), indium zinc oxide (IZO), indium tin oxide added with silicon oxide (ITSO), zinc oxide (ZnO), and silicon (Si) are desirable since they transmit light and thus can be used in a portion that transmits light; for example, they can be used as a pixel electrode or a common electrode.

Note that these materials may have a single layer structure or a multilayer structure to form the wire or the electrode. When a single layer structure is adopted, manufacturing steps can be simplified and the number of manufacturing days can be reduced, leading to cost savings. On the other hand, when a multilayer structure is adopted, the advantages of respective materials can be utilized and the disadvantages thereof can be reduced, thereby forming a high-performance wire or electrode. For example, by including a low resistance material (e.g., aluminum) in a multilayer structure, the resistance of a wire can be reduced. Further, by including a high heat resistance material, for example, when adopting a stacked structure in which a material that does not have a high heat resistance but has other advantages is interposed between the high heat resistance materials, the heat resistance of the wire or the electrode can be increased as a whole. For example, it is desirable to use a stacked structure in which a layer containing aluminum is interposed between layers each containing molybdenum or titanium. In addition, if the wire or the electrode partially contacts directly with another wire or electrode made of a different material, these wires or electrodes may adversely affect each other. For example, a material of one wire or electrode may enter a material of the other wire or electrode to change the property thereof, so that the intended purpose is prevented from being fulfilled, or problems occur in manufacturing and manufacturing steps cannot be completed normally. In such a case, the problem can be solved by interposing or covering a layer with another layer. For example, in the case where indium tin oxide (ITO) is to contact with aluminum, titanium or molybdenum is desirably interposed therebetween. Also, in the case where silicon is to contact with aluminum, titanium or molybdenum is desirably interposed therebetween.

Note that this embodiment can be implemented freely combining with Embodiments 1 to 8.

Embodiment 10

The light sensor which detects the intensity of outside light may be provided for the display device as its component or may be formed integrally in the display. In the case where it is formed integrally in the display, a display surface thereof can be used also as a receiving surface of the light sensor, which has a great effect in design. That is, gray scale control based on the intensity of outside light can be performed without making conscious of the light sensor attached to the display device.

Figure 48:
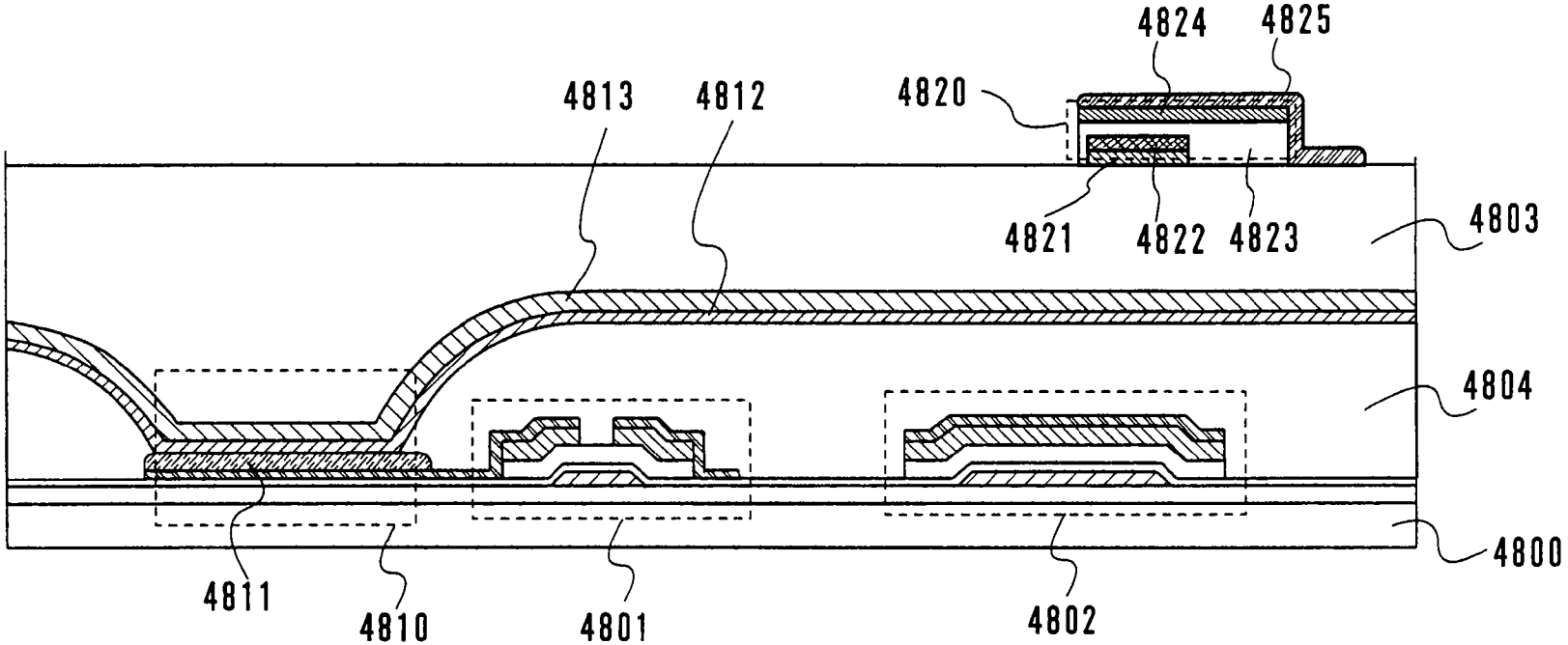
FIG. 48 is a view showing a structure of a display device of the invention.

Here, shown in FIG. 48 is a structure example in the case where a light sensor is formed integrally on a display. Note that FIG. 48 shows the case where a pixel is constituted by a light-emitting element which emits light of electroluminescence (an OLED element) and a TFT which controls operation of the light-emitting element.

In FIG. 48, a driving TFT 4801 and a capacitor 4802 formed on a substrate 4800 having a light-transmitting property, a first electrode (a pixel electrode) 4811 formed of a light-transmitting material, an organic compound layer 4812, and a second electrode (an opposing electrode) 4813 formed of a light-transmitting material are provided. Over an insulating film 4803 formed on the second electrode 4813, a photoelectric conversion element 4820 formed by stacking a p-type layer 4822, an i-type layer 4823 which is virtually intrinsic and an n-type layer 4824, an electrode 4821 connected to the p-type layer, and an electrode 4825 connected to the n-type layer are provided.

In this embodiment, the photoelectric conversion element 4820 is used as a light sensor element. The light-emitting element 4810 and the photoelectric conversion element 4820 are formed over the same substrate 4800, and light emitted from the light-emitting element 4810 constitutes an image, and the user sees it. On the other hand, the photoelectric conversion element 4820 has a function of detecting outside light and sending an electronic signal corresponding to the outside light intensity to a controller (CPU). In this way, the light-emitting element and the light sensor (the photoelectric conversion element) can be formed over the same substrate, which contributes to miniaturization of the set.

Note that the photoelectric conversion element 4820 may be formed on an insulating film 4804 as well.

Note that this embodiment can be implemented freely combining with Embodiments 1 to 9.

Embodiment 11

Throughout this specification, the light-emitting element means an element (an OLED element) having a structure in which an organic compound layer which emits light when an electric field is generated is interposed between an anode and a cathode, however, the invention is not limited to this.

In addition, in this specification, the light-emitting element means both an element that utilizes light (fluorescence) emitted when making a transition from a singlet exciton to a base state, and an element that utilizes light (phosphorescence) emitted when making a transition from a triplet exciton to a base state.

As an organic compound layer, there are a hole injecting layer, a hole transporting layer, a light-emitting layer, an electron transporting layer, an electron injecting layer, and the like. The basic structure of a light-emitting element is a stack of an anode, a light-emitting layer, and a cathode in this order. Other than this, there are a structure of stacking an anode, a hole injecting layer, a light-emitting layer, an electron injecting layer, and a cathode in this order, a structure of stacking an anode, a hole injecting layer, a hole transporting layer, a light-emitting layer, an electron transporting layer, an electron injecting layer, and a cathode in this order, and the like.

Note that the organic compound layer is not limited to a layer having a stacked-layer structure in which the hole injecting layer, the hole transporting layer, the light-emitting layer, the electron transporting layer, the electron injecting layer, and the like are clearly distinguished. That is, the organic compound layer may have a structure including a layer in which respective materials of forming the hole injecting layer, the hole transporting layer, the light-emitting layer, the electron transporting layer, the electron injecting layer, or the like are mixed.

Further, an inorganic material may be mixed as well.

Further, any material of a low molecular material, a high molecular material, and a medium molecular material can be used for the organic compound layer of an OLED element.

Note that in this specification, a medium molecular material does not have the subliming property, and the number of molecules thereof is 20 or less or a molecular chain length thereof is 10 μm or less.

Note that this embodiment can be implemented freely combining with Embodiments 1 to 10.

Embodiment 12

This embodiment describes electronic apparatuses which use the display device of the invention, with reference to FIGS. 35A to 35F.

Figure 35A:
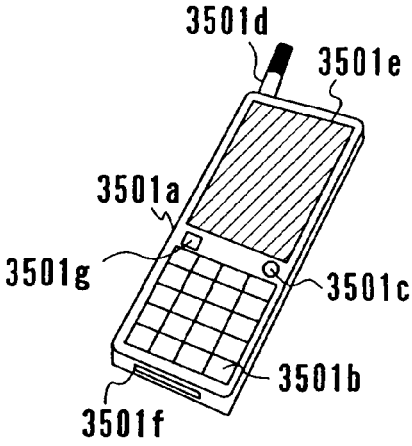
FIGS. 35A to 35F are views showing electronic apparatuses of the invention.

FIG. 35A is a schematic view of a portable information terminal using the display device of the invention. The portable information terminal is constituted by a main body 3501*a*, an operating switch 3501*b*, a power switch 3501*c*, an antenna 3501*d*, a display portion 3501*e*, an external input port 3501*f*, and a light sensor 3501*g*. The display device of the invention can be used in the display portion 3501*e*. According to the invention, the display portion of which visibility is high even under strong outside light can be formed, thereby providing the easy-to-use portable information terminal.

Figure 35B:
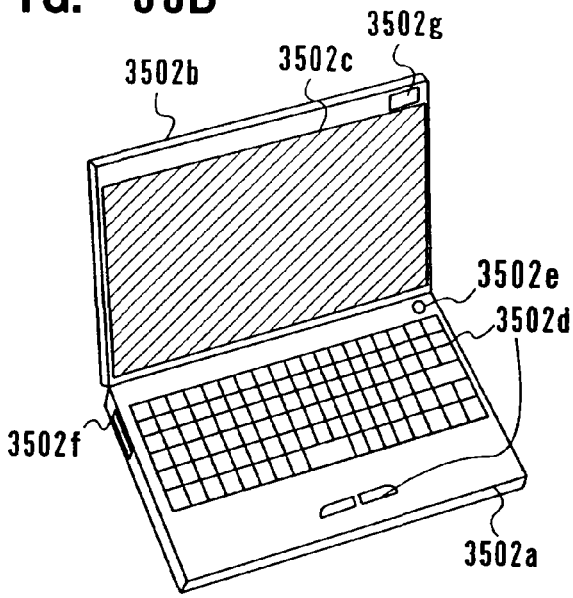

FIG. 35B is a schematic view of a personal computer using the display device of the invention. The personal computer is constituted by a main body 3502*a*, a housing 3502*b*, a display portion 3502*c*, an operating switch 3502*d*, a power switch 3502*e*, an external input port 3502*f*, and a light sensor 3502*g*. The display device of the invention can be used in the display portion 3502*c*. According to the invention, the display portion of which visibility is high even under strong outside light can be formed, thereby providing the easy-to-use personal computer.

Figure 35C:
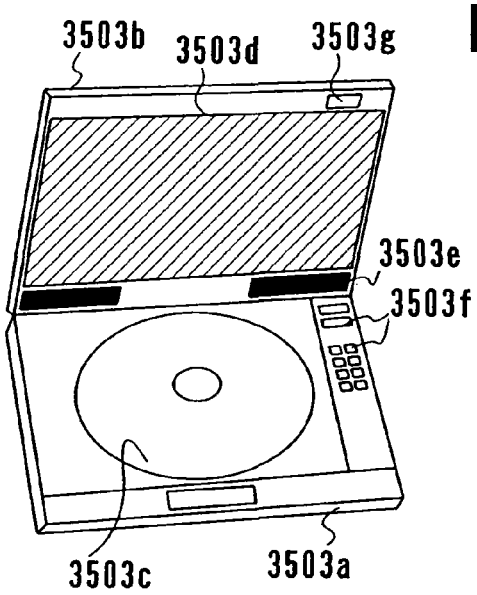

FIG. 35C is a schematic view of an image reproducing device using the display device of the invention. The image reproducing device is constituted by a main body 3503*a*, a housing 3503*b*, a recording medium 3503*c*, a display portion 3503*d*, an audio output portion 3503*e*, an operating switch 3503*f*, and a light sensor 3503*g*. The display device of the invention can be used in the display portion 3503*d*. According to the invention, the display portion of which visibility is high even under strong outside light can be formed, thereby providing the easy-to-use image reproducing device.

Figure 35D:
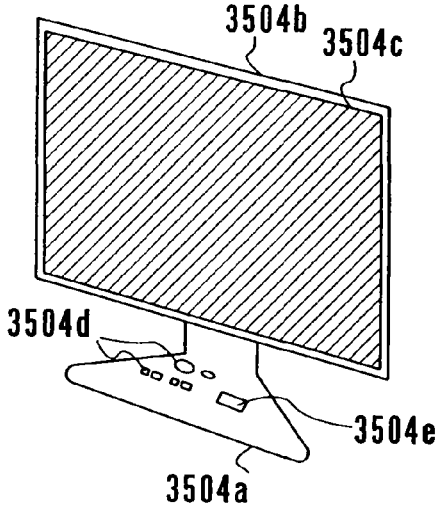

FIG. 35D is a schematic view of a television using the display device of the invention. The television is constituted by a main body 3504*a*, a housing 3504*b*, a display portion 3504*c*, an operating switch 3504*d*, and a light sensor 3504*e*. The display device of the invention can be used in the display portion 3504*c*. According to the invention, the display portion of which visibility is high even under strong outside light can be formed, thereby providing the easy-to-use television.

Figure 35E:
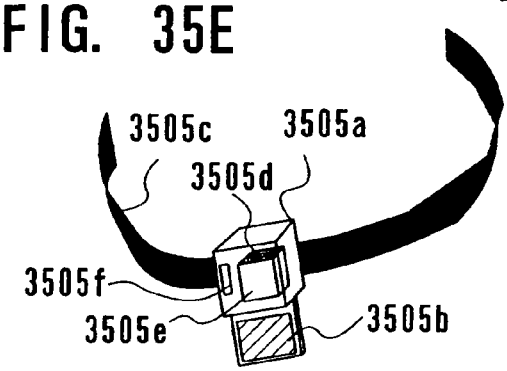

FIG. 35E is a schematic view of a head mounted display using the display device of the invention. The head mounted display is constituted by a main body 3505*a*, a monitor portion 3505*b*, a headband 3505*c*, a display portion 3505*d*, an optical system 3505*e*, and a light sensor 3505*f*. The display device of the invention can be used in the display portion 3505*d*. According to the invention, the display portion of which visibility is high even under strong outside light can be formed, thereby providing the easy-to-use head mounted display.

Figure 35F:
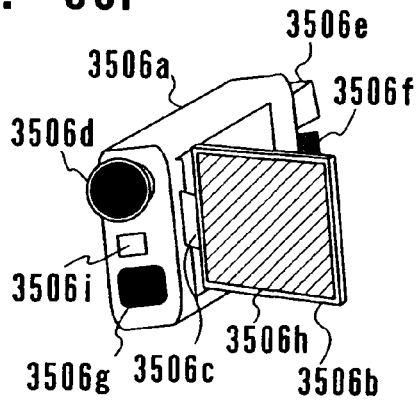
Figure 36:
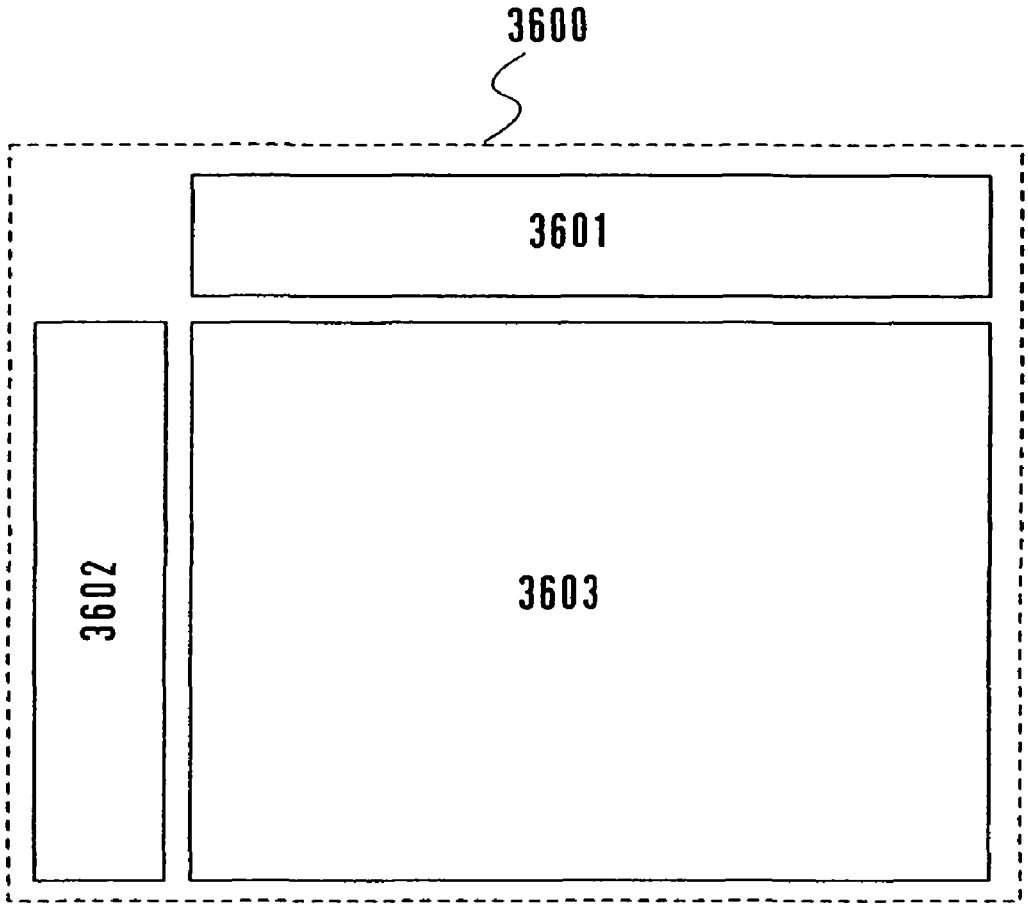
FIG. 36 is a block diagram showing constitution of a conventional display.

FIG. 35F is a schematic view of a video camera using the display device of the invention. The video camera is constituted by a main body 3506*a*, a housing 3506*b*, a connecting portion 3506*c*, an image receiving portion 3506*d*, an eye piece portion 3506*e*, a battery 3506*f*, an audio input portion 3506*g*, a display portion 3506*h*, and a light sensor 3506*i*. The display device of the invention can be used in the display portion 3506*h*. According to the invention, the display portion of which visibility is high even under strong outside light can be formed, thereby providing the easy-to-use video camera.

The invention can be applied to various electronic apparatuses in addition to the above-described applied electronic apparatuses.

Note that this embodiment can be implemented freely combining with Embodiments 1 to 11.

This application is based on Japanese Patent Application serial no. 2005148838 filed in Japan Patent Office on 20, May, 2005, and the entire contents of which are hereby incorporated by reference.

What is claimed is:

1. A display device comprising:

a display;

a display controller; and a light sensor, wherein the display device has a first display mode and a second display mode, wherein in the first display mode, one frame period is divided into a plurality of subframe periods, each of the plurality of subframe periods is either a lighting period or a non-lighting period, and an n-bit (where n is a natural number equal to or more than 2) gray scale is expressed by the sum total of a lighting time within the one frame period, wherein in the second display mode, the display is operated by a lower clock frequency and a lower driving voltage than in the first display mode, one frame period is either a lighting period or a non-lighting period, and a one-bit gray scale is expressed by the sum total of a lighting time within the one frame period, wherein outside light is received by the light sensor, and the first display mode and the second display mode are controlled by the display controller in accordance with intensity of the outside light, and wherein a plurality of gate signal lines are selected within one gate selection period by dividing one gate selection period into a plurality of sub-gate selection periods and selecting a gate signal line of one row within the sub-gate selection period.

2. The display device according to claim 1, wherein the intensity of outside light when the first display mode is selected is higher than the intensity of outside light when the second display mode is selected.

3. The display device according to claim 1, wherein the display device further comprises a frame memory, n-bit data (where n is a natural number equal to or more than 2) is written into the frame memory, the n-bit data is read from the frame memory to perform display in the first display mode, one-bit data is written into the frame memory, and the one-bit data is read from the frame memory to perform display in the second display mode.

4. The display device according to claim 1, wherein the display includes a light-emitting element in each pixel, and a current applied to the light-emitting element in the first display mode is larger than a current applied to the light-emitting element in the second display mode.

5. The display device according to claim 1, wherein the one frame period has a period for writing to a pixel, a display period, and an erasing period in the first display mode.

6. The display device according to claim 1, wherein when the second display mode is selected, a power supply controlling circuit for a driver circuit in the display controller outputs a voltage lower than that in the first display mode.

7. The display device according to claim 1, wherein the display device is incorporated in to an electronic apparatus selected from the group consisting of a portable information terminal, a personal computer, a video camera, and an image reproducing device.

8. A display device comprising:

a display;

a display controller; and a light sensor, wherein the display device has a first display mode and a second display mode, wherein in the first display mode, one frame period is divided into a plurality of subframe periods, each of the plurality of subframe periods is either a lighting period or a non-lighting period, and an n-bit (where n is a natural number equal to or more than 2) gray scale is expressed by the sum total of a lighting time within the one frame period, wherein in the second display mode, the display is operated by a lower clock frequency and a lower driving voltage than in the first display mode, one frame period longer than one frame period in the first display mode is either a lighting period or a non-lighting period, and a one-bit gray scale is expressed by a lighting time within the one frame period are included, wherein outside light is received by the light sensor, and the first display mode and the second display mode are controlled by the display controller in accordance with intensity of the outside light, and wherein a plurality of gate signal lines are selected within one gate selection period by dividing one gate selection period into a plurality of sub-gate selection periods and selecting a gate signal line of one row within the sub-gate selection period.

9. The display device according to claim 8, wherein the intensity of outside light when the first display mode is selected is higher than the intensity of outside light when the second display mode is selected.

10. The display device according to claim 8, wherein the display device further comprises a frame memory, n-bit data (where n is a natural number equal to or more than 2) is written into the frame memory, the n-bit data is read from the frame memory to perform display in the first display mode, one-bit data is written into the frame memory, and the one-bit data is read from the frame memory to perform display in the second display mode.

11. The display device according to claim 8, wherein the display includes a light-emitting element in each pixel, and a current applied to the light-emitting element in the first display mode is larger than a current applied to the light-emitting element in the second display mode.

12. The display device according to claim 8, wherein the one frame period has a period for writing to a pixel, a display period, and an erasing period in the first display mode.

13. The display device according to claim 8, wherein when the second display mode is used, a power supply controlling circuit for a driver circuit in the display controller outputs a voltage lower than that in the first display mode.

14. The display device according to claim 8, wherein the display device is incorporated in to an electronic apparatus selected from the group consisting of a portable information terminal, a personal computer, a video camera, and an image reproducing device.

15. A display device comprising:

a display;

a display controller; and a light sensor, wherein the display device has a first display mode and a second display mode, wherein in the first display mode, one frame period is divided into a plurality of subframe periods, each of the plurality of subframe periods is either a lighting period or a non-lighting period, and an n-bit (where n is a natural number equal to or more than 2) gray scale is expressed by the sum total of a lighting time within the one frame period, wherein in the second display mode, the display is operated by a lower clock frequency and a lower driving voltage than in the first display mode, one frame period is divided into a plurality of subframe periods, each of the plurality of subframe periods is either a lighting period or a non-lighting period, and an m-bit (where m is a natural number less than n) gray scale is expressed by the sum total of a lighting time within the one frame period are included, wherein outside light is received by the light sensor, and the first display mode and the second display mode are controlled by the display controller in accordance with intensity of the outside light; and wherein a plurality of gate signal lines are selected within one gate selection period by dividing one gate selection period into a plurality of sub-gate selection periods and selecting a gate signal line of one row within the sub-gate selection period.

16. The display device according to claim 15, wherein the intensity of outside light when the first display mode is selected is higher than the intensity of outside light when the second display mode is selected.

17. The display device according to claim 15, wherein the display device further comprises a frame memory, n-bit data (where n is a natural number equal to or more than 2) is written into the frame memory, the n-bit data is read from the frame memory to perform display in the first display mode, m-bit data (where m is a natural number less than n) is written into the frame memory, and the m-bit data is read from the frame memory to perform display in the second display mode.

18. The display device according to claim 15, wherein the display includes a light-emitting element in each pixel, and a voltage applied to the light-emitting element in the first display mode is higher than a voltage applied to the light-emitting element in the second display mode.

19. The display device according to claim 15, wherein the one frame period has a period for writing to a pixel, a display period, and an erasing period in the first display mode.

20. The display device according to claim 15, wherein when using the second display mode, a power supply controlling circuit for a driver circuit in the display controller outputs a voltage which is lower than that in the first display mode.

21. The display device according to claim 15, wherein the display device is incorporated in to an electronic apparatus selected from the group consisting of a portable information terminal, a personal computer, a video camera, and an image reproducing device.

22. A driving method of a display device comprising a display and a light sensor, the method comprising:

selecting a display mode between a first display mode and a second display mode in accordance with intensity of an outside light received by the light sensor;

in the selected display mode, selecting a plurality of gate signal lines within one gate selection period by dividing one gate selection period into a plurality of sub-gate selection periods and selecting a gate signal line of one row within the sub-gate selection period, wherein in the first display mode, one frame period is divided into a plurality of subframe periods, each of the plurality of subframe periods is either a lighting period or a non-lighting period, and an n-bit (where n is a natural number equal to or more than 2) gray scale is expressed by the sum total of a lighting time within the one frame period, and wherein in the second display mode, the display is operated by a lower clock frequency and a lower driving voltage than in the first display mode, one frame period is either a lighting period or a non-lighting period, and a one-bit gray scale is expressed by a lighting time within the one frame period.

23. The method according to claim 22, wherein the intensity of outside light when the first display mode is selected is higher than the intensity of outside light when the second display mode is selected.

24. The method according to claim 22, wherein the display device further comprises a frame memory, n-bit data (where n is a natural number equal to or more than 2) is written into the frame memory, the n-bit data is read from the frame memory to perform display in the first display mode, m-bit data (where m is a natural number less than n) is written into the frame memory, and the m-bit data is read from the frame memory to perform display in the second display mode.

25. The method according to claim 22, wherein the display includes a light-emitting element in each pixel, and a voltage applied to the light-emitting element in the first display mode is higher than a voltage applied to the light-emitting element in the second display mode.

26. The method according to claim 22, wherein the one frame period has a period for writing to a pixel, a display period, and an erasing period in the first display mode.

27. The method according to claim 22, wherein the display device is incorporated in to an electronic apparatus selected from the group consisting of a portable information terminal, a personal computer, a video camera, and an image reproducing device.

* * * * *